US012601251B2

(12) United States Patent
Short et al.

(10) Patent No.: US 12,601,251 B2
(45) Date of Patent: Apr. 14, 2026

(54) RIG OPERATIONS INFORMATION SYSTEM

(71) Applicant: Schlumberger Technology Corporation, Sugar Land, TX (US)

(72) Inventors: Geoffrey Peter Short, Ackworth (GB); James Curtis Brannigan, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/807,959

(22) Filed: Jun. 21, 2022

(65) Prior Publication Data

US 2022/0316316 A1 Oct. 6, 2022

Related U.S. Application Data

(63) Continuation of application No. 15/768,569, filed as application No. PCT/US2016/057258 on Oct. 17, 2016, now Pat. No. 11,365,623.

(60) Provisional application No. 62/396,883, filed on Sep. 20, 2016, provisional application No. 62/243,132, filed on Oct. 18, 2015.

(51) Int. Cl.

| | |
|---|---|
| ***E21B 47/04*** | (2012.01) |
| ***E21B 19/00*** | (2006.01) |
| ***E21B 19/02*** | (2006.01) |
| ***E21B 44/00*** | (2006.01) |

(52) U.S. Cl.

CPC ..... *E21B 47/04* (2013.01); *E21B 19/008* (2013.01); *E21B 19/02* (2013.01); *E21B 44/00* (2013.01)

(58) Field of Classification Search

CPC ..... E21B 47/04; E21B 19/008; E21B 19/02; E21B 44/00

See application file for complete search history.

(56) References Cited

U.S. PATENT DOCUMENTS

| | | | | |
|---|---|---|---|---|
| 5,881,310 | A | 3/1999 | Airhart et al. | |
| 7,031,840 | B1 * | 4/2006 | Brett | E21B 44/00 702/9 |
| 7,548,873 | B2 * | 6/2009 | Veeningen | G06Q 10/06312 705/7.22 |
| 8,672,055 | B2 | 3/2014 | Boone et al. | |
| 9,428,961 | B2 * | 8/2016 | Benson | E21B 7/06 |
| 11,106,185 | B2 * | 8/2021 | Benson | E21B 44/00 |
| 11,365,623 | B2 | 6/2022 | Short et al. | |

(Continued)

FOREIGN PATENT DOCUMENTS

| | | | |
|---|---|---|---|
| WO | WO-2014160561 A1 * | 10/2014 | E21B 21/08 |
| WO | WO-2015123591 A1 * | 8/2015 | E21B 41/0007 |

OTHER PUBLICATIONS

Saeverhagen et al. "Utilization of Key Performance Indicators and Benchmarking Improves Drilling Performance for Several Operators." Paper presented at the SPE/IADC Middle East Drilling Technology Conference & Exhibition, Dubai, UAE, Oct. 2013 (Year: 2013).*

(Continued)

*Primary Examiner* — Raymond L Nimox

(74) *Attorney, Agent, or Firm* — Jeffrey D. Frantz

(57) ABSTRACT

A system includes a data interface that receives data associated with a plurality of wells; an inference engine that receives and analyzes at least a portion of the data to generate results; and a communication engine that outputs information based at least in part on the results.

17 Claims, 36 Drawing Sheets

(56) References Cited

U.S. PATENT DOCUMENTS

| | | | | |
|---|---|---|---|---|
| 2004/0040746 | A1* | 3/2004 | Niedermayr | E21B 44/00 175/48 |
| 2005/0211468 | A1* | 9/2005 | Veeningen | E21B 7/04 175/24 |
| 2007/0199721 | A1* | 8/2007 | Givens | G06Q 10/06 166/382 |
| 2008/0208475 | A1* | 8/2008 | Karr | G06F 16/26 702/6 |
| 2008/0314641 | A1 | 12/2008 | McClard | |
| 2009/0064025 | A1* | 3/2009 | Christ | G06Q 10/087 715/772 |
| 2009/0099777 | A1 | 4/2009 | Roy et al. | |
| 2009/0132458 | A1* | 5/2009 | Edwards | G06N 5/025 702/9 |
| 2009/0152005 | A1* | 6/2009 | Chapman | E21B 44/00 702/9 |
| 2009/0153354 | A1 | 6/2009 | Daussin et al. | |
| 2012/0118637 | A1* | 5/2012 | Wang | E21B 44/00 700/29 |
| 2012/0123756 | A1* | 5/2012 | Wang | E21B 44/00 703/2 |
| 2014/0173501 | A1* | 6/2014 | Wu | G06F 3/0481 715/781 |
| 2015/0029034 | A1* | 1/2015 | Abbassian | E21B 44/00 340/853.2 |
| 2015/0053482 | A1* | 2/2015 | Boone | E21B 7/022 175/24 |
| 2015/0053483 | A1* | 2/2015 | Mebane, III | E21B 12/02 175/26 |
| 2015/0112949 | A1* | 4/2015 | Marland | G06F 16/244 707/688 |
| 2015/0377003 | A1 | 12/2015 | Benson et al. | |
| 2016/0024847 | A1 | 1/2016 | Benson et al. | |
| 2016/0053603 | A1 | 2/2016 | Israel et al. | |

OTHER PUBLICATIONS

El Afifi, Sameh , Albassam, Bassam , and Fadi Atef Fahmy. "Enhance the Drilling & Tripping Performance on Automated Rigs with fully automated performance measurement." Paper presented at the SPE Middle East Intelligent Oil and Gas Conference and Exhibition, Abu Dhabi, UAE, Sep. 2015. (Year: 2015).*

Svensson, Inge , Saeverhagen, Erland , and Fouzi M Bouillouta. "Driving Rig Performance through Real-Time Data Analysis, Benchmarking, Dashboards and Developed Key Performance Indicators." Paper presented at the SPE Digital Energy Conference and Exhibition, The Woodlands, Texas, USA, Mar. 2015. (Year: 2015).*

Dashevskiy, D., Dahl, T., Brooks, A. G., Zurcher, D., Lofts, J. C., and S. Dankers. "Dynamic Depth Correction to Reduce Depth Uncertainty and Improve MWD/LWD Log Quality." SPE Drill & Compl 23 (2008): 13-22. doi: https://doi.org/10.2118/103094-PA ( Year: 2008).*

International Search Report and Written Opinion issued in International Patent application PCT/US2016/057258, dated Mar. 27, 2017. 15 pages.

Svensson et al., Driving Rig Performance through Real-Time Data Analysis, Benchmarking, Dashboards and Developed Key Performance Indicators. SPE-173413-MS. Society of Petroleum Engineers, SPE Digital Energy Conference and Exhibition, Mar. 3-5, 2015, The Woodlands, Texas, USA. 9 pages.

Extended Search Report for the equivalent European Patent Application No. 16858032.2 mailed on May 22, 2019.

Svensson, Inge, "Driving Rig Performance through Real-Time Data Analysis, Benchmarking, Dashboards and Developed Key Performance Indicators", Mar. 3-5, 2015, The Woodlands, Texas, USA. Presentation slides as supplemental material (https://spe.silverchair-cdn.com/spe/content_public/conference/15dec/2-15dec/spe-173413-ms/2/spe-173413-sup.pdf?) as to Svensson et al., "Driving Rig Performance through Real-Time Data Analysis, Benchmarking, Dashboards and Developed Key Performance Indicators." Paper presented at the SPE Digital Energy.

* cited by examiner

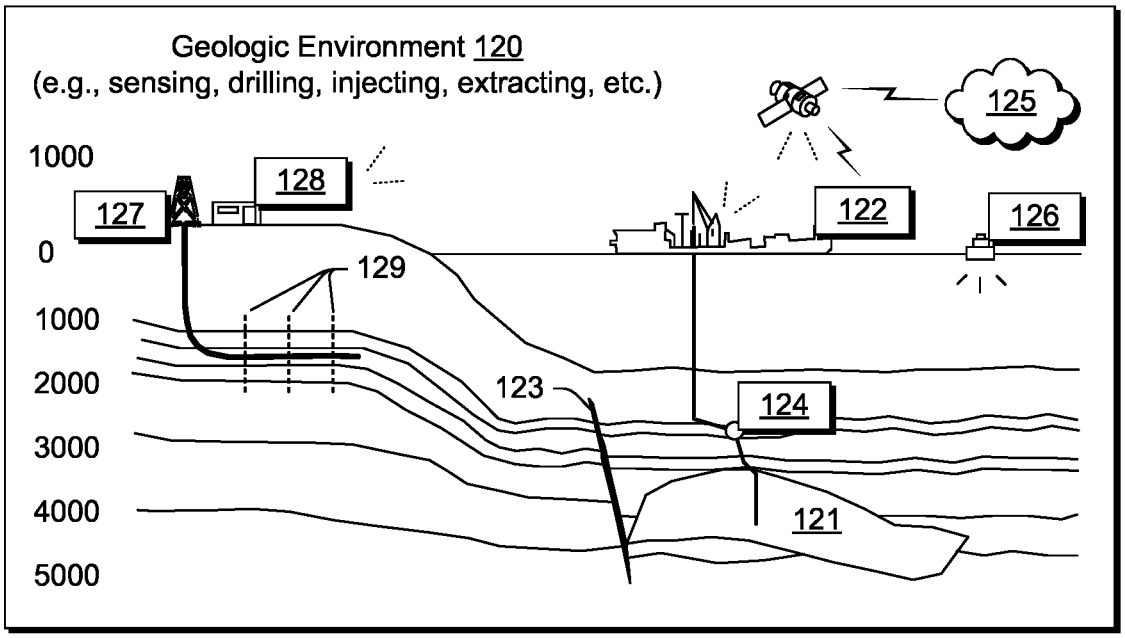
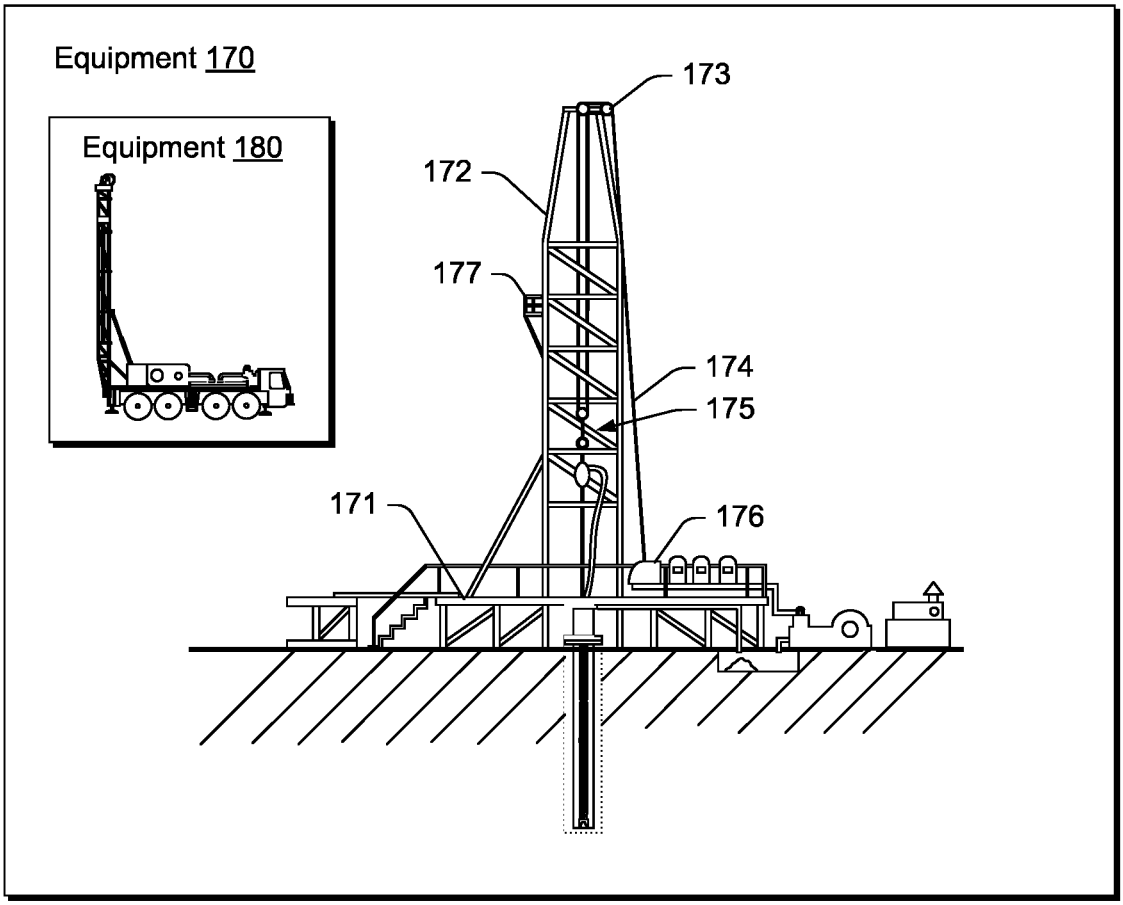
Fig. 1

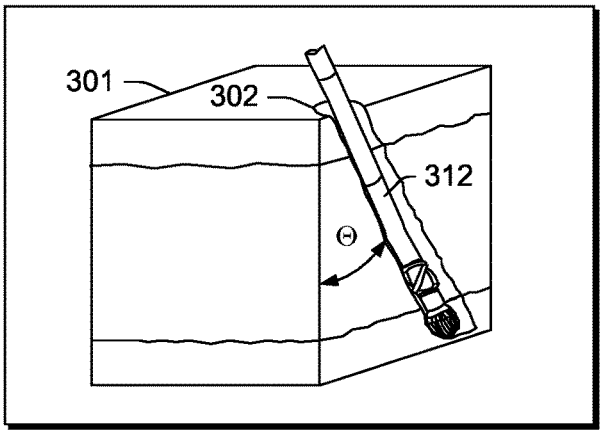
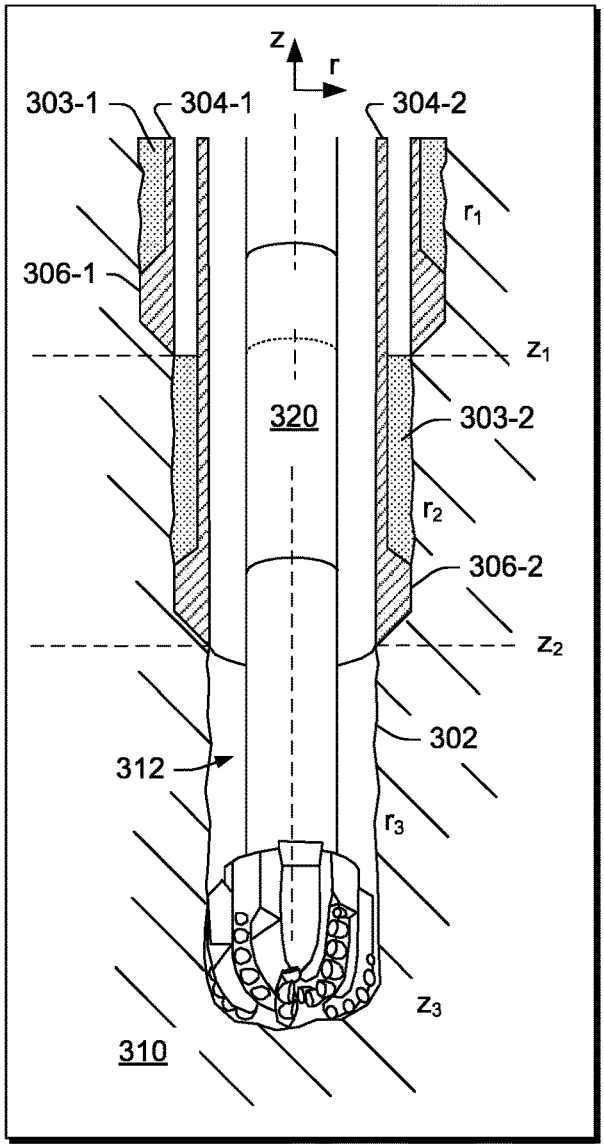
Fig. 3

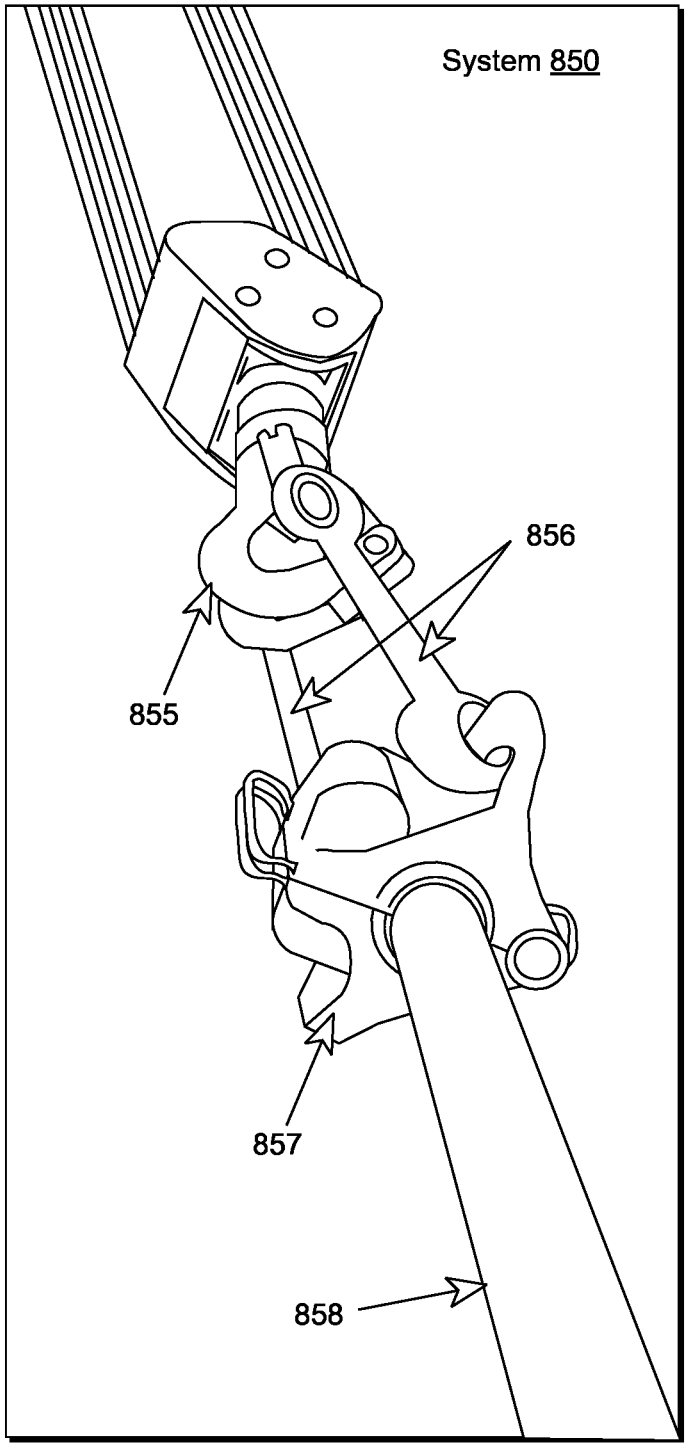
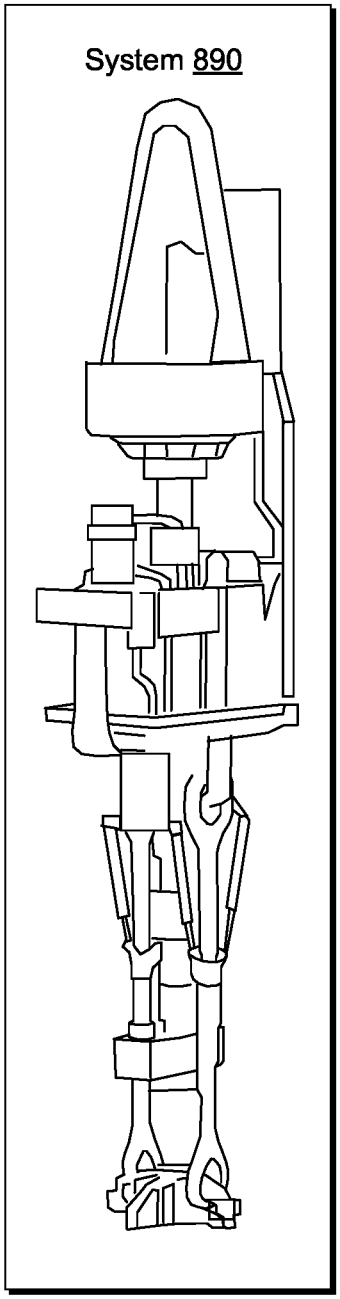
Fig. 8

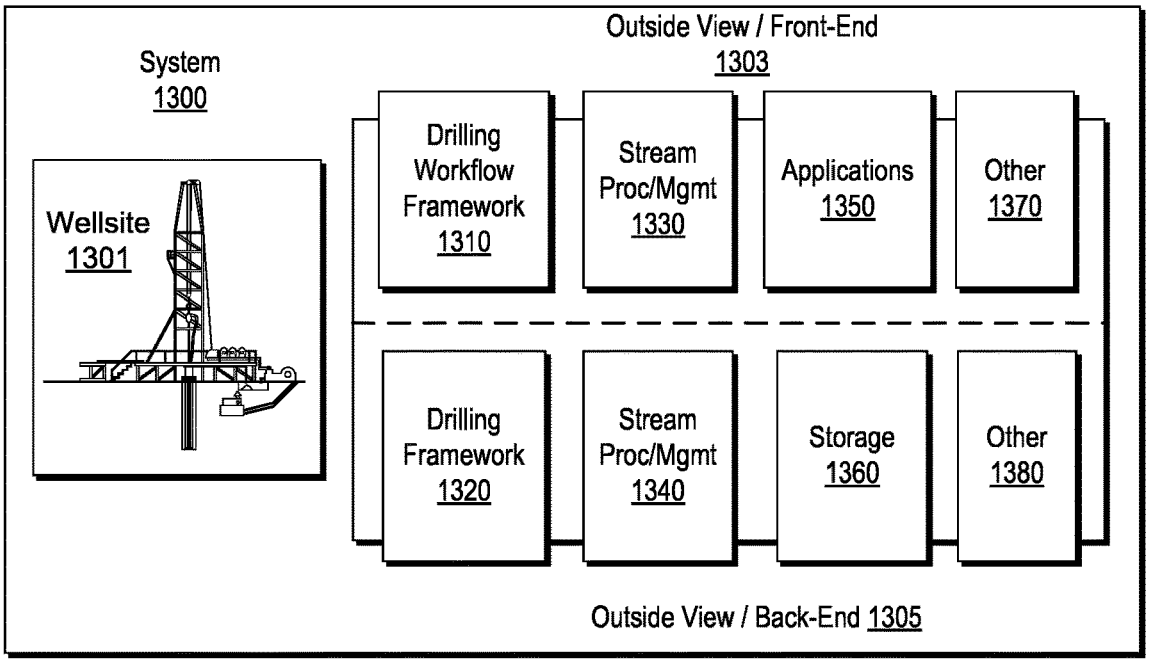
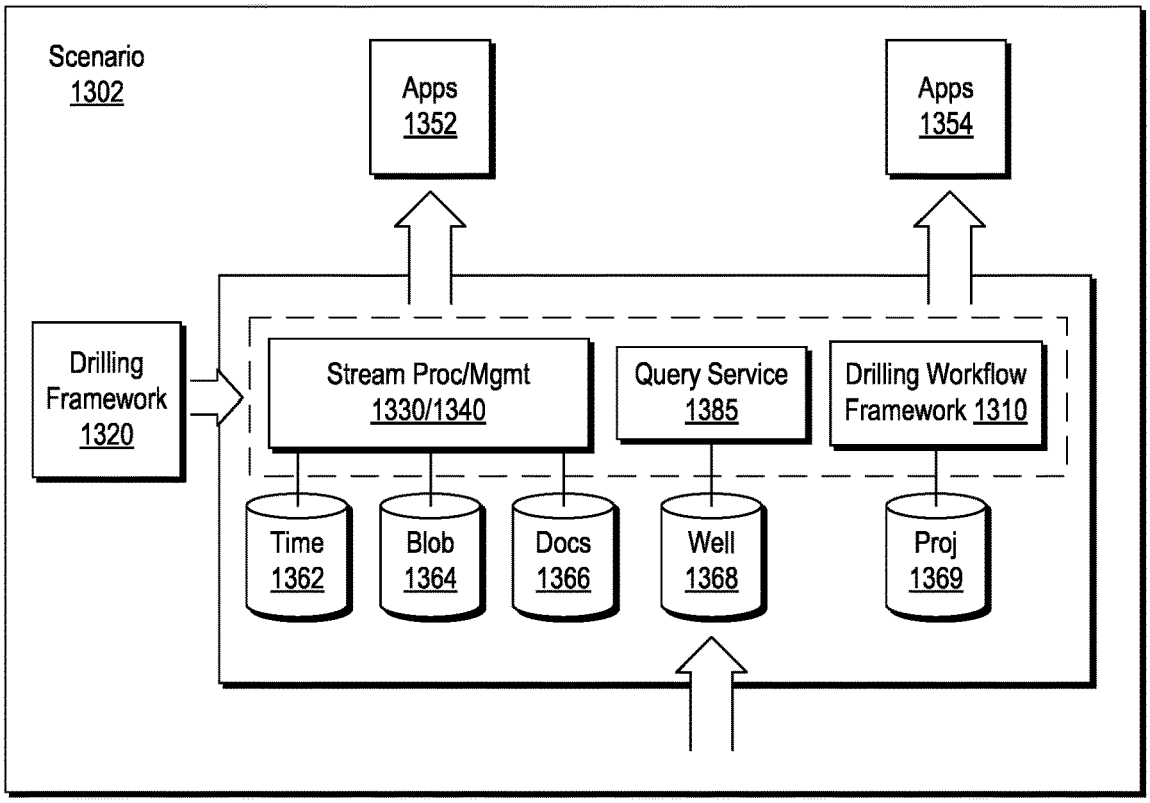
Fig. 13

1510

| Drilling Variables |
| --- |
| Daily Footage > 1000M |
| Daily Footage > 2000M |
| Daily Footage < 25m |
| Reaming > 2 hours |
| Bit Code DTF |
| Bit Code Balling |
| D&M Daily Cost= |
| MI Daily Cost= |
| Reason Pulled IADC Code = PR |
| Average 15M DLS = |
| Kick Off Point |
| Drilling Day=date |

1520

| Events |
| --- |
| Stuck Pipe |
| Lost Circulation |
| Lost Turns |
| Kick |
| Collapse |
| Unconsolidated zone |
| Junk in hole |
| Cement-related |
| Drillstring vibration |
| Wellbore geometry |
| Hole cleaning |
| Other(s) |

1550

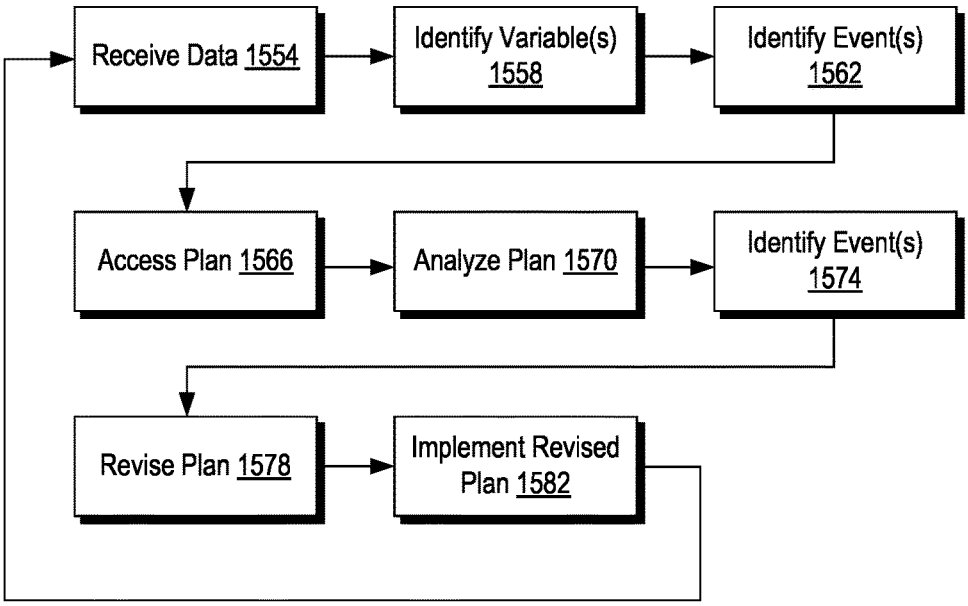

Fig. 15

1600

Escalation Matrix
Defines the subjects and the responsibilities
L1: Level 1 (NPT < 30 min and other events)
L2: Level 2 (NPT > 30 min and other events)
L3: Level 3 (NPT > 120 min and other events)

NPT - Non-productive time

Validate Export to file

| CLASS | | Rig site drilling supervisor | Rig site drilling engineer | Operations Geologist | Drilling Engineer | Drilling Superintent | Drilling Manager | Company Specialist - Drilling Fluids | Company Specialist - Cementing | Company Specialist - Drilling Mechanics | Workflow Supervisor | Workflow Approver | Operator |
|---|---|---|---|---|---|---|---|---|---|---|---|---|---|
| Directional Drilling | Tools and General | L1 | L2 | L3 | | | | | | | | | |
| | AC Scan | L1 | L2 | L3 | | | L2 | | | | | L3 | |
| | Trajectory Control | L1 | | L3 | | | L2 | | | L1 | | L3 | |
| LWD | LWD Tool | | | | L1 | | | | L2 | | | | |
| | Log data quality and Iterpretation | | | | L1 | | | | | | | | |
| | RT comms and extenders | | | | L1 | | | L2 | | | L3 | | |
| MWD | Survey - Telemetry and Tool | | | | | | | | | | | | |
| Drilling Optimization | Schock and Vibrations | | L1 | | | | L2 | | | L3 | | | |
| | Drilling Mechanics | | | | | | | | | | | | |
| | Wellbore Stability | | | L1 | | | L2 | | | L3 | | | |
| Data Transmission | Connectivity | L1 | | | L2 | | | | | | L3 | | |
| | InterACT | | | | L3 | | L2 | | | | | | L1 |
| | Data Configuration | | | L1 | | | | L2 | | | L3 | | |
| Service Quality Checks | Pre-Job Pre-Run and Validation | | L3 | | | | | | | | | | |
| Surface | Software - Sensors and Equipment | | | L3 | | L1 | | | | | L3 | | |

Fig. 16

Links | Records

GUI 2100

Link Name:

Setup File:

| Record Name | State | Distance | Seconds | Source |
|---|---|---|---|---|
| 45 General Drilling | ON | | 30 | <port> |
| 46 Advanced Drilling | ON | | 30 | <port> |
| 47 General Depth | ON | 0.5 | | <port> |
| 48 Advanced Depth | ON | 0.5 | | <port> |
| 49 Pumps | ON | | 30 | <port> |
| 50 Pits | ON | | 30 | <port> |
| 51 Volumes | ON | | 30 | <port> |

Fig. 21

GUI 2600

Channels

Drillstand Connection Time

Drillstand NonDrill Time

Drillstand Num Block Direction

Drillstand Num Pickup Bottom

Drillstand Post Connection Time

Drillstand Pre Connection Time

Drillstand Rotary Drill Time

Drillstand Slide Drill Time

Drillstand Total Drill Time

Drillstand Total Connection Time

Drill Tim

Fig. 26

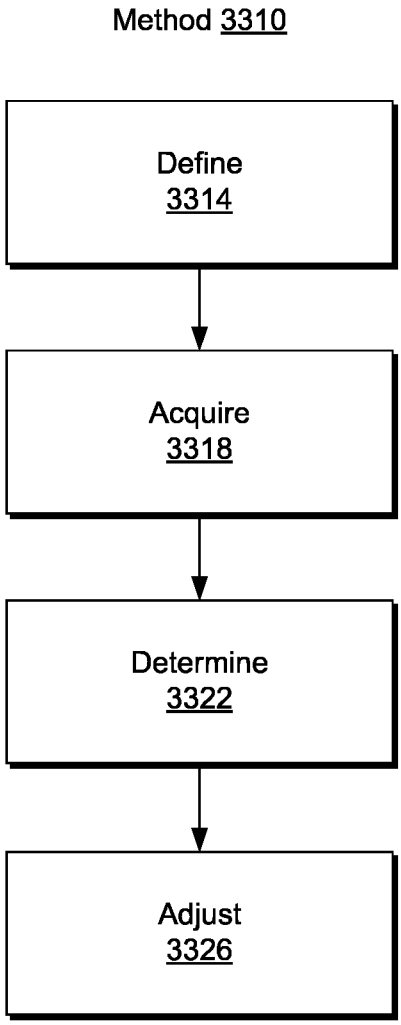
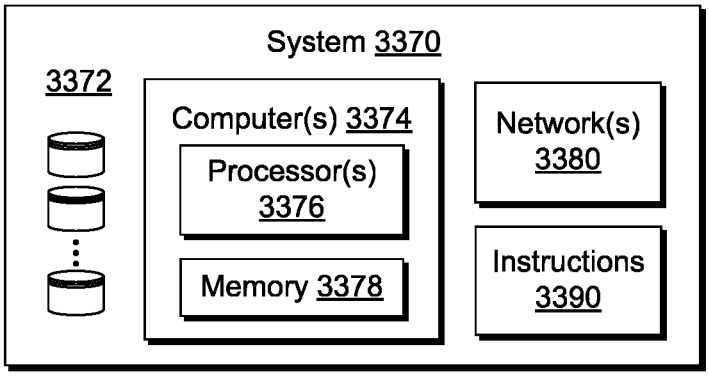
Fig. 33

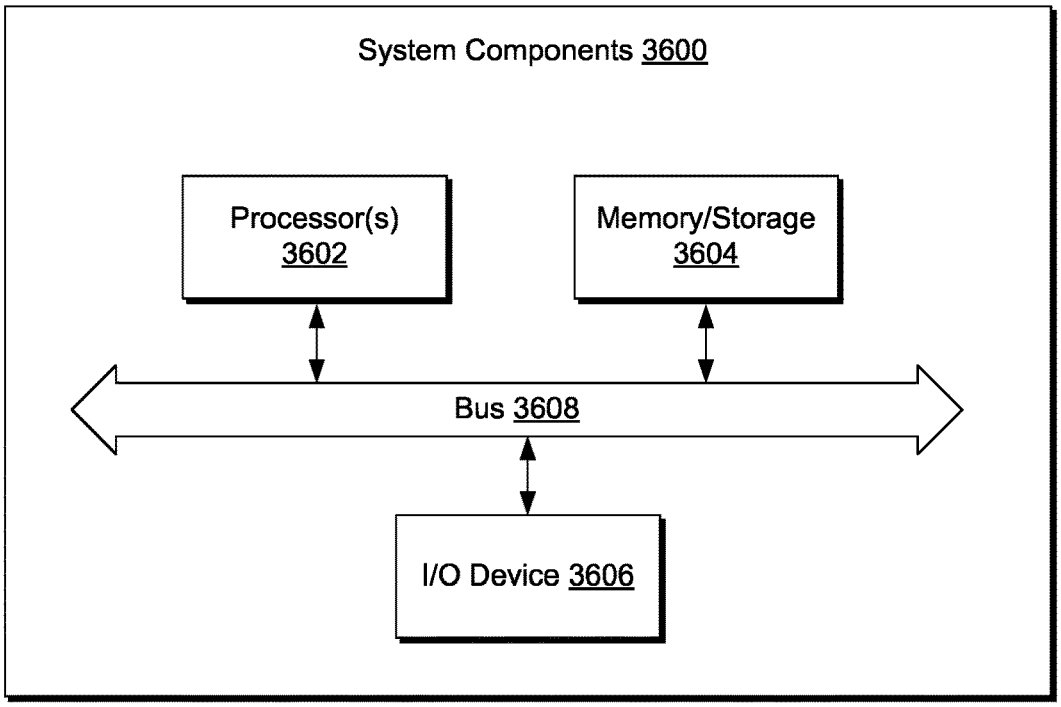
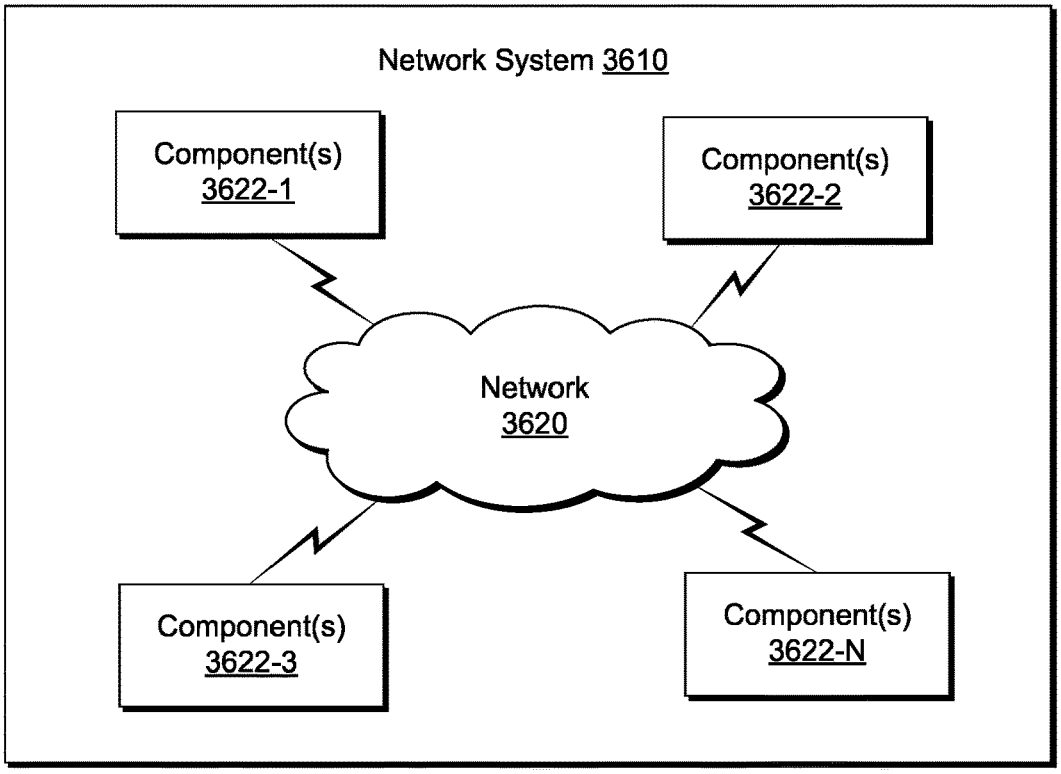
Fig. 36

RIG OPERATIONS INFORMATION SYSTEM

RELATED APPLICATIONS

This application is a continuation of U.S. patent application Ser. No. 15/768,569, filed 16 Apr. 2018, which is a national stage application filed under 35 U.S.C. 371 of international patent application no. PCT/US2016/057258 filed on 17 Oct. 2016, which claims priority to a US Provisional Application having Ser. No. 62/243,132, filed Oct. 18, 2015, and US Provisional Application having Ser. No. 62/396,883, filed Sep. 20, 2016. The above applications are incorporated by reference herein.

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning can occur over one or more phases, which can include an exploration phase that aims to identify and assess an environment (e.g., a prospect, a play, etc.), which may include drilling of one or more bores (e.g., one or more exploratory wells, etc.). Other phases can include appraisal, development and production phases.

SUMMARY

A system includes a data interface that receives data associated with a plurality of wells; an inference engine that receives and analyzes at least a portion of the data to generate results; and a communication engine that outputs information based at least in part on the results. A method includes receiving data associated with a plurality of wells; analyzing at least a portion of the data using an interpretation engine to generate results; and outputting information based at least in part on the results. One or more computer-readable storage media include processor-executable instructions to instruct a computing system to: receive data associated with a plurality of wells; analyze at least a portion of the data using an interpretation engine to generate results; and output information based at least in part on the results. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 3 illustrates examples of equipment with respect to a geologic environment;

FIG. 8 illustrates examples of systems for handling equipment;

FIG. 13 illustrates an example of a system and an example of a scenario

FIG. 15 illustrates examples of variables, examples of events and an example of a method;

FIG. 16 illustrates an example of a communication matrix;

FIG. 21 illustrates an example of a graphical user interface;

FIG. 26 illustrates an example of a graphical user interface;

FIG. 33 illustrates an example of a method and an example of a system;

FIG. 36 illustrates example components of a system and a networked system.

DETAILED DESCRIPTION

Figure 2:
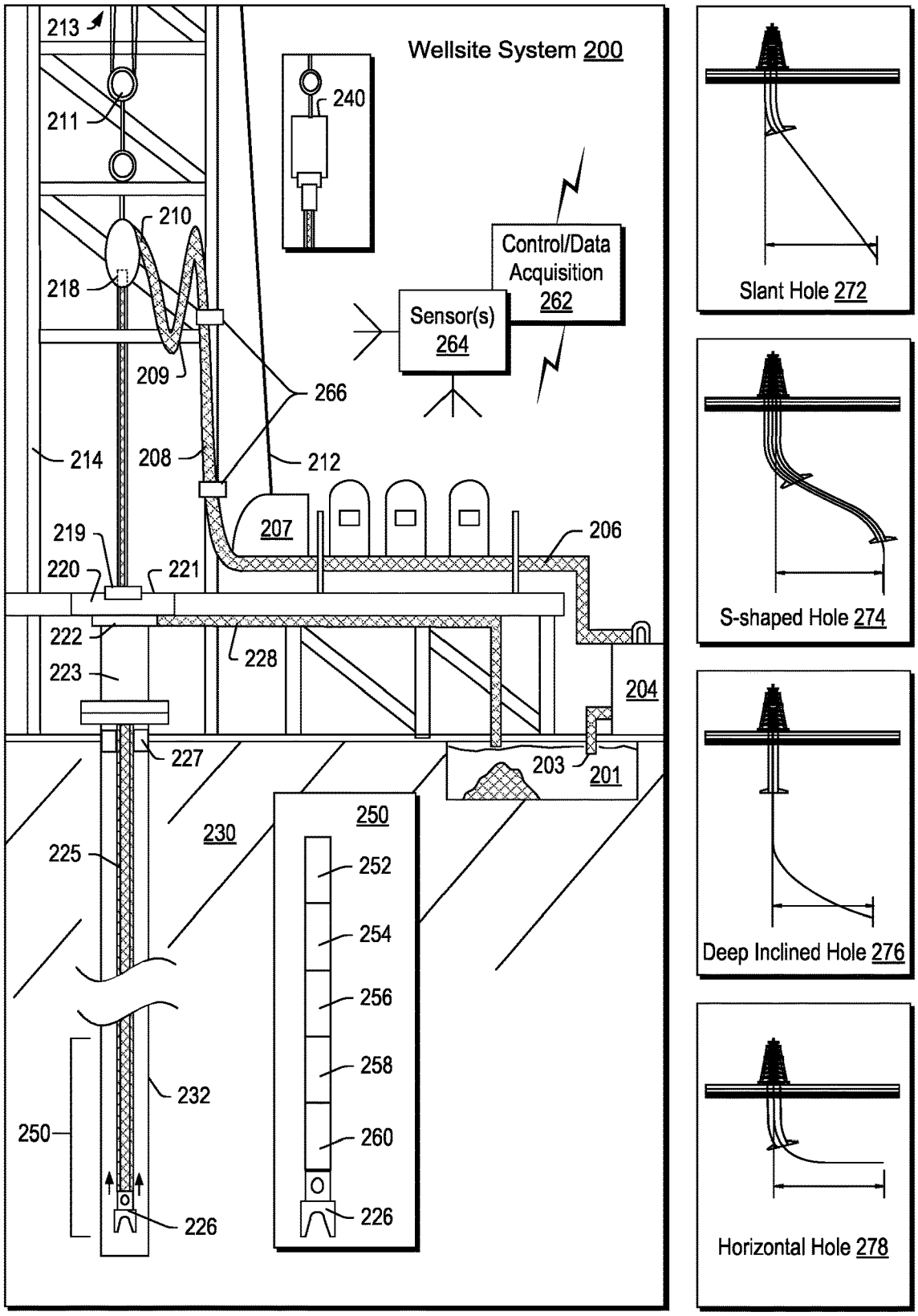
FIG. 2 illustrates examples of equipment and examples of hole types.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the drill floor 221 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226. Such components or modules may be referred to as tools where a drillstring can include a plurality of tools.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform a method such as geosteering. As an example, a steerable system can include a PDM or a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

FIG. 3 illustrates an example of a system 310 that includes a drill string 312 with one or more tools (or module(s)) 320. In the example of FIG. 3, the system 310 is illustrated with respect to a wellbore 302 (e.g., a borehole) in a portion of a subterranean formation 301 (e.g., a sedimentary basin). The wellbore 302 may be defined in part by an angle (Θ); noting that while the wellbore 302 is shown as being deviated, it may be vertical (e.g., or include one or more vertical sections along with one or more deviated sections, which may be, for example, lateral, horizontal, etc.).

As shown in an enlarged view with respect to an r, z coordinate system (e.g., a cylindrical coordinate system), a portion of the wellbore 302 includes casings 304-1 and 304-2 having casing shoes 306-1 and 306-2. As shown, cement annuli 303-1 and 303-2 are disposed between the wellbore 302 and the casings 304-1 and 304-2. Cement such as the cement annuli 303-1 and 303-2 can support and protect casings such as the casings 304-1 and 304-2 and when cement is disposed throughout various portions of a wellbore such as the wellbore 302, cement can help achieve zonal isolation.

In the example of FIG. 3, the wellbore 302 has been drilled in sections or segments beginning with a large diameter section (see, e.g., $r_1$) followed by an intermediate diameter section (see, e.g., $r_2$) and a smaller diameter section (see, e.g., $r_3$). As an example, a large diameter section may be a surface casing section, which may be three or more feet in diameter (e.g., about one meter or more) and extend down several hundred feet (e.g., about 50 m or more) to several thousand feet (e.g., about 500 m or more). A surface casing section may aim to prevent washout of loose unconsolidated formations. As to an intermediate casing section, it may aim to isolate and protect high pressure zones, guard against lost circulation zones, etc. As an example, intermediate casing may be set at about X thousand feet and extend lower with one or more intermediate casing portions of decreasing diameter (e.g., in a range from about thirteen to about five inches in diameter or from about 33 cm to about 13 cm in diameter). A so-called production casing section may extend below an intermediate casing section and, upon completion, be the longest running section within a wellbore (e.g., a production casing section may be thousands of feet in length). As an example, production casing may be located in a target zone where the casing is perforated for flow of fluid into a lumen of the casing.

Figure 4:
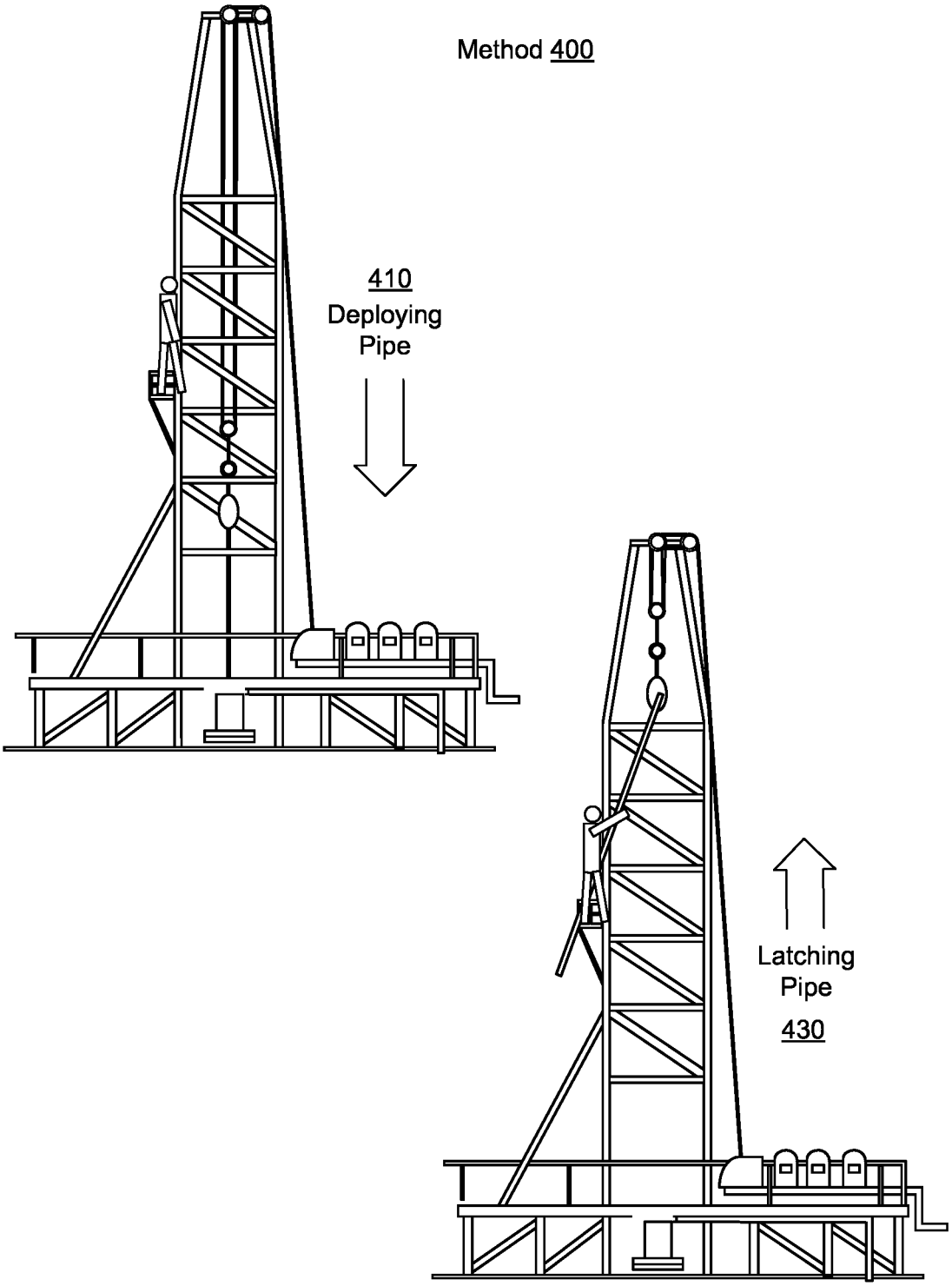
FIG. 4 illustrates an example of a method.

FIG. 4 shows an example of a method 400 that includes deploying pipe 410 and latching pipe 430. As shown, deploying pipe 410 involves moving a traveling block downward while latching pipe 430 involves moving a traveling block upward. As to when pipe latching occurs, it may occur while the traveling block is moving upwards.

Figure 5:
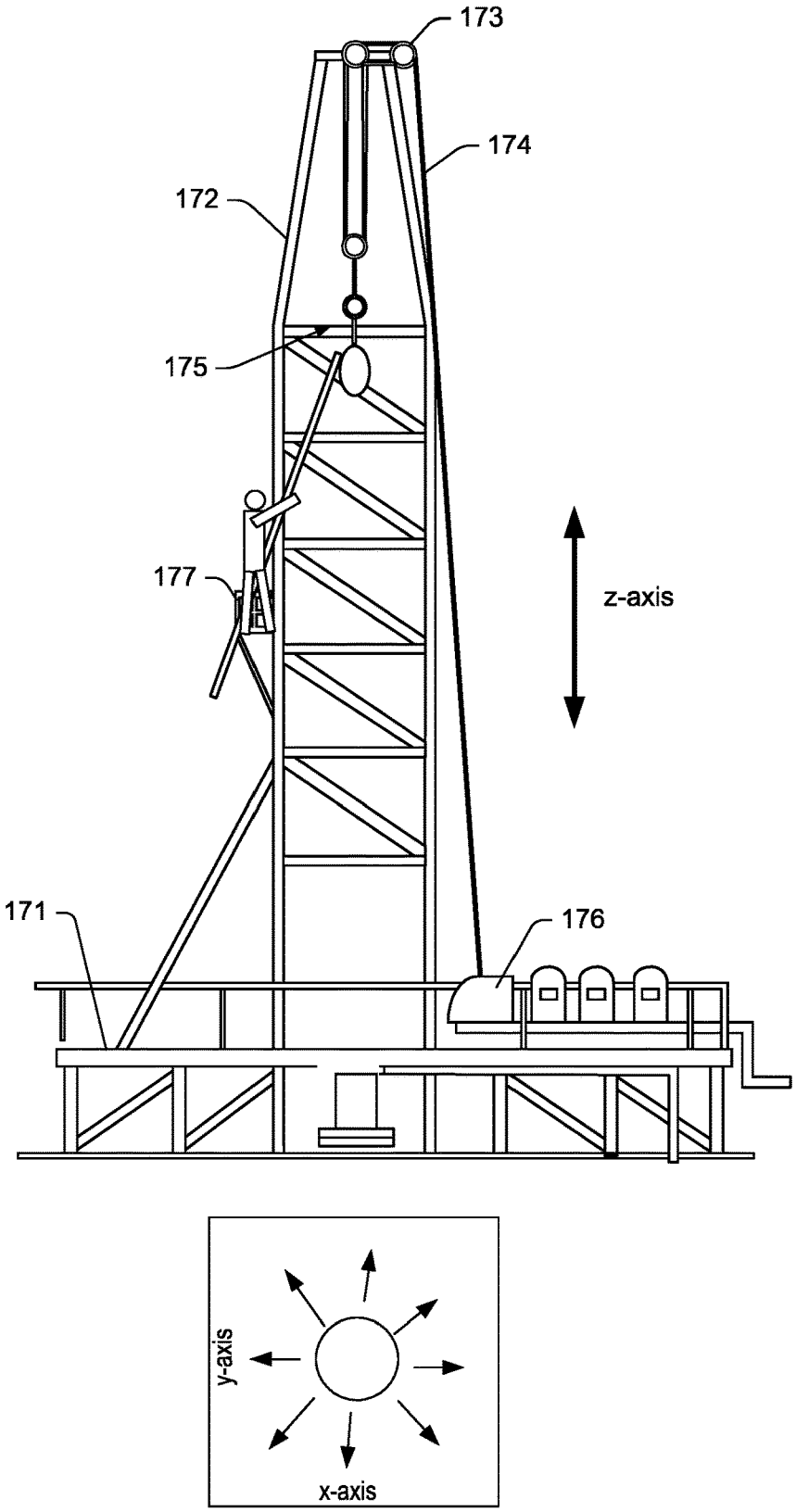
FIG. 5 illustrates an example of a system with a coordinate system.

FIG. 5 shows a portion of the equipment 170 of FIG. 1 with respect to a z-axis and an x,y-plane, defined by an x-axis and a y-axis. As an example, a cylindrical or other coordinate system may be used. As shown in FIG. 5, the traveling block assembly 175 can move in various directions; noting that various operations are effectuated via movement along the z-axis.

Figure 6:
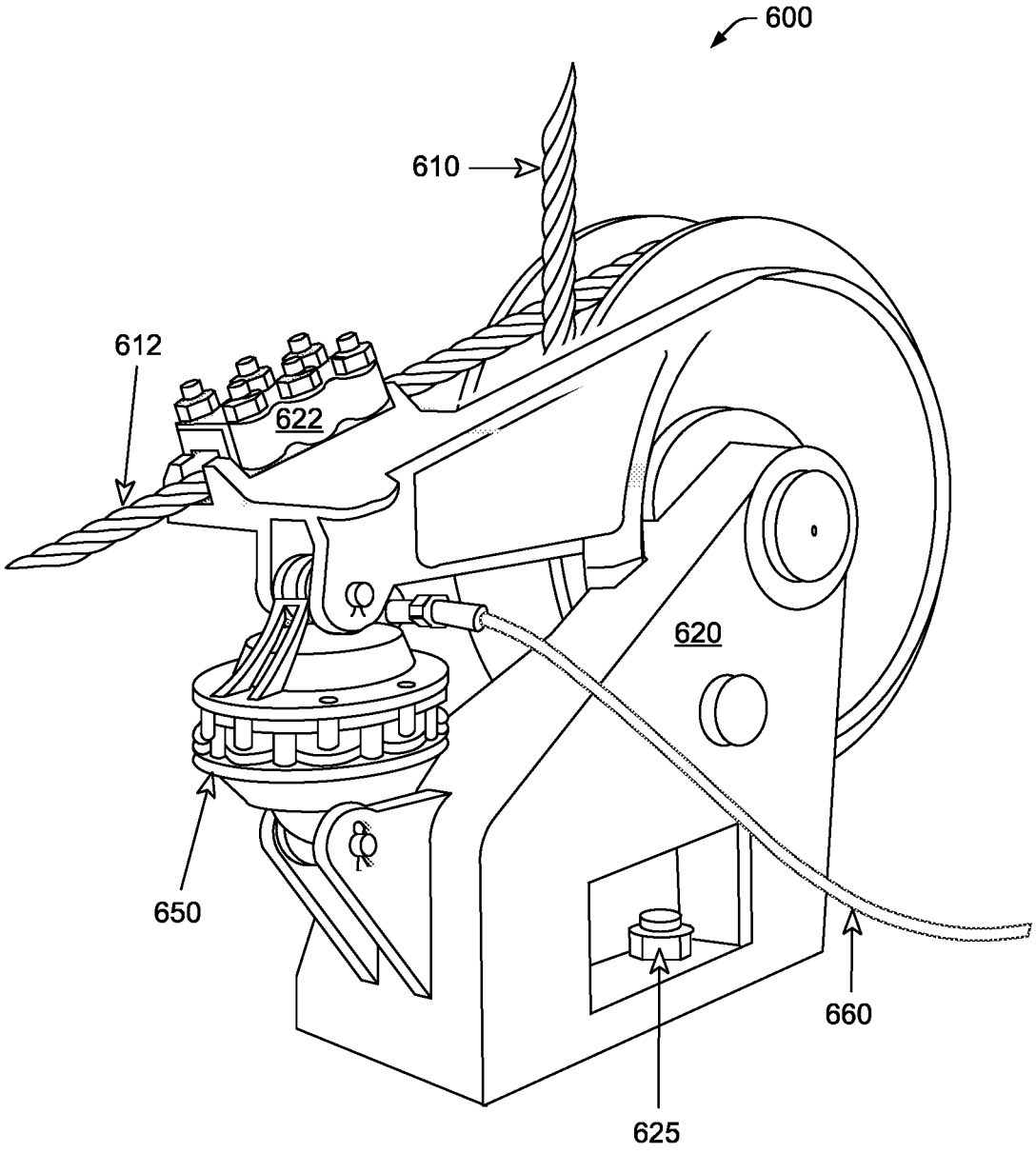
FIG. 6 illustrates an example of equipment.

FIG. 6 shows an example of a drawworks assembly 600 that can be operatively coupled to line where the line includes a so-called deadline 610 and a supply reel line 612 operatively coupled to a body 620. In the example of FIG. 6, a deadline tie-down anchor 622 of the body 620 firmly grips one end of the drilling line and keeps it from moving; noting that the body 620 itself is anchored, for example, via an anchoring mechanism 625 (e.g., bolted to a rig's substructure or to another heavy, stationary part of the rig).

Besides anchoring the drilling line, the assembly 600 can also serve as a mount for a weight indicator sensor such as a load sensor 650. Such a sensor may be operatively coupled to a hydraulic line 660 that can output a weight indication to a gauge, etc. For example, a drilling console can include a gauge that indicates to an operator how much a traveling block load may be and, for example, how much weight is on a bit. As an example, a load may be referred to as a hook load, which indicates how much weight is hanging from a hook. As an example, weight on a bit may be how much drill stem weight is pressing on the bit.

As an example, the load sensor 650 may be a strain sensor (e.g., a strain gauge). As an example, as weight of a load on a deadline flexes the deadline, the load sensor can pick up the flexes and send a signal to the weight indicator gauge (e.g., on the rig floor, drilling console, etc.). The weight indicator may be configured to translate such a signal into weight on the bit and the hook load.

As an example, an assembly such as the assembly 600 of FIG. 6 can be used to estimate depth of equipment in a bore in a geologic environment. For example, depth of a drill bit may be of interest, depth of a tool may be of interest, etc. As an example, where a tool can acquire measurements in a bore, these may be recorded, plotted, analyzed, etc., with respect to depth. In such an example, the depth may be an estimate acquired at least in part via an assembly such as the assembly 600 of FIG. 6.

As an example, a "tape measure" approach may include measuring distance between pipe joints, for example, prior to insertion of the pipe into a bore. For example, consider a scheme where a driller keeps a tally of pipe measurements that is utilized to calculate an "official" depth of a well.

As mentioned, tools may be used to acquire information in a bore. For example, consider logging while drilling. In logging while drilling (LWD), an approach that can implement continuous tracking of depth may help to produce measurement registries that may be more accurate than those achieved via a joint-to-joint tracking scheme.

As an example, a depth tracking system based on a rotary encoder records movement of a travelling block in between joints to infer measurement of pipe length as it is lowered into or pulled out of the ground. Other measurements may be derived from a rotary encoder process. For example, it may be possible to track rate of penetration while drilling, or pipe speed when tripping (e.g., measurements that help provide for safe and efficient operations).

As so-called geolograph implements a rotary encoder where a sensor is based on a roll of steel line attached to structure of a derrick (e.g., near a crown block) and the other end attached directly to a travelling block. In the geolograph, line unwinds through a wheel of known circumference whose shaft is connected to a rotary encoder. The rotational movement is translated into pulses that can be tracked to compute block position from a given reference point.

The assembly 600 of FIG. 6 may be referred to as a drawworks encoder approach. A drawworks sensor can be easier and safer to install than a geolograph and utilize a more compact approach by installing the rotary encoder directly on a main shaft of a drill hoisting drum. Depending on length of cable wrapped onto a drawworks drum, to allow for a complete block travel on a derrick, it may wrap onto itself, for example, about 2 or 3 times. In such an approach, the effective diameter of the drum changes, and one revolution of the rotary encoder corresponds to different lengths of line spooling off the drum, hence different distances travelled by the block. Due to multi-wrapping, use of a drawworks encoder involves a relatively complicated calibration procedure, which is to be repeated each time the drill line is replaced due to wear. Further, to calibration, a block reference is often to be reset. Being mechanical in nature and being in-line with the main drawworks shaft means that operations are stopped to perform replacement.

Knowledge of depth can help inform an operator as to a well's actual location, how much casing to bring to a well site, where perforating may be performed, and log information (e.g., to answer a question as to whether a log shows an actual extent of a reservoir). Such concerns can exist where there are mismatches between a driller's tally, wireline depth, and while drilling depth.

Depth information can be a starting point for various operations. For example, depth information may be used to determine lengths and distances for purposes of budgeting materials, scheduling services, requesting permits, and determining construction times. Such factors can impact estimation of cost of a project. While operations are being executed, workers and supervisors may build according to a plan by using depth information-based metrics.

Life of a well, from a planning phase onward, can depend at least in part on depth information. Such information may be used to calculate well trajectory, materials, schedules, well sections and regulatory-related information. Depth information may be used for one or more correlation indexes (e.g., as to previous wells to estimate the zones of interest for economical and safety reasons). Depth references can be used to create a drill plan for a defined well trajectory. Depth information may be used to design one or more well sections, for example, so wellbore stability may be enhanced. Drilling fluids and conditioning chemicals can be estimated, casing quantities and cement volumes and proper equipment scheduled based at least in part on depth information.

Depth from multiple wells in an area may be used by one or more geologists and/or petro-physicists to feed complex models to define development plans and to assess feasibility of such plans.

A drilling process can include adverse conditions that impact the depth measurement. For example, drill pipe thermal expansion and drill pipe mechanical stretch can impact depth measurement. Also, consider phenomena such as pipe squat and sag effect, variable friction factors while rotating and sliding drilling, pressure effects, buoyancy force and offshore rig heave and tidal produced errors. From the drilling process itself setting and removal of slips and drill-off can also affect measurement. In a depth tracking system, as well as in a driller's tally, such error sources can exist. Further, the deeper the well, the more deviated the well, etc., the more prominent such errors may become.

As an example, a local positioning system can help to reduce pipe strapping errors. Such an approach may enhance wireline logs. As an example, a method can include acquiring wireline depth information, which may account for cable stretching, tension regime and thermal factors. As an example, a method may include correlating local positioning system information and wireline depth information. As an example, a method can include associating wireline tool data (e.g., as to wireline tool measurements) with one or more of local positioning system information and wireline depth information. As an example, local positioning system information may be utilized to adjust wireline depth information or other depth information (e.g., measured depth, etc.).

As an example, a local positioning system may be utilized to determine position of a block (e.g., as the block moves up and/or down to determine one or more of its position, speed, acceleration, etc.). As an example, depending on local positioning system capabilities, pendulum movements may be determined (e.g., frequency, etc.), which may be driven by mechanical drivers, weather, etc. As an example, position and/or speed may be determined in a manner that does not depend on an initial position of a block. As an example, a method may include powering off a mechanism and powering on a mechanism to move a traveling block where a local positioning system may be implemented in a manner that does not include calibration, recalibration, etc.

As an example, a local positioning system can provide for indirect drill bit depth measurement. As an example, a local positioning system may be implemented at least in part at a level below a rig structure, for example, in a system for offshore operation. Such an approach may help to reduce effect of heave and tide. For example, a local positioning system fit to an offshore rig may be located in a manner that reduces impact of heave and/or tide. As an example, using an array of transceivers, movement of a platform with reference to a riser and waves can be tracked and fed into a compensation algorithm that can calculate accurate depth and tracking.

Figure 7:
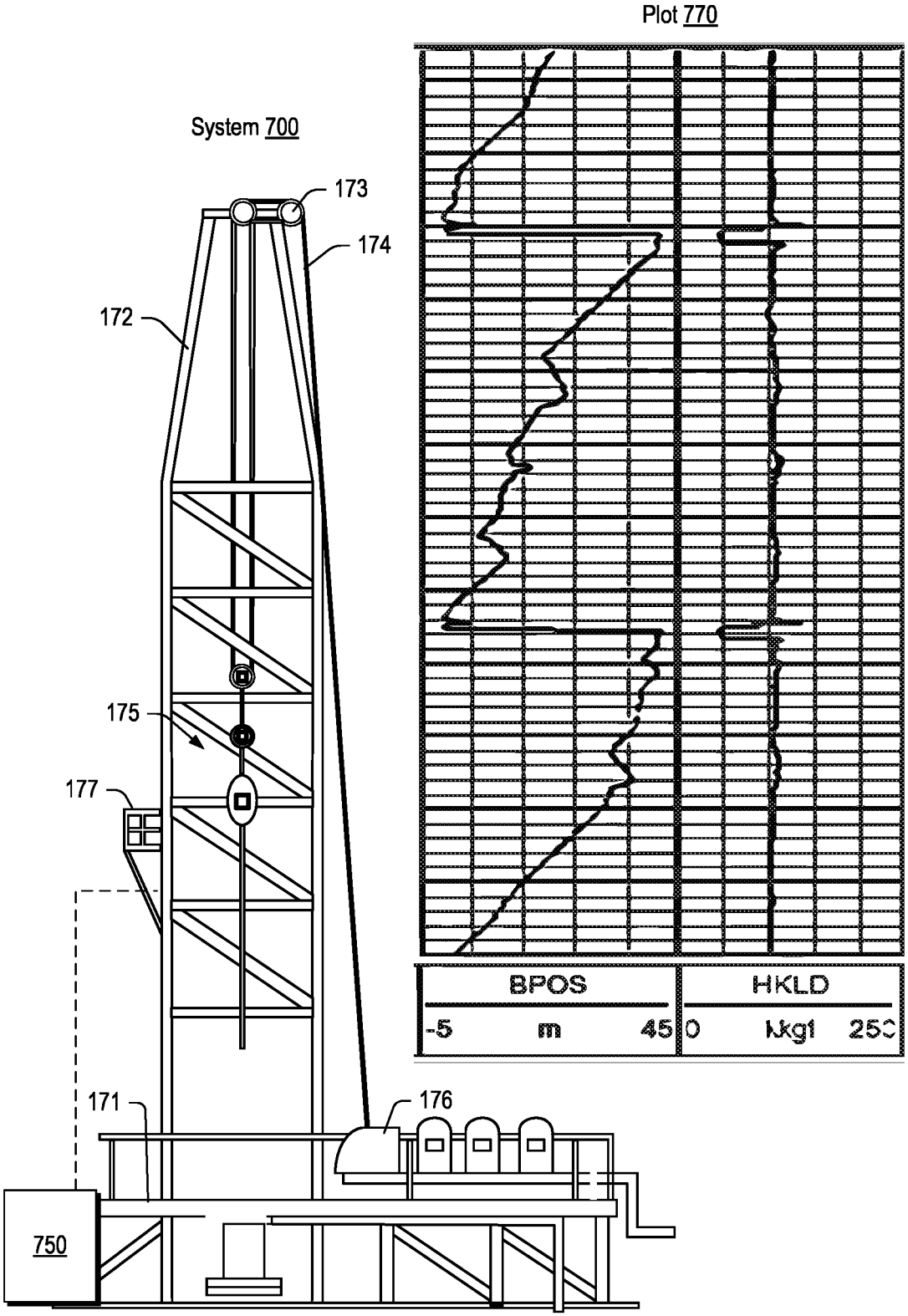
FIG. 7 illustrates an example of a system and an example data plot.

FIG. 7 shows an example of a system 700 that includes one or more data acquisition systems 750. As an example, a data acquisition system may provide for acquiring position and/or load information, for example, as shown in an example plot 770 of FIG. 7 where BPOS is the block position, which can be seen to move in a range from about—5 meters to about 45 meters and where HKLD is the hook load. Both BPOS and HKLD are shown with respect to depth (vertical axis), which may be time stamped.

As an example, data as to block position and/or data as to hook load may be utilized to estimate depth. In such an example, portions of block position data may be associated with pipe length and, where pipe length is measured and tallied, the portions of block position data may be utilized to characterize uncertainty in a pipe length based estimate of depth (e.g., measured depth). As an example, portions of hook load data may allow for determining forces experienced by pipe in a wellbore, which may be utilized to characterize uncertainty in a pipe length based estimate of depth (e.g., measured depth). For example, where pipe stretches with respect to weight and time, hook load data may be utilized to determine an expected amount of stretching per pipe segment, a minimum amount of stretching per pipe segment, a maximum amount of stretching per pipe segment, etc. In combination, block position data and load data (e.g., hook load data) can help to estimate depth and/or characterize uncertainty in one or more depth estimates, which may be based in part on known pipe lengths, measured pipe lengths, etc.

As an example, block position data and/or hook load data may be utilized to determine operational times and/or non-operational times. For example, non-productive time can be a non-operational type of time. Where a block is stationary with respect to time (e.g., over an increment of time that exceeds a predetermined increment of acceptable non-movement), a wellsite may be in a non-productive mode. In such an example, hook load data may be analyzed to determine whether such data is changing or stationary. As an example, an analysis of one or more types of data may occur in response to data indicative of a stationary block. As an example, a stationary block may be an event as determined by a computing system. In such an example, the event may be characterized with an amount of certainty or uncertainty and, for example, one or more notifications issued based at least in part on occurrence of the event and optionally based at least in part on certainty of the event and/or uncertainty of the event.

FIG. 8 shows an example of a system 850 that includes a traveling block 854, a hook 855, bails 856 and an elevator 857 that can latch a pipe 858. FIG. 8 also shows a system 890 that includes various components such as a rotary drive, bails and an elevator.

As an example, an elevator may be a hinged mechanism that may be closed around drillpipe or other drillstring components to facilitate lowering them into a bore or lifting them out of a bore. In a closed position, arms of an elevator may be latched together to form a load-bearing ring around a component (e.g., pipe, etc.). A shoulder or taper on the component to be lifted may be larger in size than the inside diameter of an opening of a closed elevator. In an open position, an elevator may "split" into portions and, for example, may be swung away from a component.

As an example, a hook may be a J-shaped piece of equipment that can be used to hang various other equipment. As an example, a hook may hang a swivel and kelly, elevator bails or a top drive unit. A hook may be attached to a traveling block and provide a way to pick up heavy loads with the traveling block. A hook may be locked or free to rotate, for example, so that it may be mated or decoupled with items positioned around the rig floor.

As an example, a system may include a top drive (e.g., or topdrive). A top drive can turn a string, for example, via one or more motors (e.g., electric, hydraulic, etc.). As an example, a top drive can include gearing that can be coupled to a short section of pipe called a quill, which, in turn, may be screwed into a saver sub or a string. As an example, a top drive may be suspended from a hook. In such an example, the rotary mechanism can travel up and down a derrick or a mast. A top drive arrangement may be used with or without a rotary table and kelly for turning a string (e.g., a drillstring).

Figure 9:
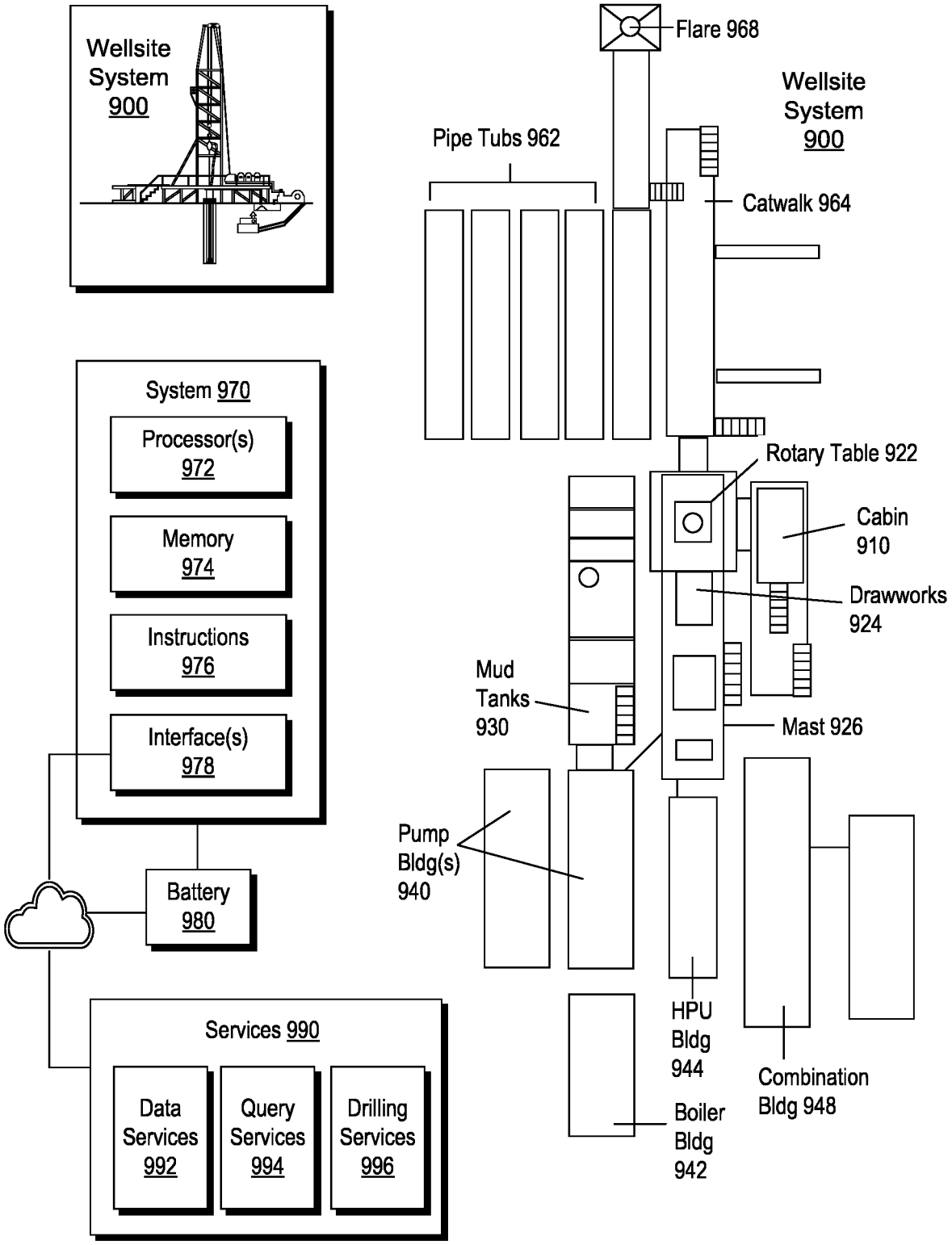
FIG. 9 illustrates examples of equipment and an example of a computing system.

FIG. 9 shows an example of a wellsite system 900, specifically, FIG. 9 shows the wellsite system 900 in an approximate side view and an approximate plan view along with a block diagram of a system 970.

In the example of FIG. 9, the wellsite system 900 can include a cabin 910, a rotary table 922, drawworks 924, a mast 926 (e.g., optionally carrying a top drive, etc.), mud tanks 930 (e.g., with one or more pumps, one or more shakers, etc.), one or more pump buildings 940, a boiler building 942, an HPU building 944 (e.g., with a rig fuel tank, etc.), a combination building 948 (e.g., with one or more generators, etc.), pipe tubs 962, a catwalk 964, a flare 968, etc. Such equipment can include one or more associated functions and/or one or more associated operational risks, which may be risks as to time, resources, and/or humans.

As shown in the example of FIG. 9, the wellsite system 900 can include a system 970 that includes one or more processors 972, memory 974 operatively coupled to at least one of the one or more processors 972, instructions 976 that can be, for example, stored in the memory 974, and one or more interfaces 978. As an example, the system 970 can include one or more processor-readable media that include processor-executable instructions executable by at least one of the one or more processors 972 to cause the system 970 to control one or more aspects of the wellsite system 900. In such an example, the memory 974 can be or include the one or more processor-readable media where the processor-executable instructions can be or include instructions. As an example, a processor-readable medium can be a computer-readable storage medium that is not a signal and that is not a carrier wave.

FIG. 9 also shows a battery 980 that may be operatively coupled to the system 970, for example, to power the system 970. As an example, the battery 980 may be a back-up battery that operates when another power supply is unavailable for powering the system 970. As an example, the battery 980 may be operatively coupled to a network, which may be a cloud network. As an example, the battery 980 can include smart battery circuitry and may be operatively coupled to one or more pieces of equipment via a SMBus or other type of bus.

In the example of FIG. 9, services 990 are shown as being available, for example, via a cloud platform. Such services can include data services 992, query services 994 and drilling services 996.

As an example, a system may be utilized to perform a workflow. Such a system may be distributed and allow for collaborative workflow interactions and may be considered to be a platform (e.g., a framework for collaborative interactions, etc.).

As an example, one or more systems can be utilized to implement a workflow that can be performed collaboratively. As an example, a system can be operated as a distributed, collaborative well-planning system. A system may utilize one or more servers, one or more client devices, etc. and may maintain one or more databases, data files, etc., which may be accessed and modified by one or more client devices, for example, using a web browser, remote terminal, etc. As an example, a client device may modify a database or data files on-the-fly, and/or may include "sandboxes" that may permit one or more client devices to modify at least a portion of a database or data files optionally off-line, for example, without affecting a database or data files seen by one or more other client devices. As an example, a client device that includes a sandbox may modify a database or data file after completing an activity in the sandbox.

In some examples, client devices and/or servers may be remote with respect to one another and/or may individually include two or more remote processing units. As an example, two systems can be "remote" with respect to one another if they are not physically proximate to one another; for example, two devices that are located at different sides of a room, in different rooms, in different buildings, in different cities, countries, etc. may be considered "remote" depending on the context. In some embodiments, two or more client devices may be proximate to one another, and/or one or more client devices and a server may be proximate to one another.

Figure 10:
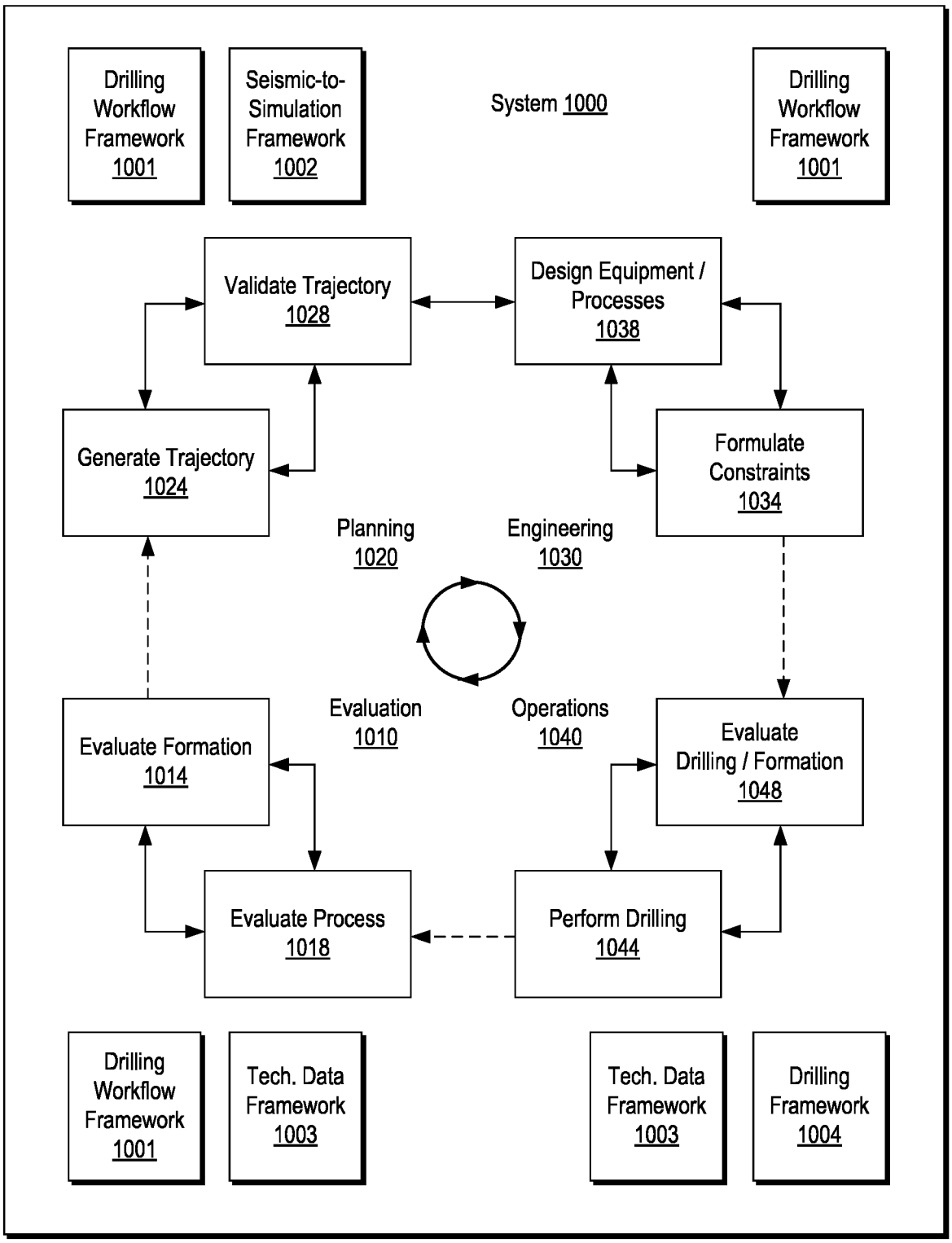
FIG. 10 illustrates an example of a system.

FIG. 10 shows an example of a system 1000 that includes various equipment for evaluation 1010, planning 1020, engineering 1030 and operations 1040. For example, a drilling workflow framework 1001, a seismic-to-simulation framework 1002, a technical data framework 1003 and a drilling framework 1004 may be implemented to perform one or more processes such as a evaluating a formation 1014, evaluating a process 1018, generating a trajectory 1024, validating a trajectory 1028, formulating constraints 1034, designing equipment and/or processes based at least in part on constraints 1038, performing drilling 1044 and evaluating drilling and/or formation 1048.

In the example of FIG. 10, the seismic-to-simulation framework 1002 can be, for example, the PETREL® framework (Schlumberger Limited, Houston, Texas) and the technical data framework 1003 can be, for example, the TECHLOG® framework (Schlumberger Limited, Houston, Texas).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. A commercially available example of an object-based framework is the MICROSOFT™ .NET™ framework (Redmond, Washington), which provides a set of extensible object classes. In the .NET™ framework, an object class encapsulates a module of reusable code and associated data structures. Object classes can be used to instantiate object instances for use in by a program, script, etc. For example, borehole classes may define objects for representing boreholes based on well data.

As an example, a framework can include an analysis component that may allow for interaction with a model or model-based results (e.g., simulation results, etc.). As to simulation, a framework may operatively link to or include a simulator such as the ECLIPSE® reservoir simulator (Schlumberger Limited, Houston Texas), the INTERSECT® reservoir simulator (Schlumberger Limited, Houston Texas), etc.

The aforementioned PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As an example, one or more frameworks may be interoperative and/or run upon one or another. As an example, consider the commercially available framework environment marketed as the OCEAN® framework environment (Schlumberger Limited, Houston, Texas), which allows for integration of add-ons (or plug-ins) into a PETREL® framework workflow. The OCEAN® framework environment leverages .NET™ tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. The framework may include the commercially available OCEAN® framework where the model simulation layer can include or operatively link to the commercially available PETREL® model-centric software package that hosts OCEAN® framework applications. In an example embodiment, the PETREL® software may be considered a data-driven application. The PETREL® software can include a framework for model building and visualization. Such a model may include one or more grids.

As an example, the model simulation layer may provide domain objects, act as a data source, provide for rendering and provide for various user interfaces. Rendering may provide a graphical environment in which applications can display their data while the user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 1000 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL® software, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA® framework, marketed by Schlumberger Limited, Houston, Texas) may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL® framework, etc.).

As an example, a workflow may be a process implementable at least in part in the OCEAN® framework. As an example, a workflow may include one or more worksteps that access a module such as a plug-in (e.g., external executable code, etc.).

As an example, a framework may provide for modeling petroleum systems. For example, the commercially available modeling framework marketed as the PETROMOD® framework (Schlumberger Limited, Houston, Texas) includes features for input of various types of information (e.g., seismic, well, geological, etc.) to model evolution of a sedimentary basin. The PETROMOD® framework provides for petroleum systems modeling via input of various data such as seismic data, well data and other geological data, for example, to model evolution of a sedimentary basin. The PETROMOD® framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL® framework, workflows may be constructed to provide basin-to-prospect scale exploration solutions. Data exchange between frameworks can facilitate construction of models, analysis of data (e.g., PETROMOD® framework data analyzed using PETREL® framework capabilities), and coupling of workflows.

As mentioned, a drillstring can include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger Limited, Houston, Texas) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG® framework. As an example, the TECHLOG® framework can be interoperable with one or more other frameworks such as, for example, the PETREL® framework.

As an example, various aspects of a workflow may be completed automatically, may be partially automated, or may be completed manually, as by a human user interfacing with a software application. As an example, a workflow may be cyclic, and may include, as an example, four stages such as, for example, an evaluation stage (see, e.g., the evaluation equipment 1010), a planning stage (see, e.g., the planning equipment 1020), an engineering stage (see, e.g., the engineering equipment 1030) and an execution stage (see, e.g., the operations equipment 1040). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 1014). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 1024), which may involve execution of one or more G&G software packages. Examples of such software packages include the PETREL® framework. As an example, a G&G service provider may determine a well trajectory or a section thereof, based on, for example, one or more model(s)

provided by a formation evaluation (e.g., per the evaluation block 1014), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 1028). Such a validation process may include evaluating physical properties, calculations, risk tolerances, integration with other aspects of a workflow, etc. As an example, one or more parameters for such determinations may be maintained by a server and/or by the first engineering service provider; noting that one or more model (s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 1038). In some embodiments, a second engineering service provider may perform such design using one of more software applications. Such designs may be stored in one or more databases maintained by one or more servers, which may, for example, employ STUDIO® framework tools, and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 1034). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 1044 and 1048). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 1018). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over Processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 11:
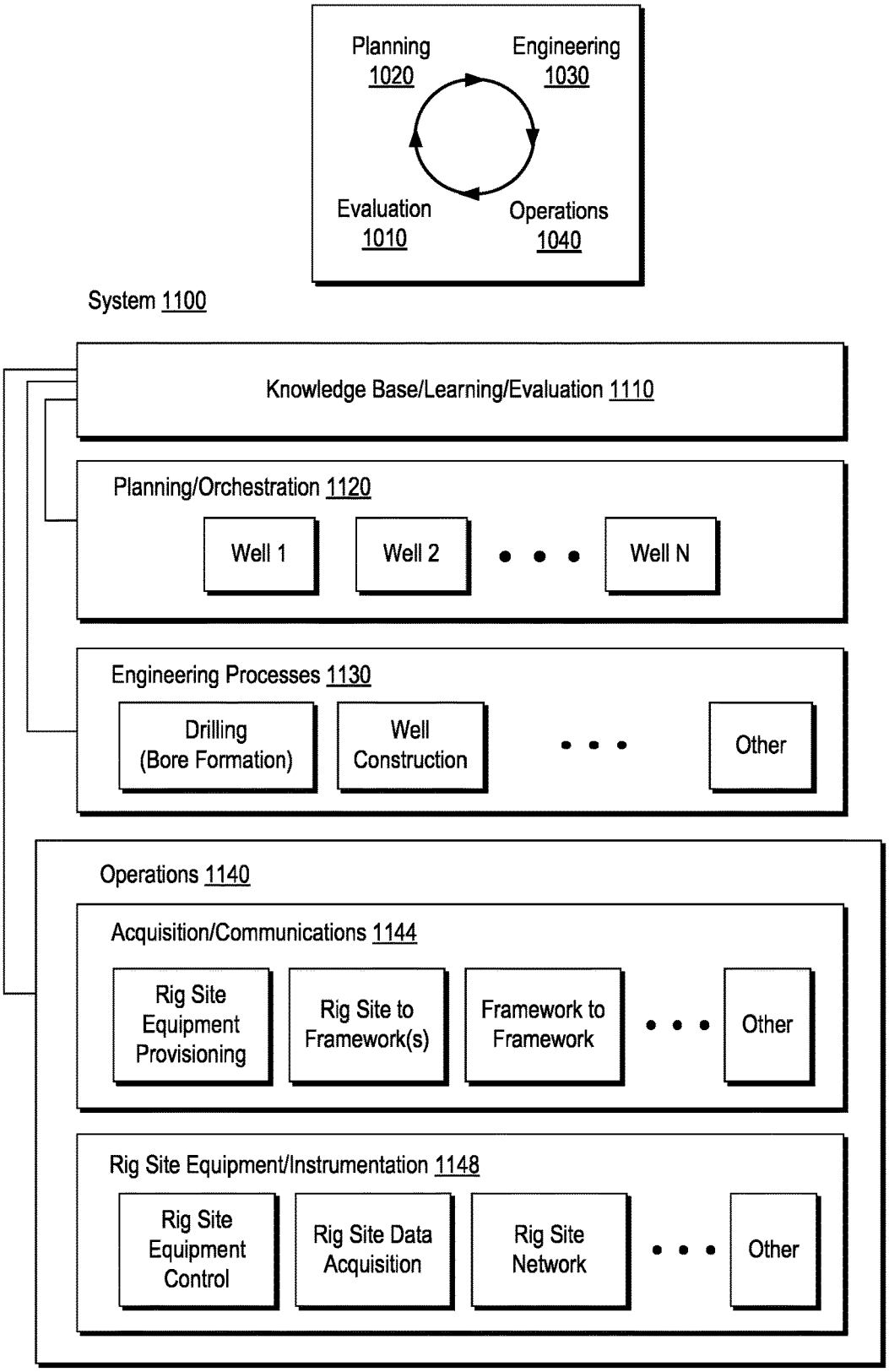
FIG. 11 illustrates an example of a system.

FIG. 11 shows an example of a system 1100 along with the cyclical process of FIG. 10 as associated with the evaluation equipment 1010, the planning equipment 1020, the engineering equipment 1030 and the operations equipment 1040. Such equipment can include circuitry, which can be hardware circuitry or hardware and software circuitry.

As shown in the example of FIG. 11, the system 1100 can include knowledgebase, learning and evaluation equipment 1110, planning and orchestration equipment 1120, engineering processes equipment 1130 and operations equipment 1140. In the example of FIG. 11, the knowledgebase, learning and evaluation equipment 1110 can correspond to the evaluation equipment 1010, the planning and orchestration equipment 1120 can correspond to the planning equipment 1020, the engineering processes equipment 1130 can correspond to the engineering equipment 1030 and the operations equipment 1140 can correspond to the operations equipment 1040.

As shown, system can be interlinked such that equipment can transmit information, for example, via one or more networks. As an example, equipment can include cloud-based equipment that may be hosted in a cloud platform or cloud infrastructure.

In the example of FIG. 11, the planning and orchestration equipment 1120 can plan and orchestrate operations for one or more wells, the engineering processes equipment 1130 can provide information as to drilling (e.g., bore formation), well construction and one or more other types of operations, the operations equipment 1140 can include acquisition and communications equipment 1144 and rig site equipment and instrumentation 1148.

As shown in the example of FIG. 11, the acquisition and communications equipment 1144 can include rig site equipment provisioning equipment, rig site to framework communications equipment, framework to framework communications equipment and one or more other types of equipment.

As shown in the example of FIG. 11, the rig site equipment and instrumentation 1148 can include rig site equipment control equipment, rig site data acquisition equipment, rig site network equipment and one or more other types of equipment.

In the example of FIG. 11, the block 1110 can include various features for input of information, learning, evaluation and output of information. For example, equipment illustrated in FIGS. 1 to 9 can generate information and, for example, people operating and/or monitoring such equipment can generate information. Such information can include sensed information such as weight related information, depth related information, formation related information, equipment operational state information, etc.

As explained, uncertainty can exist in actual depth as depth may be determined based on one or more proxies (e.g., measurement of lengths of pipe, measurement of rig equipment motion, etc.). Measured depth can be an estimate of the length of a bore. Measured depth can differ from actual depth due to uncertainties in how equipment may respond to forces, temperature, pressure, etc. downhole. A bore is, in general, not physically measurable from end to end. As an example, lengths of individual joints of drillpipe, drill collars and other drillstring elements may be measured with a steel tape measure and added together. Pipe may be measured while in a derrick or while laying on a pipe rack, in an untensioned, unstressed state. When such pipe is screwed together and put into the bore, it tends to stretch under its own weight and, for example, that of a BHA, etc. In various situations, actual bore depth tends to be deeper than reported depth via a tape measure approach. As an example, an operator may observe certain conditions during drilling operations that may be taken into account as to depth, which may reduce uncertainty. In the system 1100, the knowledge base, learning and evaluation block 1110 may receive such information and may learn based on such information by training one or more algorithms and then utilize one or more of such trained algorithms to adjust an estimated depth (e.g., to adjust measured depth) for one or more wellsites and/or to determine uncertainty associated with an estimated depth for one or more wellsites. As an example, uncertainty as to an estimated depth may change over time, for example, as a bore is drilled, cased, completed, etc.

As an example, information sensed by drawworks equipment such as the drawworks assembly 600 of FIG. 6 may be utilized to adjust an estimated depth. For example, weight sensed via the load sensor 650 may be utilized to adjust a stretching parameter associated with one or more types of string segments that are disposed downhole.

As an example, information sensed by rig equipment such as the system 700 of FIG. 7 may be utilized to adjust an estimated depth. For example, block position (BPOS) may be sensed and utilized to adjust an estimate depth.

As an example, various types of information may be combined to reduce uncertainty and/or to estimate uncertainty associated with an estimated depth. In such an example, an operator may be able to view such types of information and adjust and/or comment thereon with respect to one or more drilling operations.

Figure 12:
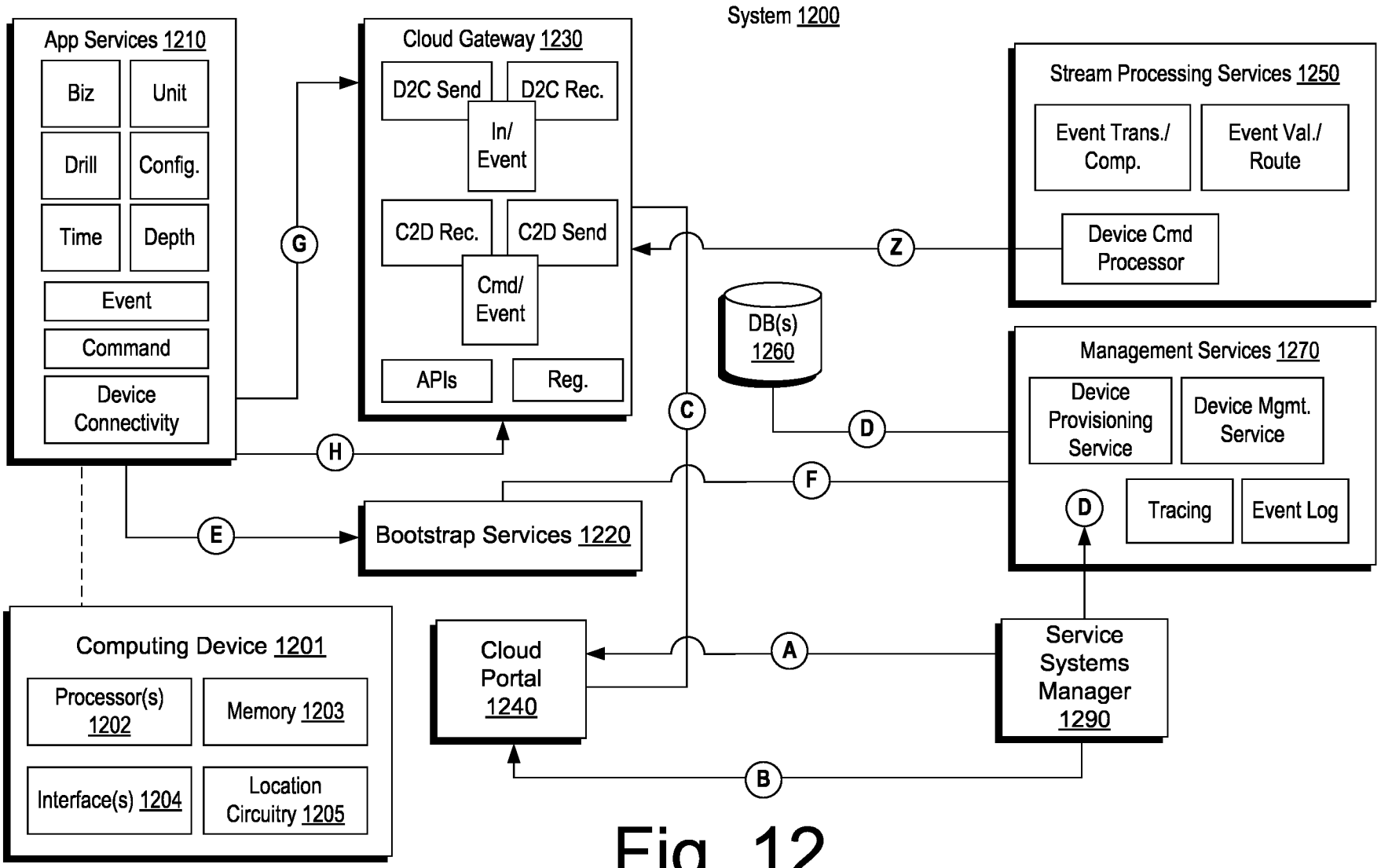
FIG. 12 illustrates an example of a system.

Referring again to the operations equipment 1140 of FIG. 11, as mentioned, rig site equipment can be provisioned. FIG. 12 shows an example of a system 1200 that includes a computing device 1201, an application services block 1210, a bootstrap services block 1220, a cloud gateway block 1230, a cloud portal block 1240, a stream processing services block 1250, one or more databases 1260, a management services block 1270 and a service systems manager 1290.

In the example of FIG. 12, the computing device 1201 can include one or more processors 1202, memory 1203, one or more interfaces 1204 and location circuitry 1205 or, for example, one of the one or more interfaces 1204 may be operatively coupled to location circuitry that can acquire local location information. For example, the computing device 1201 can include GPS circuitry as location circuitry such that the approximate location of the computer device 1201 can be determined. While GPS is mentioned (Global Positioning System), location circuitry may employ one or more types of locating techniques. For example, consider one or more of GLONASS, GALILEO, BeiDou-2, or another system (e.g., global navigation satellite system, "GNSS"). As an example, location circuitry may include cellular phone circuitry (e.g., LTE, 3G, 4G, etc.). As an example, location circuitry may include WiFi circuitry.

As an example, the application services block 1210 can be implemented via instructions executable using the computing device 1201. As an example, the computing device 1201 may be at a wellsite and part of wellsite equipment. As an example, the computing device 1201 may be a mobile computing device (e.g., tablet, laptop, etc.) or a desktop computing device that may be mobile, for example, as part of wellsite equipment (e.g., doghouse equipment, rig equipment, vehicle equipment, etc.).

As an example, the system 1200 can include performing various actions. For example, the system 1200 may include a token that is utilized as a security measure to assure that information (e.g., data) is associated with appropriate permission or permissions for transmission, storage, access, etc.

In the example of FIG. 12, various circles are shown with labels A to H. As an example, A can be a process where an administrator creates a shared access policy (e.g., manually, via an API, etc.); B can be a process for allocating a shared access key for a device identifier (e.g., a device ID), which may be performed manually, via an API, etc.); C can be a process for creating a "device" that can be registered in a device registry and for allocating a symmetric key; D can be a process for persisting metadata where such metadata may be associated with a wellsite identifier (e.g., a well ID) and where, for example, location information (e.g., GPS based information, etc.) may be associated with a device ID and a well ID; E can be a process where a bootstrap message passes that includes a device ID (e.g., a trusted platform module (TPM) chip ID that may be embedded within a device) and that includes a well ID and location information such that bootstrap services (e.g., of the bootstrap services block 1220) can proceed to obtain shared access signature (SAS) key(s) to a cloud service endpoint for authorization; F can be a process for provisioning a device, for example, if not already provisioned, where, for example, the process can include returning device keys and endpoint; G can be a process for getting a SAS token using an identifier and a key; and H can be a process that includes being ready to send a message using device credentials. Also shown in FIG. 12 is a process for getting a token and issuing a command for a well identifier (see label Z).

As an example, Shared Access Signatures can be an authentication mechanism based on, for example, SHA-256 secure hashes, URIs, etc. As an example, SAS may be used by one or more Service Bus services. SAS can be implemented via a Shared Access Policy and a Shared Access Signature, which may be referred to as a token. As an example, for SAS applications using the AZURE™ .NET SDK with the Service Bus, .NET libraries can use SAS authorization through the SharedAccessSignatureToken Provider class.

As an example, where a system gives an entity (e.g., a sender, a client, etc.) a SAS token, that entity does not have the key directly, and that entity cannot reverse the hash to obtain it. As such, there is control over what that entity can access and, for example, for how long access may exist. As an example, in SAS, for a change of the primary key in the policy, Shared Access Signatures created from it will be invalidated.

As an example, the system 1200 of FIG. 12 can be implemented for provisioning of rig acquisition system and/or data delivery.

As an example, a method can include establishing an Internet of Things (IoT) hub or hubs. As an example, such a hub or hubs can include one or more device registries. In such an example, the hub or hubs may provide for storage of metadata associated with a device and, for example, a per-device authentication model. As an example, where location information indicates that a device (e.g., wellsite equipment, etc.) has been changed with respect to its location, a method can include revoking the device in a hub.

As an example, such an architecture utilized in a system such as, for example, the system 1200, may include features of the AZURE™ architecture (Microsoft Corporation, Redmond, WA). As an example, the cloud portal block 1240 can include one or more features of an AZURE™ portal that can manage, mediate, etc. access to one or more services, data, connections, networks, devices, etc.

As an example, the system 1200 can include a cloud computing platform and infrastructure, for example, for building, deploying, and managing applications and services (e.g., through a network of datacenters, etc.). As an example, such a cloud platform may provide PaaS and IaaS services and support one or more different programming languages, tools and frameworks, etc.

FIG. 13 shows an example of a system 1300 associated with an example of a wellsite system 1301 and also shows an example scenario 1302. As shown in FIG. 13, the system 1300 can include a front-end 1303 and a back-end 1305 from an outside or external perspective (e.g., external to the wellsite system 1301, etc.). In the example of FIG. 13, the system 1300 includes a drilling framework 1320, a stream processing and/or management block 1340, storage 1360 and optionally one or more other features that can be defined as being back-end features. In the example of FIG. 13, the system 1300 includes a drilling workflow framework 1310, a stream processing and/or management block 1330, applications 1350 and optionally one or more other features that can be defined as being front-end features.

As an example, a user operating a user device can interact with the front-end 1303 where the front-end 1303 can interact with one or more features of the back-end 1305. As an example, such interactions may be implemented via one or more networks, which may be associated with a cloud platform (e.g., cloud resources, etc.).

As to the example scenario 1302, the drilling framework 1320 can provide information associated with, for example, the wellsite system 1301. As shown, the stream blocks 1330 and 1340, a query service 1385 and the drilling workflow framework 1310 may receive information and direct such information to storage, which may include a time series database 1362, a blob storage database 1364, a document database 1366, a well information database 1368, a project (s) database 1369, etc. As an example, the well information database 1368 may receive and store information such as, for example, customer information (e.g., from entities that may be owners of rights at a wellsite, service providers at a wellsite, etc.). As an example, the project database 1369 can include information from a plurality of projects where a project may be, for example, a wellsite project.

Figure 14:
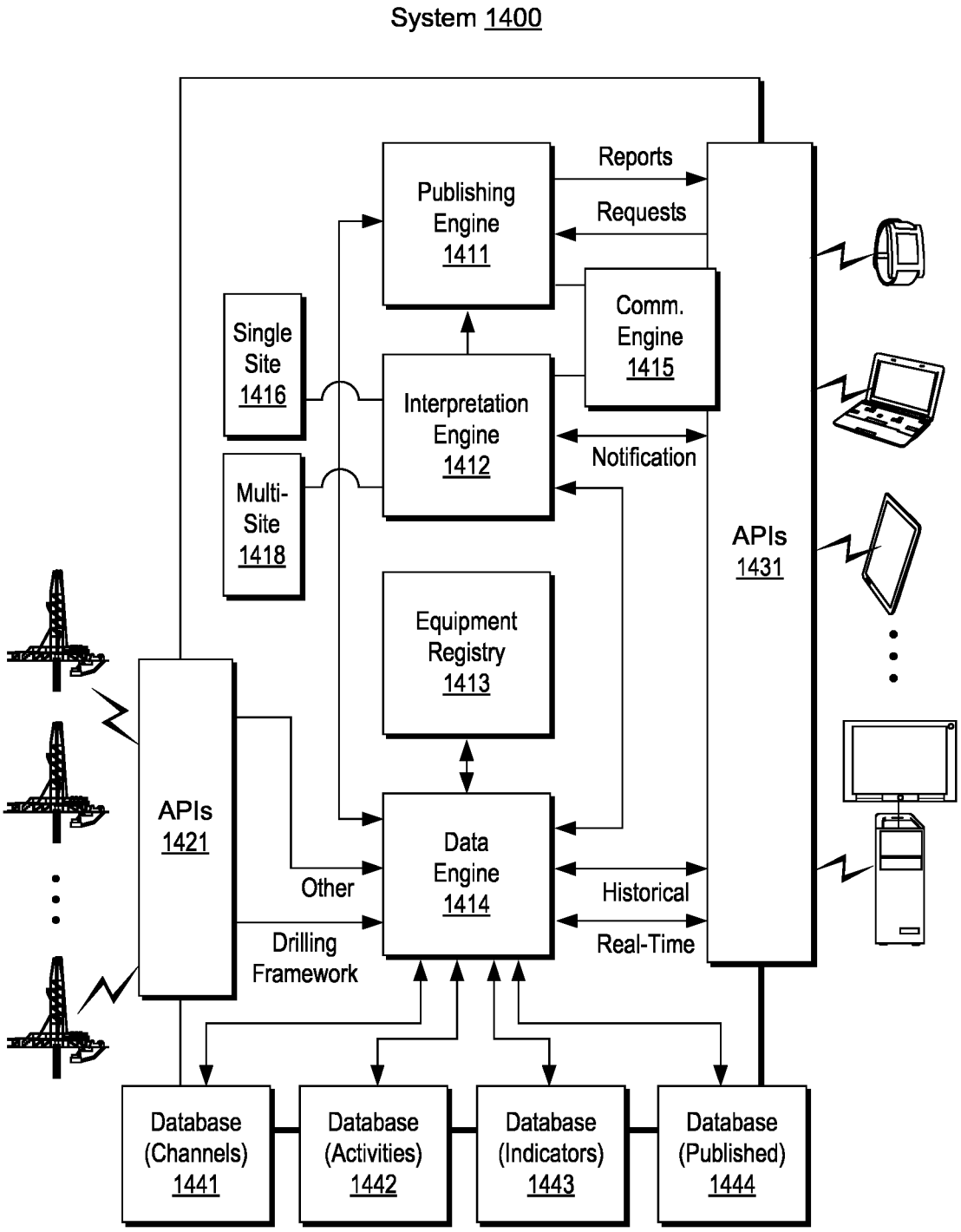
FIG. 14 illustrates an example of a system.

FIG. 14 shows an example of a system 1400 that includes a publishing engine 1411, an interpretation engine 1412, an equipment registry 1413, a data engine 1414 and a communication engine 1415 as well as application programming interfaces 1421 and 1431 and operatively coupled databases 1441, 1442, 1443 and 1444.

In the example of FIG. 14, the components 1411, 1412, 1413, 1414 and 1415 can be hosted by a cloud computing platform, which may also host at least a portion of the system 1200 of FIG. 12 and/or at least a portion of the system 1100 of FIG. 11. As an example, the equipment registry 1413 can be a registry associated with an equipment provisioning framework that may operate, for example, via resources provided in a cloud computing platform. As an example, the equipment registry 1413 can be rig site specific where each rig site includes a dedicated equipment registry. As an example, the system 1400 may include a plurality of equipment registries for a plurality of rig sites.

In the example of FIG. 14, the data engine 1414 may correspond to and/or be operatively coupled to one or more features of the wellsite system 900 of FIG. 9 (e.g., the computing system 970, equipment of the wellsite system, etc.). As shown in the example of FIG. 14, the data engine 1414 can be operatively coupled to one or more of the APIs 1421 and to the equipment registry 1413 (e.g., or registries). As shown, the data engine 1414 can be operatively coupled to the databases 1441 to 1444. Further, the data engine 1414 can be operatively coupled to the publishing engine 1411 and the interpretation engine 1412 as well as, for example, one or more of the APIs 1431.

In the example of FIG. 14, various components may be in a trusted or secure zone where, for example, the APIs 1421 and/or the APIs 1431 provide predefined calls and responses for components in the trusted or secure zone. As an example, the APIs 1431 can expose functionality of one or more components in the trusted or secure zone. For example, a computing device with a browser application may issue an API call to the system 1400 where the system 1400 responds to the API call with information transmitted to the computing device that can be rendered to a display via the browser application. In such an example, the computing device may be prohibited from accessing functionality of components in a trusted or secure zone where such functionality is not exposed via an API defined call.

As an example, the APIs 1421 can be utilized by rig site equipment, for example, for purposes of provisioning, data transmission, control commands, etc. As an example, the APIs 1421 can provide for handshakes between rig site equipment and one or more components of the system 1400 where information may be transmitted before, during or after a handshake.

As an example, the system 1400 can receive drilling framework information from one or more rig sites (e.g., via a system as in FIG. 9) and/or other information from one or more rig sites.

As an example, the interpretation engine 1412 can issue one or more notifications, which may be based on one or more events. For example, the interpretation engine 1412 can receive information, determine an event and issue a notification for that event. As an example, a notification of the interpretation engine 1412 can be issued to one or more destination addresses, for example, according to the communication engine 1415, which may operating according to information in a communication matrix.

As shown in the example of FIG. 14, the interpretation engine 1412 can be implemented for a single site 1416 and/or for multiple sites 1418. For example, the interpretation engine 1412 can include algorithms for handling single site information and algorithms for handling multiple site information. As an example, where the system 1400 receives information for a plurality of well plans the plurality of well plans may be analyzed individually and/or collectively. As an example, a well plan can be a digital well plan for an individual well to be drilled and/or completed and/or a well plan can be a digital master well plan for a plurality of wells to be drilled and/or completed. As an example, a digital master well plan can include information as to equipment and/or other resources (e.g., human resources, power, water, mud, etc.) that may be utilized at a plurality of sites. In such an example, an event that occurs at one site may possibly impact one or more other sites.

As an example, a method can include generating reports using a system such as, for example, the system 1400. As shown in the example of FIG. 14, the publishing engine 1411 may respond to requests received as API calls by generating and issuing one or more reports.

As shown in FIG. 14, the system 1400 can include features for acquiring information about a rig, which can be state information. As an example, a system may operate automatically to determine a state or states based at least in part on information received by the system, which can include information acquired via one or more sensors, one or more devices with input mechanisms for user input, etc. As an example, a report may be generated based at least in part on a state or states (e.g., based at least in part on state information). As an example, a report may be triggered based on a push system and/or a pull system. For example, an oilfield operator may query a system to determine one or more states of the system (e.g., where a state can be a system state, a subsystem state, etc.). As an example, a report may be triggered based on state information, time, or another type of trigger.

As an example, the system 1400 can include receiving data associated with one or more drilling operations, analyzing at least a portion of the data and identifying one or more events and classifying the events. For example, the interpretation engine 1412 can include interpreting information to identify one or more events and to classify the one or more events. In such an example, an event may be classified as being associated with a particular type of performance (e.g., drilling, formation, equipment, etc.) and, for example, may be classified as being a "good" event or a "bad" event, optionally along one or more axes. For example, an axis from bad to good may be utilized and, for example, an associated cost, which may range from negative to positive. Thus, an event may be classified as being good with a positive financial or other type of cost return on achievement of that event. Such an event may be desirable to achieve while drilling. As an example, another type of event may be classified as being bad with a low financial or other type of cost impact. In such an example, avoidance of such an event may be considered to be optional due to low impact on cost; whereas, for example, a bad event with a high financial or other type of cost impact may be assessed for avoidance. Such an assessment may impact a drilling plan, etc., for one or more wells, which are being drilled, being planned to be drilled, etc.

As an example, the interpretation engine 1412 can be or include an inference engine. As an example, an inference engine can use logic represented as IF-THEN rules. For example, consider a format of such rules as IF <logical expression> THEN <logical expression>. IF-THEN statements (e.g., Modus Ponens) can represent various types of logic including, for example, human psychology as humans can utilize IF-THEN types of representations of knowledge. As an example, an inference engine may implement inductive algorithms that can predict a next state (e.g., next event, worsening of an event, improvement of an event, etc.) based upon a given series of information. As an example, an inductive framework can combine algorithmic information theory with a Bayesian framework.

As an example, the interpretation engine 1412 can be part of the knowledge base, learning and evaluation block 1100 of the system 1100 of FIG. 11 or operatively coupled thereto. In such an example, the interpretation engine 1412 may receive information from a knowledge base (e.g., one or more sources of information), may learn by training one or more algorithms (e.g., including retraining one or more algorithms), and may evaluate information based at least in part on one or more trained algorithms. As an example, an "expert" may review information output by an interpretation engine where the expert may approve, disapprove, modify, comment, etc. as to such output. In such an example, a mechanism may capture the expert feedback and utilize at least a portion of the feedback for purposes of training the interpretation engine.

As an example, an expert station may be a computing system that is operatively coupled to an interpretation engine that can intervene in operation of the interpretation engine. For example, where output is deemed lacking, input may be received via an expert station to comment on such output, to halt transmission of such output, to cause reinterpretation of information to generate new output, etc.

As an example, a system can be a drilling event analysis system, which can include an analysis engine, which may be a machine learning engine (e.g., Bayesian, etc.). As an example, consider the APACHE STORM engine (Apache Software Foundation, Forest Hill, Maryland).

The APACHE STORM engine can be implemented as a distributed realtime computation system. Such a system can receive and process unbounded streams of data. Such a system may provide for realtime analytics, online machine learning, continuous computation, distributed RPC, ETL, etc. Such a system may integrate with one or more queueing and database technologies. As an example, a topology may be constructed that consumes streams of data and processes those streams in one or more manners, optionally repartitioning streams between each stage of computation. As an example, a topology can be constructed as a graph of computation where, for example, a node in a topology includes processing logic, and links between nodes indicate how data may be passed around between nodes.

As an example, data may be available in the WITSML™ standard (Wellsite Information Transfer Standard Markup Language, Energistics, Sugar Land, Texas) developed as part of an industry initiative to interfaces for technology and applications (e.g., to monitor wells, manage wells, drilling, fracturing, completions, workovers, etc.). For example, a machine learning system can receive data organized in the WITSML™ standard where such data may pertain to one or more of drilling, completions, interventions data exchange, etc. As an example, a system may be operatively coupled to resources associated with one or more entities (e.g., energy companies, service companies, drilling contractors, application vendors, regulatory agencies, etc.). While WITSML™ is mentioned, one or more other types of data schemes may be utilized.

As an example, a machine learning system may receive data and automate identification and collection of drilling events. As an example, a machine learning system can include identification and classification of events. As an example, such an approach may be utilized to assign a probability of an event occurring for a scenario or scenarios. For example, a type of event may be associated with drilled wells and information for a "to be drilled well" (e.g., a scenario) may be input where output can assign a probability of that event occurring during drilling of the "to be drilled well". Such output may be associated with a trajectory distance, optionally a depth.

As an example, a well planning platform may be operatively coupled to a machine learning system such that during well planning, events and probabilities of their occurrence may be indicated. During well planning, the platform may issue notices and/or suggestions as to one or more parameters that can be utilized to reduce occurrence of such an event during drilling and/or increase occurrence of such an event during drilling, which may be based on a cost assessment (e.g., for good and bad types of events and associated costs, which may be cost estimates as to time, resources, etc.).

As an example, machine learning may occur based on one or more types of input. As an example, input may be via one or more mechanisms. For example, information may be generated with respect to planning and may be included in a digital well plan or digital well plans. As an example, where a system includes a master review component (e.g., an expert station), such a component may input information that can assist in learning. As an example, one or more users at one or more computing devices may interact with one or more GUIs that can capture information that may be utilized for learning (e.g., training one or more artificial intelligence algorithms, engines, etc.).

As an example, a machine learning system may be operatively coupled to a well planning platform where the machine learning system includes a network or nodes and associated logic, for example, series logic statements. As an example, logical statements may make up an algorithm that can search one or more databases where, for example, the algorithm may identify content that meets one or more criteria for risk. As an example, such risk may include risk as specified via one or more WITSML™ criteria.

As an example, a risk may be associated with time for making up a bottom hole assembly (BHA). In such an example, logic may identify what is the average time for a rig or the field, and then compare BHA make-up events to that average time.

As an example, a machine learning system may implement an algorithm that applies to a realtime data stream, for example, as received from a rig at a wellsite (e.g., from computerized equipment, etc. at a wellsite). In such an example, a series of logic statements may be utilized where streaming data channels from the rig are analyzed to identify and/or classify one or more events that occurred or that may have occurred. In such an example, an event may have occurred, whether good or bad, where the event was noted by an operator; or, for example, an event may have occurred, whether good or bad, where the event was not noted by an operator. In such instances, a probability of that event may be assigned. Such an approach may optionally be utilized to identify noted events that may be false positives as well as noted events that were successfully noted (e.g., confirmation of the operator's judgement).

FIG. 15 shows some examples of variables 1510, some examples of events 1520 and an example of a method 1550. As shown, the method 1550 includes a reception block 1554 for receiving data, an identification block 1558 for identifying variables, an identification block 1562 for identifying events, an access block 1566 for accessing a plan, an analysis block 1570 for analyzing the plan, an identification block 1574 for identifying one or more events associated with the plan based at least in part on the analysis, a revision block 1578 for revising the plan and an implementation block 1582 for implementing at least a portion of the revised plan. As shown, implementation can include generating data where such data may be received by the reception block 1554.

As an example, multiple instances of the method 1550 may be implemented where such instances may be linked. For example, a machine learning system may be operatively coupled to data networks associated with wellsite equipment and may be operatively coupled to one or more well planning systems. As an example, the method 1550 of FIG. 15 may be implemented at least in part via the interpretation engine 1412 of the system 1400 of FIG. 14.

The method 1550 can be associated with various computer-readable media (CRM) blocks. Such blocks generally include instructions suitable for execution by one or more processors (or cores) to instruct a computing device or system to perform one or more actions. As an example, a single medium may be configured with instructions to allow for, at least in part, performance of various actions of the method 1550. As an example, a computer-readable medium (CRM) may be a computer-readable storage medium that is non-transitory and not a carrier wave and not a signal.

As an example, a method can include identifying one or more types of events by implementing a topology that includes a directed acyclic graph. For example, the APACHE STORM application can include utilization of a topology that includes a directed acyclic graph (DAG). A DAG can be a finite directed graph with no directed cycles that includes many vertices and edges, with each edge directed from one vertex to another, such that there is no way to start at any vertex v and follow a consistently-directed sequence of edges that eventually loops back to v again. As an example, a DAG can be a directed graph that includes a topological ordering, a sequence of vertices such that individual edges are directed from earlier to later in the sequence. As an example, a DAG may be used to model different kinds of information.

As an example, a method can include receiving data as receiving realtime data as acquired from wellsite equipment and/or as receiving data from at least one database.

As an example, a system can include one or more processors; a network interface operatively coupled to the one or more processors; memory operatively coupled to the one or more processors; and processor-executable instructions stored in the memory and executable by at least one of the processors to instruct the system to receive data acquired from wellsite equipment at a plurality of wellsites; identify types of events based at least in part on the data; analyze a well plan with respect to at least some of the types of events; and, based at least in part on an analysis of the well plan, adjust the well plan to alter probability of occurrence of at least one of the types of events.

As an example, one or more computer-readable storage media can include computer-executable instructions executable to instruct a computing system to: receive data acquired from wellsite equipment at a plurality of wellsites; identify types of events based at least in part on the data; analyze a well plan with respect to at least some of the types of events; and, based at least in part on an analysis of the well plan, adjust the well plan to alter probability of occurrence of at least one of the types of events.

FIG. 16 shows an example of a communication matrix 1600 that includes subject classes (e.g., to classify events, etc.), escalation/de-escalation rules, and roles.

As an example, the communication matrix 1600 may be generated as part of an application (e.g., a communication matrix generation framework) that can render a graphical user interface to a display such that information may be entered, selected, modified, etc. In such an example, a validate control may assess the information to determine whether the information is sufficiently complete, logical, etc. As an example, one or more messages may be generated in response to a validation process to guide a user and/or to automatically suggest and/or make one or more adjustments to the communication matrix 1600. For example, where a wellsite is handled by a particular entity (e.g., as a service provider), particular roles may differ from where a wellsite is handled by a different entity. In such an example, a communication matrix application can be aware of one or more aspects of well planning, drilling operations, entities involved, etc.

As shown in the example of FIG. 16, a control may be rendered and actuated to export a communication matrix 1600 as a file. As an example, the communication matrix 1600 can be a digital file that can be stored in memory and that can be retrieved from memory for purposes of issuing one or more notifications.

As an example, the communication matrix 1600 can include trigger criteria categorized as to level, which can be a combined indicator of severity and time. For example, an event identified via the interpretation engine 1412 of the system 1400 may be time stamped and classified, optionally at least in part as to severity (e.g., good, bad, etc.). As an example, time can be utilized as a metric, for example, to track an amount of time that an identified event may remain unresolved (e.g., via one or more decisions, rectifications by operations on a job, etc.).

As an example, a level may be defined with respect to a time metric that represents non-productive time (NPT). For example, consider: "Level 1" defined as non-productive time (NPT) under about 30 minutes or "Light" events on a Catastrophic/Major/Serious/Light (CMSL) scale; "Level 2" defined as NPT greater than 30 minutes but less than 120 minutes or Serious on the CMSL scale; and "Level 3" defined as NPT greater than 120 minutes or "Major" on the CMSL scale.

As an example, subject and subclass as to the subject of a notification trigger can include, for example, directional drilling, trajectory control, anticollision, tools and general, LWD, realtime communication, log data quality and interpretation, tool, MWD, survey, telemetry, tool, drilling optimization, drilling mechanics, shock and vibrations, performance, sticky hole indicators change, stuck pipe, mud, solids control, sweeps and slug, mud check, geomechanics, model change, mud weight close to window boundaries, cutting shape change, borehole imaging interpretation, formation pressure station, geosteering, boundary crossed, steering recommendation, data transmission, connectivity, data availability from rig, data availability from aggregator, service quality checks, calibrations, operations of interest, survey taken, begin trip in, begin trip out, begin drilling, end of section, out of hole, entering pay, wireline logging, etc.

As an example, a communication matrix generation framework can include executable instructions for a workflow that can generate, modify, etc. a communication matrix. For example, to get a list of names for sending escalation SMS and/or email, a workflow can include selecting a location from a dropdown menu. In such an example, from a "Custom Selection" dropdown menu, a workflow can include selecting a related Job number or other custom name such as Client name or Field name. As an example, items in a list may be sorted alphabetically for comfortable use. As an example, a workflow can include selecting the classification for a message to send (e.g., classification can be akin to an eTrace ticket classification). In such an example, by selecting the classification, a triggers list can be updated, which may be split into multiple levels. As an example, a workflow can include selecting applicable Level for escalation/de-escalation. As an example, classification and level can pop-up after pressing a level button associated with a triggers graphical user interface.

A list of names can be validated such that people listed are those to be informed via one or more mechanisms (e.g., via one or more destination addresses). As an example, a message may be typed into a designated text field, noting that SMS messages may be limited as to character length and split, etc.

As an example, a communication matrix can be a file that includes information that is in a JSON (JavaScript Object Notation) data-interchange format. Such a format may be human readable and writable. Such information can be machine parsable and generatable and can be based on a subset of the JavaScript Programming Language. As an example, JSON can be a text format that is language independent and that uses conventions in the C-family of languages (e.g., C, C++, C#, Java, JavaScript, Perl, Python, etc.).

As an example, information in JSON can include the following structures: a collection of name/value pairs (e.g., an object, record, struct, dictionary, hash table, keyed list, associative array, etc.); and an ordered list of values (e.g., an array, vector, list, sequence, etc.).

As an example, a communication matrix may be defined on a job-by-job basis. As an example, a communication matrix can be part of a digital well plan. As an example, a communication matrix may be complete as generated by a well planning framework or may be to be completed after receipt by a system such as the system 1400. As an example, a portion of information in the communication matrix may be included in a digital well plan.

Figure 17:
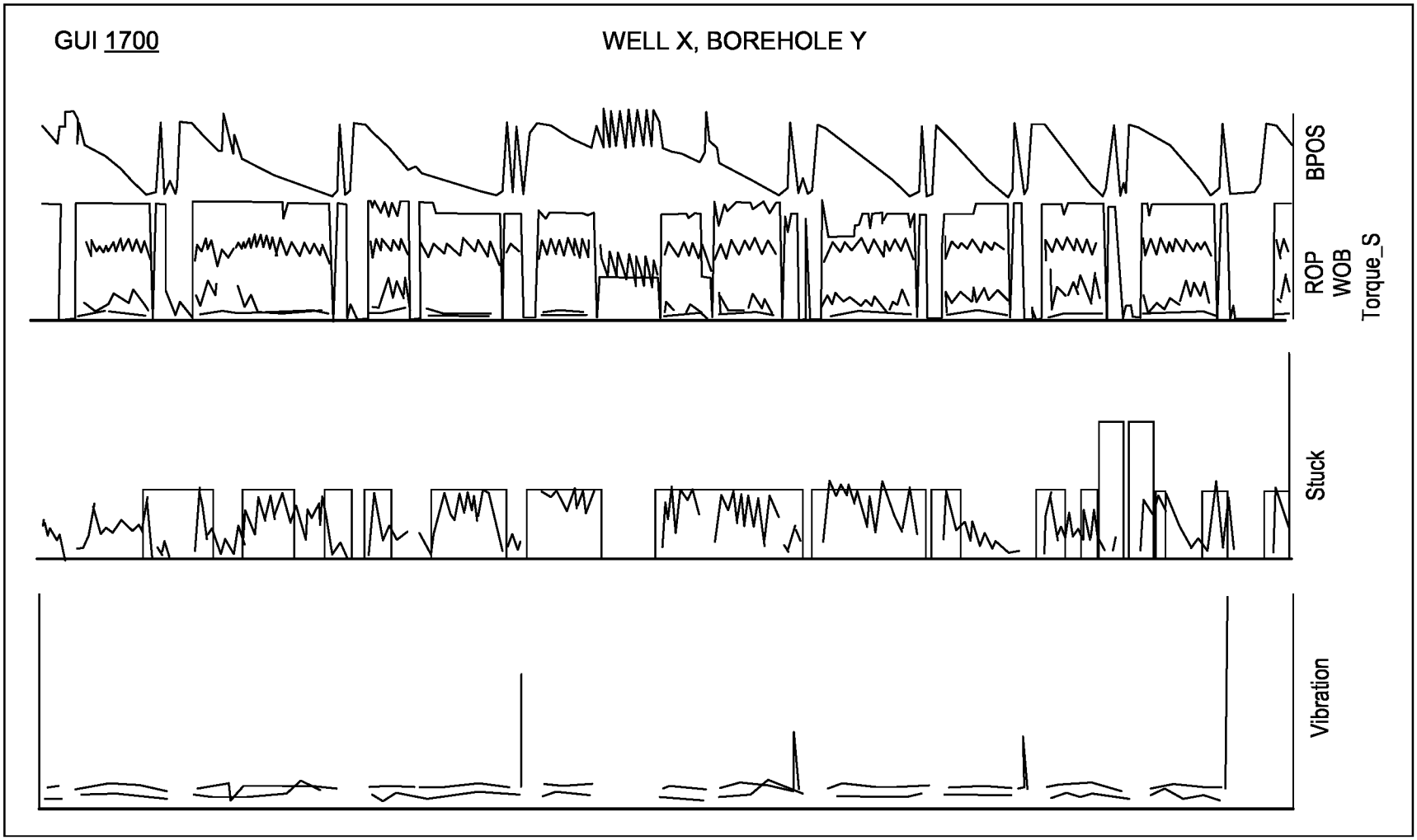
FIG. 17 illustrates an example of a graphical user interface.

FIG. 17 shows an example of a GUI 1700 that includes ganged plots. As an example, the GUI 1700 may be rendered to a display of a computing device or a display operatively coupled to a computing device. In the example of FIG. 17, the GUI 1700 may include information for a plurality of rig sites or for a single rig site. The GUI 1700 may be rendered based at least in part on information received via a system such as the system 1400 of FIG. 14. For example, API calls may be made and information received thereto. As an example, the GUI 1700 can include rendering of notification information, which can include notifications issues based at least in part on output of the interpretation engine 1412.

In the example GUI 1700, information for a well "X" and borehole "Y" is rendered, including block position (BPOS), rate of penetration (ROP), weight on bit (WOB), surface torque (Torque_S), sticking information, and vibration information.

The GUI 1700 can render time data and depth data cross plots where the plots can be linked together such that depth and/or time segments can be adjusted via a common adjustment mechanism (e.g., to select a time or time range, a depth or a depth range, etc.), which may be able to zoom-in and zoom-out as to an axis or axes. Some of the plots may include two "ranges" such as a broom stick plot where a vertical axis is a depth axis for a depth range and where time data are displayed in the broom stick plot related to a certain time range.

A GUI can include a master plot that when its range changed, it will force one or more other plots to share the same range, which may be referred to as follower plots. As an example, a follower plot may be individually adjusted without such an individual adjustment affecting another plot. As an example, a plot may be selected to be a master plot.

As an example, where an active master plot is a time versus depth plot, a user may zoom in/out on the time versus depth plot instance as coupled to a linking matrix where both time and depth range may be changed during zooming.

As an example, the system 1400 of FIG. 14 may be implemented as triage system that can provide services associated with a plurality of rig sites where operations are being performed and where information is being received.

As an example, the system 1400 may be implemented to reduce non-productive time (NPT) at a plurality of rig sites. As an example, an operator may be responsible for monitoring two or more rig sites. In such an example, the operator may have a functional bandwidth (e.g., a human bandwidth) such that information can be transmitted from the system 1400 to a computing device of the operator, which may include a browser or other type of application that can render information to a display. For example, the GUI 1700 may be rendered to a display of a computing device of a single operator (e.g., an expert station). Such a GUI can include one or more controls that can help to manage overload experienced by an operator (e.g., an escalation button, a "panic" button, etc.). As mentioned, escalation and/or de-escalation may be managed at least in part via the communication engine 1415 with respect to information output by the interpretation engine 1412.

As mentioned, the interpretation engine 1412 can be a trained interpretation engine that can be trained using one or more experts. For example, an individual with 10 years or more of experience may be utilized to assess information and to determine courses of action in response to the assessment of the information. For example, the individual may be considered to be a trend-spotter where the individual identifies trends based on an assessment of the information. In such an example, the interpretation engine 1412 can "learn" (e.g., be trained) using those identified trends. In such an example, where received data can be assessed by the interpretation engine 1412 and matched to a scenario to which the interpretation engine 1412 has been trained, the interpretation engine 1412 can output a likelihood of what may occur and/or one or more actions that can mitigate or may mitigate an expected trend or trends.

As shown in the example of FIG. 14, the system 1400 can include components for issuing notifications, for issuing reports and for transmitting information such as, for example, historical information and/or real-time information.

As an example, where a load of an operator may be expected to be at or near a maximum (e.g., practical mental information handling load), the system 1400 can include one or more components that can effectuate load shedding that can direct notifications to one or more other destination addresses to shed load of the operator that may be at or near a maximum load.

As an example, the system 1400 can implement one or more queues where notifications can be ordered in the one or more queues. In such an example, the queues may be managed such that ordering can change over time prior to a notification in a queue or queues being issued (e.g., transmitted to one or more destination addresses). For example, an active queue may include one or more items (e.g., notifications) that can escalate and/or de-escalate prior to issuance. As an example, a filter scheme may be implemented as to one or more queues for one or more rig sites.

As an example, one criterion can be non-productive time (NPT) at a rig site. As an example, such a criterion may be linked to a phase of operations at a rig site. For example, a phase may be associated with time criticality that may be associated with expense, risk, and/or ability to reschedule. As an example, where a phase is operational as to a particular task that is difficult to reschedule (e.g., due to having to trip-out and trip-in, etc.), NPT may be weighted to make its impact more profound (e.g., higher priority).

As an example, a digital well plan can include one or more digital watchdogs. As an example, a digital watchdog can be an amount of time for an operation, a phase, etc. As an example, such a digital watchdog may be received by an inference engine and/or a communication engine. In such an example, a digital watchdog can be tracked, can expire without effect or notice/check-off, can be used to trigger a notification, can be used to trigger an escalation or a de-escalation, etc.

As an example, consider a digital watchdog being set in a digital well plan where the digital watchdog is activated during a particular phase of operations at a rig site that aims to drill and/or complete a well according to the digital well plan. In such an example, the digital watchdog may commence a timer that indicates that the phase is to be completed within a particular time, which may be associated with a plus and/or minus time margin. Where information received by an interpretation engine determines that the phase is not likely to be completed within the time period as commenced by the digital watchdog, the interpretation engine may issue one or more notifications to one or more destination addresses, optionally with one or more recommendations as to what action or actions may be taken to reduce time to get the phase back on track as to its likelihood of being completed within the planned time per the digital well plan.

As an example, time tracking can be implemented by the system 1400 of FIG. 14 to determine schedule time and/or to determine non-productive time (NPT); noting that these two types of times may be related. For example, NPT can lead to a likelihood of running beyond a schedule time. As an example, such times may be related to one or more rig sites. For example, consider equipment being used at one rig site that is planned to be used at a different rig site or rig sites. In such an example, an event that occurs at one rig site can impact implementation of a digital well plan at one or more other rig sites. As an example, where an operator is responsible for a plurality of rig sites, a master schedule for the plurality of rig sites may be affected by occurrence of an event at one of the rig sites. As an example, an interpretation engine may operate at an individual rig site level and at a master level for a plurality of rig sites. In such an example, the interpretation engine may be trained to identify trends as to one or more events at individual rig sites that can impact one or more operations occurring or to occur at one or more other rig sites. In such an example, the interpretation engine may issue notifications to one or more destination addresses in a manner to coordinate one or more actions to diminish impact on a master schedule, which may be defined at least in part by a digital master well plan for a plurality of wells to be drilled and/or completed at a plurality of sites.

As an example, a system can include a data interface that receives data associated with a plurality of wells; an inference engine that receives and analyzes at least a portion of the data to generate results; and a communication engine that outputs information based at least in part on the results according to a communication matrix. In such an example, the communication matrix can relate destination addresses to the plurality of wells. As an example, a communication matrix can relate destination addresses to levels.

As an example, results of an inference engine can include events where a communication matrix relates destination addresses to types of events.

As an example, results of an inference engine can include events wherein a communication matrix relates types of events and levels. For example, the communication engine can output information for a type of event to a destination address associated with one of the levels. As an example, a communication engine can adjust output of information from one level to another level to escalate the information. As an example, a communication engine can adjust output of information from one level to another level to de-escalate the information.

As an example, a communication engine can output information to a plurality of destination addresses for a plurality of events where each of the events is associated with one of the plurality of wells.

As an example, an inference engine can generate results for individual wells of a plurality of wells based at least in part on corresponding individual well plans.

As an example, an inference engine can receive and analyze at least a portion of data from a different plurality of wells to generate results for the different plurality of wells. In such an example, a communication engine can output information based at least in part on results of an interpretation engine for the different plurality of wells according to a different communication matrix.

As an example, a system can include a master review component (e.g., an expert station) that includes an associated graphical user interface (GUI) that can render information for one or more sites as to information generated by one or more interpretation engine instances. As an example, such a master review component may be a sanity review that reviews a stream of information and that can knock out, flag, escalate, de-escalate information. As an example, such a master review component may be behind and/or in-front of a communication engine such as the communication engine 1415. As an example, a master review component may manage a communication matrix that can control a communication engine and/or may output information to an interpretation engine, for example, to cause learning of the interpretation engine. As an example, an operator that operates a master review component may be an expert that can relatively quickly assess information being streamed from an interpretation engine or engines. As an example, such an operator may identify issues that arise with logic (e.g., inferences) being made by an interpretation engine, which may be addresses on-line, off-line, etc. For example, at the end of a shift, the operator may have generated a file as to one or more inferences made by an inference engine that may benefit from retraining, additional training, etc. of the inference engine.

As an example, a master review component can include an "IF-THEN" assessment feature that can flag basic if-then types of logic. For example, where real-time data from the data engine 1414 for a site indicates a particular trend or event according to an expert operator and where the interpretation engine 1412 indicates a different trend or event, the logic may be flagged (e.g., and time-stamped, etc.). As an example, where a particular trend or event is in accord with that of an expert, the master review component can allow for confirmation, which may act to weight one or more algorithms or grade one or more algorithms as operating in an effective manner according to expert opinion.

Figure 18:
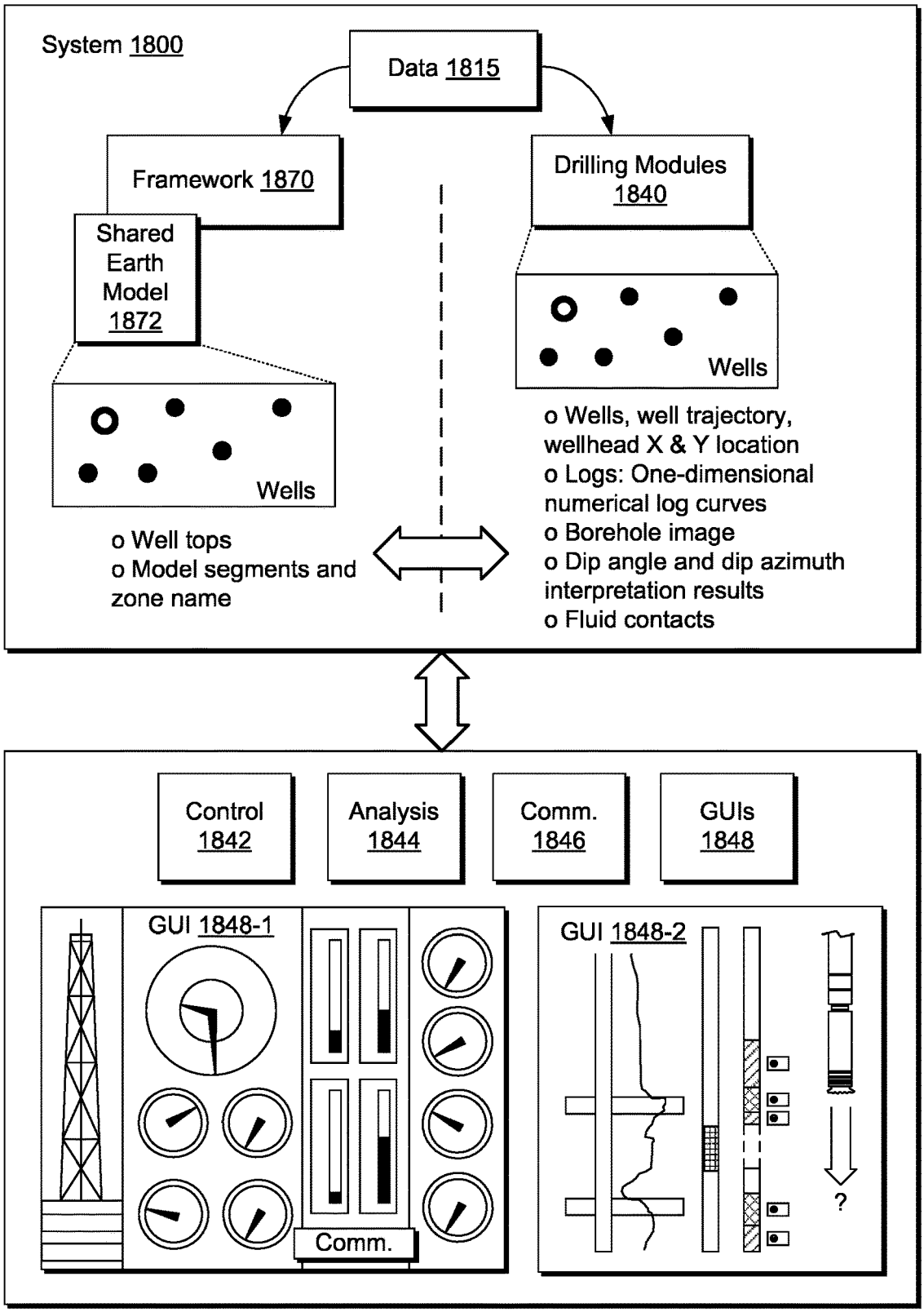
FIG. 18 illustrates an example of a system.

FIG. 18 shows an example of a system 1800 that includes data 1815, drilling modules 1840 and a framework 1870. As to the drilling modules 1840, these may include a control module 1842, an analysis module 1844, a communication module 1846 and one or more graphical user interface (GUI) modules 1848, for example, to organize data and graphics commands for rendering of a GUI 1848-1, a GUI 1848-2, etc. In the example of FIG. 18, the GUIs 1848-1 and 1848-2 provide information relevant to a drilling process where such information may optionally include real time information. As an example, the InterACT™ system (Schlumberger Ltd., Houston, Texas) may be implemented as part of a data handling system. As an example, the InterACT™ system may provide for rendering of information such as information of the GUI 1848-1. As an example, the system 1800 may be part of or operatively coupled to a system such as the system 1000 of FIG. 10.

As an example, the drilling modules 1840 may include one or more modules of the commercially available TECHLOG™ wellbore framework (Schlumberger Limited, Houston, TX), which provides wellbore-centric, cross-domain workflows based on a data management layer. The TECHLOG™ wellbore framework includes features for petrophysics (core and log), geology, drilling, reservoir and production engineering, and geophysics.

As indicated in FIG. 18, information may be exchanged between the framework 1870 and the drilling modules 1840, optionally using plug-ins, APIs, etc. Such transfers may allow for spatial mapping, temporal mapping or spatial and temporal mapping of data between the framework 1870 and the drilling modules 1840. As an example, the framework 1870 may access information associated with the drilling modules 1840 pertaining to wells, well trajectory, wellhead location, logs, borehole images, dip angle and dip azimuth interpretation results, fluid contacts, etc. As an example, the drilling modules may access information associated with the framework 1870 pertaining to well tops, model segments and zone name (e.g., for a model that includes one or more grids).

As to the data 1815, it may be stored in one or more data storage devices locally, remotely, or locally and remotely. For example, consider data storage options that may exist in a private resource layer and/or a public resource layer. As an example, data may include seismic data, interpreted data, model data, measurement data, qualitative data, etc. Portions of such data may be relevant to the drilling modules 1840 directly and/or the framework 1870 directly. As shown in the example of FIG. 18, information transfers between the drilling modules 1840 and the framework 1870 may include other data, for example, acquired from one or more other sources and may include analyzed data (e.g., optionally with respect to a model, etc.).

As an example, the InterACT™ system may be implemented to provide for connectivity, collaboration, information handling, etc. Such a multifunction system may provide for collaboration to facilitate planning and implementation of downhole, desktop or other workflows. Such workflows may include one or more of a stimulation operation, a drilling operation, wireline logging, a testing operation, production monitoring, downhole monitoring, etc. (e.g., as workflow steps, workflow processes, workflow algorithms, etc.). Collaboration may occur between any of a variety of parties such as clients, partners, experts, etc. Processor-executable instructions may provide for a variety of graphical user interfaces (e.g., for devices such as desktop terminals or computers, tablets, mobile devices, smart phones, etc.).

As an example, a GUI may provide for access to data, navigation, search features, chat capabilities, etc. As an example, the aforementioned InterACT™ system includes communication functionality for a chatroom. For example, a GUI of the InterACT™ system may provide various fields to setup a chatroom such as name (e.g., "drilling chatroom"), description (e.g., "chatroom with client"), activity (e.g., a dropdown menu), and category (e.g., a dropdown menu).

As an example, a data exchange system may include one or more features of the aforementioned InterACT™ system. As an example, data may be exchanged between one layer and another layer using a markup language. An example of a markup language is the WITSML™ markup language. The use of WITSML™ data objects and the data access application programming interface (API) can allow for development of an application that may exchange data with one or more other applications, to combine multiple data sets from different entities (e.g., services, vendors, etc.), for example, into an application (e.g., for analysis, visualization, collaboration, etc.).

As an example, one or more industrial information technology platforms that may include Open Platform Communications Data Access (OPC DA) functionality, which can be used to connect to one or more sensors and/or pieces of equipment, for example, through Classic OPC and/or OPC Unified Architecture (UA) as well as one or more standards such as, for example, MODBUS®, WITSML™, etc. As an example, connections, whether wired and/or wireless, may provide for data acquisition and/or control, where such connections may be operatively coupled to a simulation system.

Figure 19:
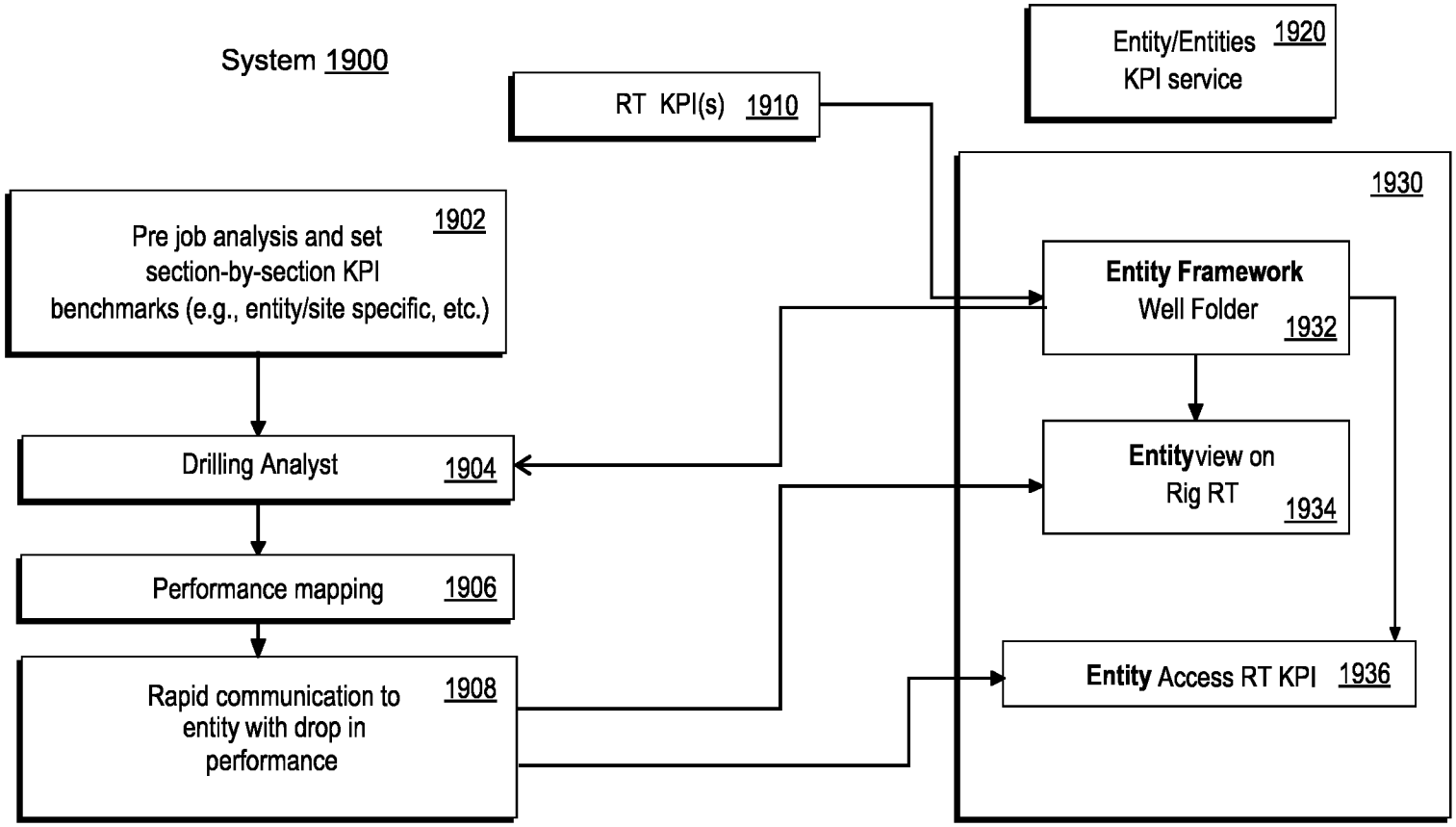
FIG. 19 illustrates an example of system.

FIG. 19 shows an example of a system 1900 that includes various blocks 1902, 1904, 1906, 1908, 1910, 1920, 1930, 1932, 1934 and 1936. As shown, the blocks may form a workflow where information may be exchanged, analyzed, etc. In the example of FIG. 19, a pre-job analysis may be performed per the block 1902 that can set section-by-section key performance indicators (KPIs), which may be particular types of metrics. As an example, a KPI may be defined with respect to an operation, a physical portion of a borehole, equipment, an entity or entities (e.g., an individual, a group, a corporation, a data system, etc.), etc. As an example, real-time (RT) KPIs per the block 1910 may be determined and compared against estimates such as pre-job estimates. In such an example, one or more deltas (e.g., deviations) from estimates may be determined and, for example, rendered to a display or displays. As an example, such an approach may be implemented to render such information at a rigsite while an operation is being performed (e.g., a tripping operation, etc.). As an example, a KPI service may be implemented via the system 1900. Such a service may aim to convey information (e.g., KPIs, etc.) and, for example, control an operation (e.g., optionally through presentation of information to one or more operators, controllers, etc.).

As an example, the system 1900 may provide for continuous improvement cycles and/or continual improvement cycles. Continuous improvement, sometimes called continual improvement, can be an ongoing improvement of products, services or processes through incremental and/or breakthrough improvements. For example, continuous improvement can be an ongoing effort to improve products, services or processes. These efforts can seek "incremental" improvement over time and/or "breakthrough" improvement (at once).

As an example, the system 1900 may be part of or operatively coupled to an interpretation engine such as, for example, the interpretation engine 1412 of the system 1400. As an example, the system 1400 may be implemented for a plurality of wellsites over a period of time where continuous improvement occurs as to the output of the system 1400. In such an example, the system 1400 can learn, for example, by training one or more algorithms associated with the interpretation engine 1412.

A continuous improvement can be achieved, for example, via a four-action quality model—the plan-do-check-act (PDCA) cycle, also known as Deming Cycle or Shewhart Cycle: Plan: Identify an opportunity and plan for change; Do: Implement the change on a small scale; Check: Use data to analyze the results of the change and determine whether it made a difference; Act: If the change was successful, implement it on a wider scale and continuously assess your results. If the change did not work, begin the cycle again.

Methods of continuous improvement—such as Six Sigma, LEAN, and Total Quality Management—may involve employees and teamwork; measuring and systematizing processes; and reducing variation, defects and cycle times.

The terms continuous improvement and continual improvement are frequently used interchangeably. But some quality practitioners make the following distinction: Continual improvement: a broader term of by W. Edwards Deming to refer to general processes of improvement and encompassing "discontinuous" improvements—that is, many different approaches, covering different areas. Continuous improvement: a subset of continual improvement, with a more specific focus on linear, incremental improvement within an existing process. Some practitioners also associate continuous improvement more closely with techniques of statistical process control.

As an example, the system 1400 may be implemented in a manner that includes continuous improvement. For example, consider the interpretation engine 1412 as learning through training of one or more algorithms (e.g., inference algorithms, etc.) based on data received and feedback from one or more sources. In such an example, where the system 1400 is implemented for a field that includes a plurality of wellsites, as the wellsites are developed (e.g., wells drilled), the system 1400 can learn from some of the wellsites and improve operations at other wellsites in the field. In such an approach, the field may be developed in a manner whereby the last drilled well is drilled in less time than a first drilled well. For example, the last drilled well may be drilled with less non-productive time (NPT) and, for example, with less uncertainty as to one or more metrics (e.g., depth, etc.).

As an example, the system 1900 may be implemented via a performance improvement process that creates value. For example, for a driller, this can mean achieving a better performance with each new hole that is drilled. As an example, one or more wells (e.g., offset, etc.) may be used to benchmark expected performance, for example, to establish key performance indicators (KPIs). As an example, the system 1900 may be implemented using information from a variety of sources, including individual wells in one block of a field, individual wells in another block of a field, individual wells in another field, etc.

As an example, KPIs may be established and statistically analyzed for central tendencies and convergence, which together serve as benchmarks. As an example, KPIs may be utilized in an approach to planning new wells. KPIs may be used for measuring performance of ongoing operations and to provide consistent, fact-based data for selecting an optimal approach for a well.

As an example, a system such as, for example, the system 1900 may be utilized to generate a drilling performance database that can provide for benchmarks by which performance can be measured and improved. As an example, the system 1900 can operate in real-time (e.g., according to acquisition of data at a site) and generate information that can inform one or more operations at a site and/or at one or more other sites. As an example, the system 1900 may be implemented for real-time continuous (e.g., or continual) improvement during drilling of a well at a site.

As an example, the system 1900 may provide for Key Performance Analysis in Real Time (KPA in RT). For example, such a system may move current drilling benchmarks to improve drilling, tripping and connection performance and reduce client costs. Such a system may, for example, allow one or more clients (e.g., entities) to track and improve performance in RT in one or more of a head office, OOC, home and rig. As an example, such a system may gather, store and provide a client KPI database suitable to develop future wells and/or to aid with new performance targets.

As an example, the system 1900 may implement a multi-platform approach for RT KPIs using InterACT™, the PERFORM Toolkit (PTK) and one or more wellsite logging systems. As an example, saving rig time may be accomplished via small incremental change, which may effectively add up to hours. As an example, the system 1900 may be part of or operatively coupled to the system 1000 of FIG. 10.

As to the PERFORM Toolkit (PTK), it is an engineering application that allows a user to gather, analyze, and optimize drilling data. The PTK can be used for job planning, execution, and post job evaluation. When used as pre-job planning tool, it enables users to analyze offset data to determine potential risks. When used in real time, surface and downhole measurements may be utilized for monitoring, analysis, etc. As an example, such information may be streamed. In such an example, the InterACT™ system may be implemented. As to post-job analysis tool, PTK can be used for failure analysis, visualization, and collaboration (communication). As an example, PTK may be used in IPM Real-Time Enabled Cells and OSCs.

As an example, Key Performance Analysis in Real Time (KPA RT) may include a staged approach. For example, consider a field trial where: Stage 1 includes setting benchmarks; Stage 2 includes execution and RT performance mapping; Stage 3 includes evaluation of results and setting one or more new benchmarks (e.g., revised, etc.) for a next well; and Stage 4 includes implementing the process at another block, field, etc.

As an example, PTK can operate via data streaming. For example, consider real-time rig streams of, for example, 65 channels, to the InterACT™ system, data capture via the InterACT™ system and real-time KPI calculations in PTK via a real time connect (RTC) component data link technology (Schlumberger Limited, Houston, Texas). As an example, one or more entity specific benchmarks may be set for one or more KPI channels. As an example, a system may render channels versus benchmarks in real-time. As an example, the system 1400 can include one or more feature of the InterACT™ system and/or other features to receive a plurality of channels of data where at least a portion of the channels provide realtime data from a plurality of wellsites.

Figure 20:
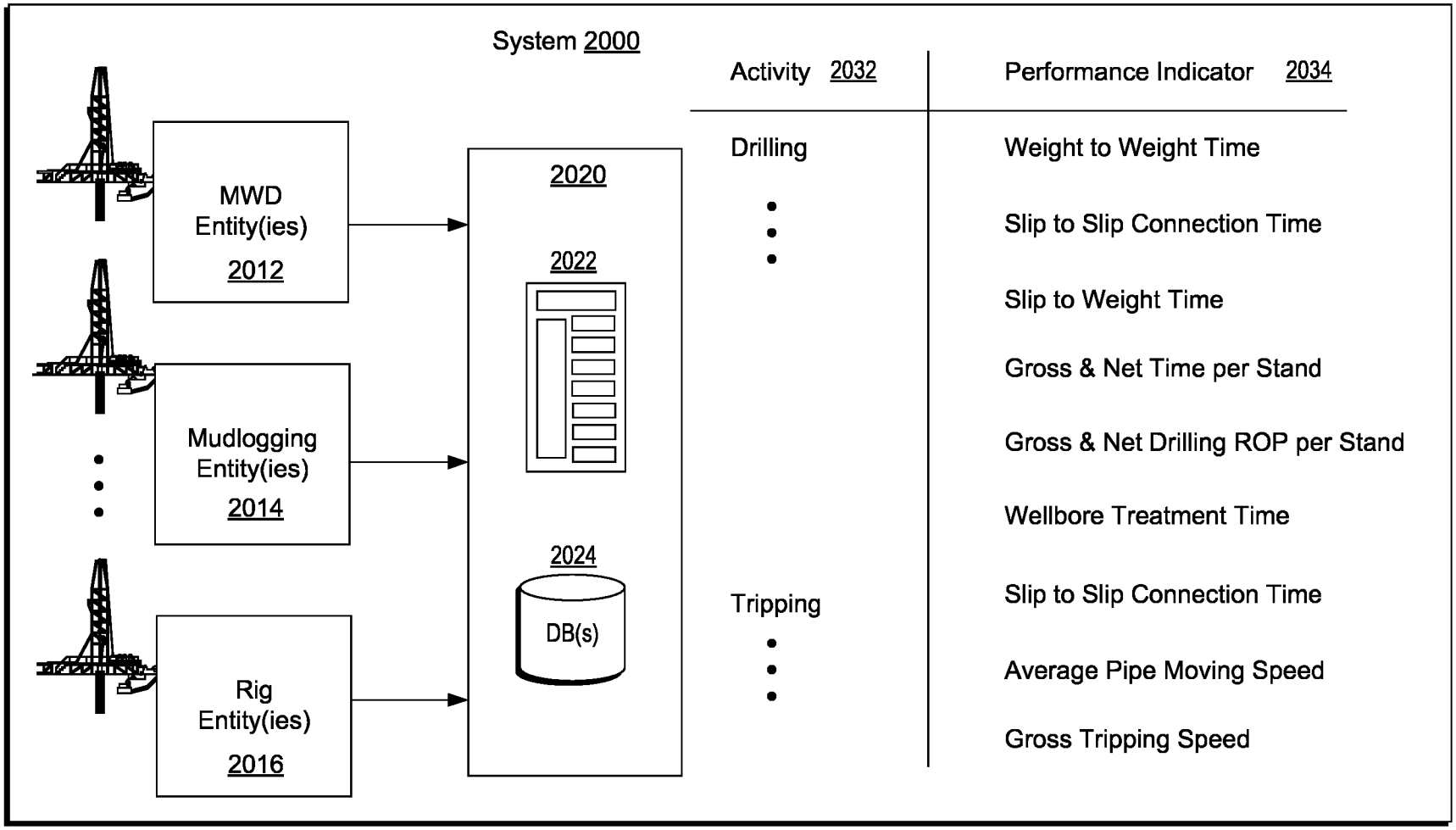
FIG. 20 illustrates an example of a system.

FIG. 20 shows an example of a system 2000 that includes entities 2012, 2014 and 2016 that generate information that can be received by a computing system 2020 that includes one or more computers 2022 (e.g., workstations, servers, etc.) and one or more data storage devices 2024 (e.g., databases). The system 2000 is shown as including a table that associates activities 2032 with performance indicators 2034, which may be particular to activities such as, for example, drilling, tripping, etc.

The entities 2012, 2014 and 2016 are examples of data acquisition sources that may be integrated via the computing system 2020 (e.g., the InterACT™ system, the system 1400 of FIG. 14, etc.). As an example, one or more channels may be real-time channels. For example, consider a system that can process 9 RT KPI channels as may be obtained via surface logging systems. As an example, an entity may choose which KPIs they want to focus on for a project (e.g., customized KPIs, focused KPIs, etc.). As an example, one or more KPI channels can be displayed RT at a rig. As an example, one or more KPI channels can be streamed RT to drilling analyst support equipment or individual or team.

As an example, a method can include setting KPIs on InterACT™ via an acquisition system (e.g., GN4, etc.) and the InterACT™ setup from InTouch with custom records. As an example, a method can include activating a KPI on an InterACT™ setup. For example, consider opening an InterACT™ xml file with a WITSML™ Record Editor. In such an example, consider a method that includes: On the Trigger Setup, Select the Trigger 2 (e.g., data time at 10 s intervals), and tick the record 65, and save. In such an example, a method may include: Go on communication Monitoring, stop the Wits connection, click on Modify and on Conf. File reselect your xml file modified.

FIG. 21 shows an example of a graphical user interface 2100 that provides for RT KPIs. In such an example, a method can include: Go the tab Record, select Receiver_1 and select the record 65, with State: ON, and for the Data Source: Port, then click on Apply. In such an example, for Sender_1, add record 65, State: ON, Data Source: Receiver_1, then Apply. In such an example, a method can include: go on the top left of Wits Server, click on file, then Save.

As an example, consider a rig specific set up where at the beginning the record 65 was sent but without corresponding KPI traces. In such an example, a user may modify information on an xml file, for example, with adding "0.1" at the end of each KPI traces. Consider as an example:

Before: KeyPerfIndicatorMeasuredSlipToSlipConnectionTime;

Modified as: KeyPerfIndicator.MeasuredSlipToSlipConnectionTime.1

Figure 22:
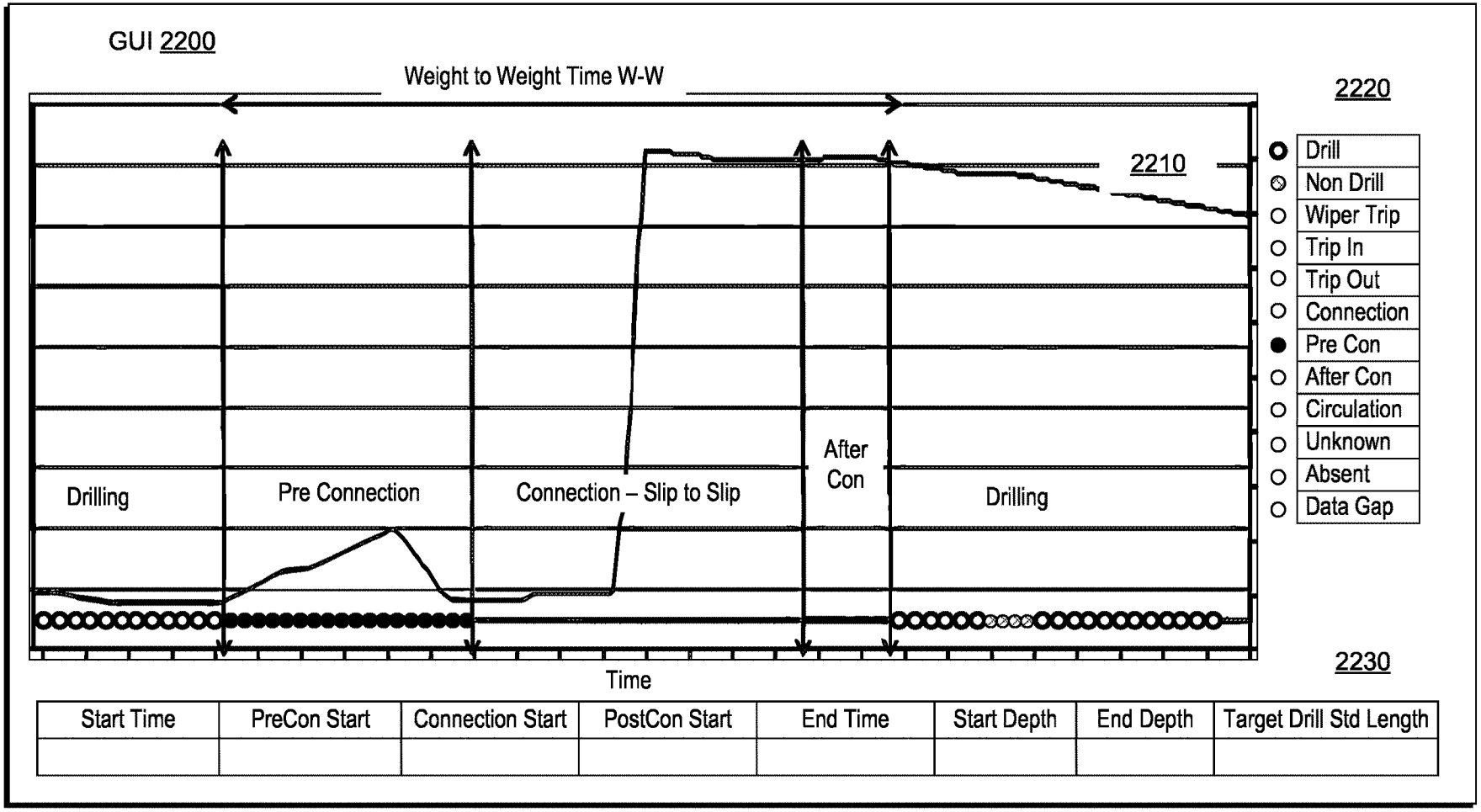
FIG. 22 illustrates an example of a graphical user interface.

FIG. 22 shows an example of a graphical user interface (GUI) 2200 that renders information as to Weight to Weight (minutes)=pre connection+slip to slip+after connection. The drill state in PTK is the standard offline method of KPI generation. The information in FIG. 22 is shown as DEPTH and HDTH versus time where operations include drilling, pre-connection, connection slip to slip time, after connection and again drilling. Weight to weight time is defined by various processes that occur between the two drilling windows. The GUI 2200 can include a table 2230 of information and can include a code graphic 2220 that can, for example, color code various operations, events, etc. for rendering to a display with respect to time, depth, etc. For example, a horizontal line is shown as including drilling events, pre-connection events and non-drilling events. Such an approach may allow a user to readily assess information in the GUI 2200. As an example, such a GUI may be part of a system such as the system 1400 of FIG. 14 (e.g., part of an expert station, etc.).

As mentioned with respect to the plot 770 of FIG. 7, block position data and/or load data (e.g., weight data) may be utilized in assessing one or more metrics such as, for example, wellbore depth and non-productive time (NPT). As shown in the plot 770 and in the GUI 2200, block position data and load data can be real-time data that may be dynamic at times and static at times. As shown in the GUI 2200, a weight-to-weight time may be estimated as being a time between two periods that include drilling (see open circles). During a period of drilling, a weight of interest is the weight applied to the bit on the bottom of the hole. As an example, a system such as the system 1400 of FIG. 14 can receive load data and/or block position data in real-time and analyze such data using the interpretation engine 1412 to generate results germane to one or more metrics such as, for example, weight on bit, depth of wellbore and productive and/or non-productive time. In such an example, one or more types of events may be determined to have occurred and/or may be likely to occur where the system 1400 can output information based at least in part on type of event to one or more destinations (e.g., destination addresses of a network or networks).

Figure 23:
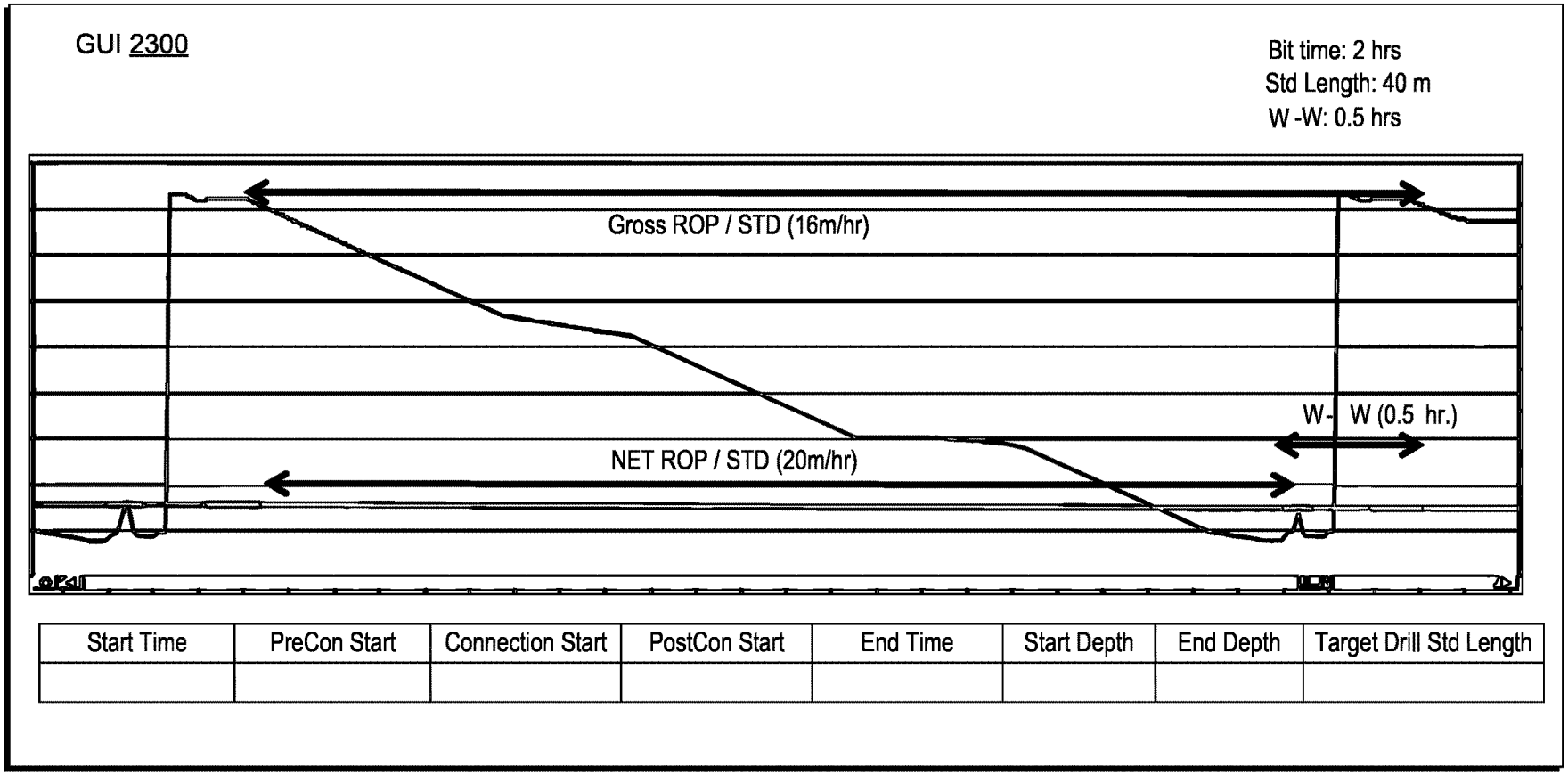
FIG. 23 illustrates an example of a graphical user interface.

FIG. 23 shows an example of a GUI 2300 renders information as to rate of penetration (ROP), for gross and net. As an example, ROP can be speed at which a drill bit breaks the rock under it to deepen a borehole. ROP may be known as a penetration rate or a drill rate. As an example, it may be provided in various units (e.g., feet per minute, meters per hour, minutes per foot, etc.). As an example, a real-time system may operate on increments in seconds and convert information to a minute basis (e.g., to accommodate units utilized by an operator, etc.). As an example, such a GUI may be part of a system such as the system 1400 of FIG. 14 (e.g., part of an expert station, etc.).

As an example, data such as block position data, load data, etc. may be received by the system 1400 for a plurality of wellsites in the realtime and analyzed using the interpretation engine 1412 to generate results, which can include a rate of penetration result for each of the plurality of wellsites. As an example, the interpretation engine 1412 may utilized various types of data and trained algorithms to reduce uncertainty and/or to characterize uncertainty as to rate of penetration for each of the plurality of wellsites. Where the wellsites are in a common field and drilling through layers that span the field, comparisons may be made from wellsite to wellsite. As an example, the interpretation engine 1412 can learn based on data from one of the wellsites by training one or more algorithms and utilize such one or more trained algorithms to analyze data from one or more of the other wellsites in the field. In such an example, non-productive time (NPT) may be reduced for one or more of the wellsites based on learning as to one or more of the other wellsites. In such an example, uncertainty as to one or more metrics may be reduce, for example, consider a reduction in uncertainty as to wellbore depth, weight on bit, rate of penetration (e.g., whether past, current or future), etc.

Figure 24:
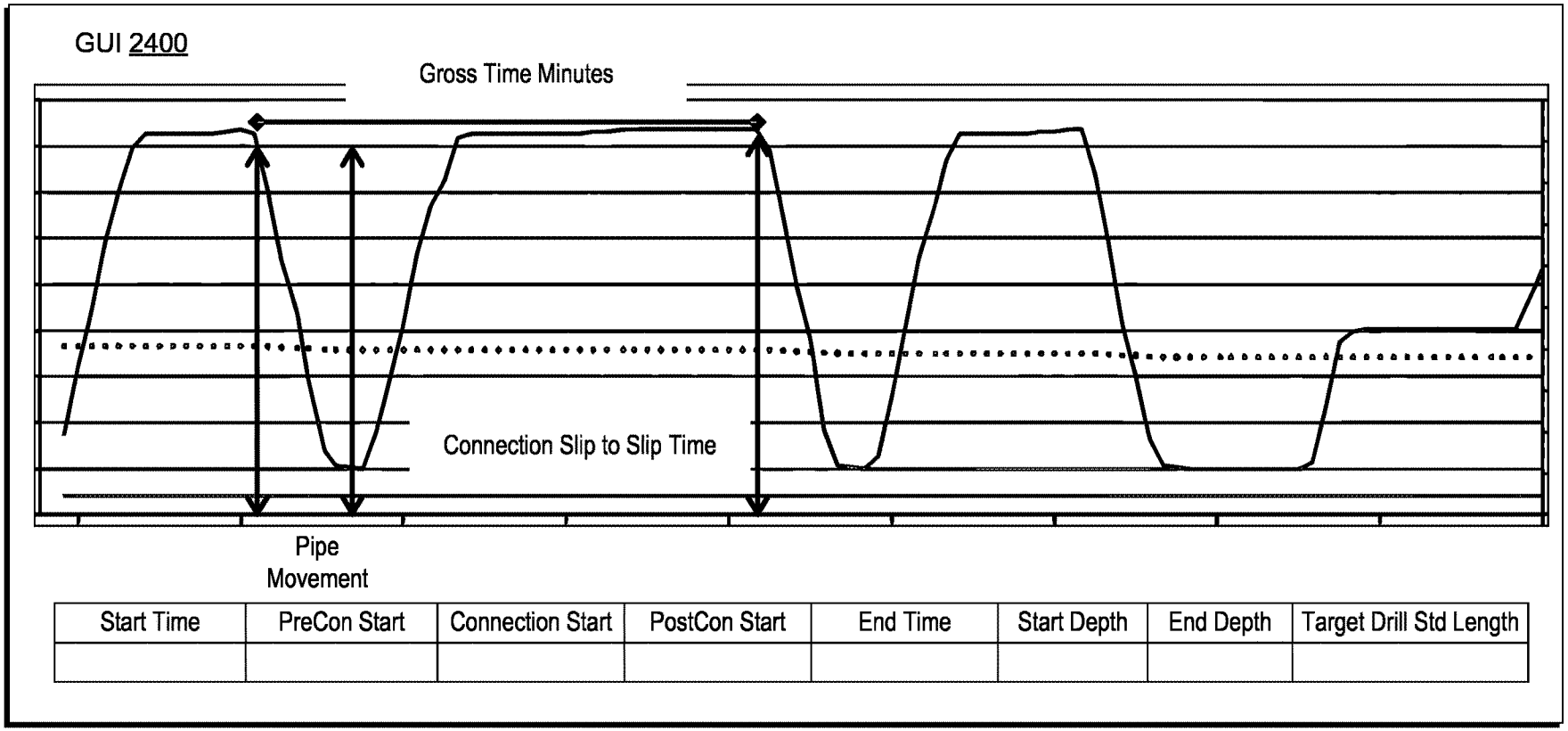
FIG. 24 illustrates an example of a graphical user interface.

FIG. 24 shows an example of a graphical user interface (GUI) 2400 that renders information such as gross time in minutes as may be calculated based on pipe movement (e.g., block position, etc.) and connection slip to slip time. Such a factor may be a metric (e.g., a KPI). As an example, such a GUI may be part of a system such as the system 1400 of FIG. 14 (e.g., part of an expert station, etc.).

Figure 25:
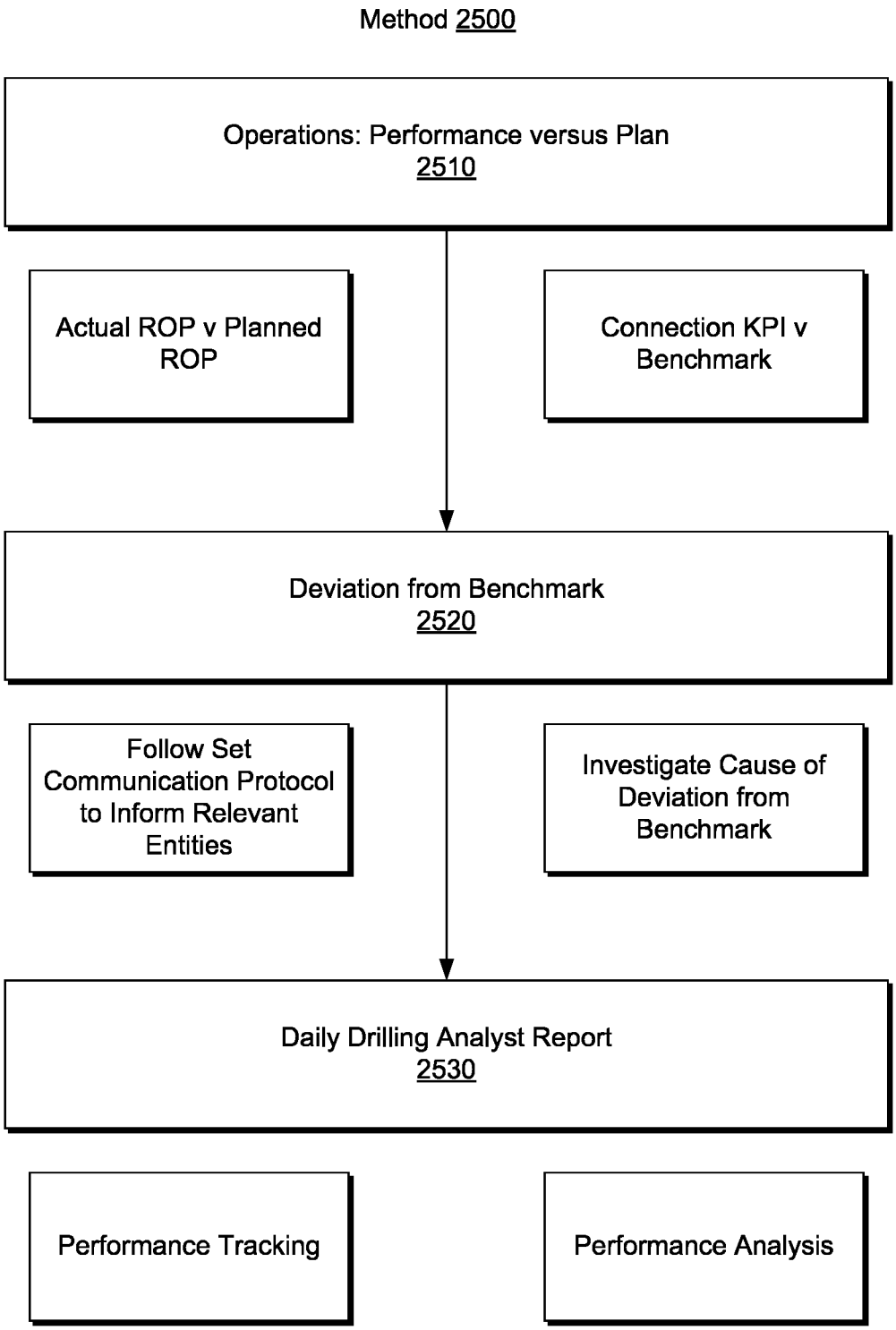
FIG. 25 illustrates an example of a method.

FIG. 25 shows an example of a method 2500 that includes an operations block 2510, a determination block 2520 for determining deviation from a benchmark and a report block 2530 for generating and outputting a drilling analyst report. The method 2500 can process information during drilling a well that compares KPIs generated RT on one system (e.g., GN4 data acquisition system) and offline by another system using PTK. As an example, a system may display the RT S-S and W-W for client to track connection performance. As an example, PTK can be used for in depth KPI Analysis for daily reports. As an example, the method 2500 may be implemented at least in part via a system such as the system 1400 of FIG. 14.

FIG. 26 shows an example of a graphical user interface (GUI) 2600 for a system that can handle information from various channels (e.g., RT channels, etc.). As an example, the channels may be available as input to a system such as, for example, the system 1400 of FIG. 14.

As to benchmarks, a system can allow for various set client specific benchmarks. As an example, consider a process that includes: Make UDF for each KPI benchmark; Make UDF to create tripping speed (mins/std) to compare versus results of a simulation utility such as, for example, the Virtual Hydraulics™ simulation utility (Schlumberger Limited, Houston, Texas); Set Time to minutes for units rather than hours; Add symbol and select channel and have scale set at halfway for benchmark.

The Virtual Hydraulics™ is a simulation utility that can be used to evaluate and design drilling hydraulics under simulated downhole conditions. For example, by monitoring and predicting equivalent circulating density (ECD), equivalent static density (ESD), temperature, hole cleaning, and tripping profiles, the utility can help to achieve a quality wellbore under optimal operating conditions while reducing rig time and lowering costs.

As an example, a method can include Key Performance Analysis RT operations; an execution phase performance versus a plan; an act on the RT information to improve performance; a client led performance push to reach benchmark targets; and information as to end of section (e.g., where it may be too late to make up for lost time).

As an example, a graphical user interface may render a color bar as a graphic that can indicate various times using color coding. Such an approach may readily allow an operator to assess an operation and to optionally make one or more adjustments to an operation (e.g., on-going or subsequent).

As an example, a graphical user interface can render information to a display, for example, in a client office (e.g., entity office) using PTK (e.g., RT Performance mapping in PTK). For example, the system 1400 of FIG. 14 may provide information at a site (e.g., drilling site/rig site) and at one or more locations, which can include one or more remote locations.

Figure 27:
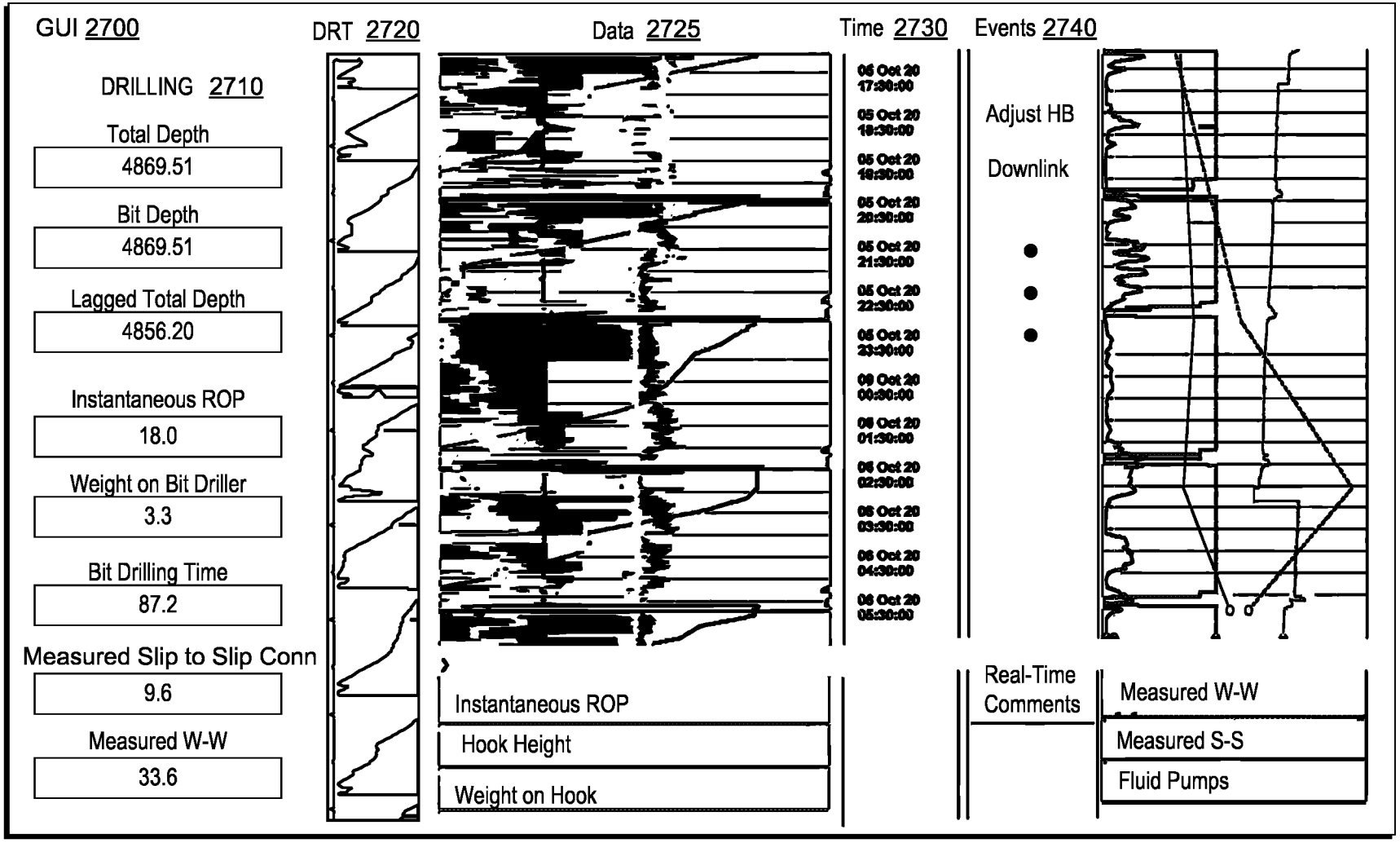
FIG. 27 illustrates an example of a graphical user interface.

FIG. 27 shows an example of a graphical user interface (GUI) 2700 with various types of information, including, for example, drilling information 2710 in a numeric form, drilling information in a graphical form 2720, various types of data in graphical forms 2725, a time line 2730 and an event line 2740. The GUI 2700 may render information such as RT W-W and S-S graphs and numeric values.

Figure 28:
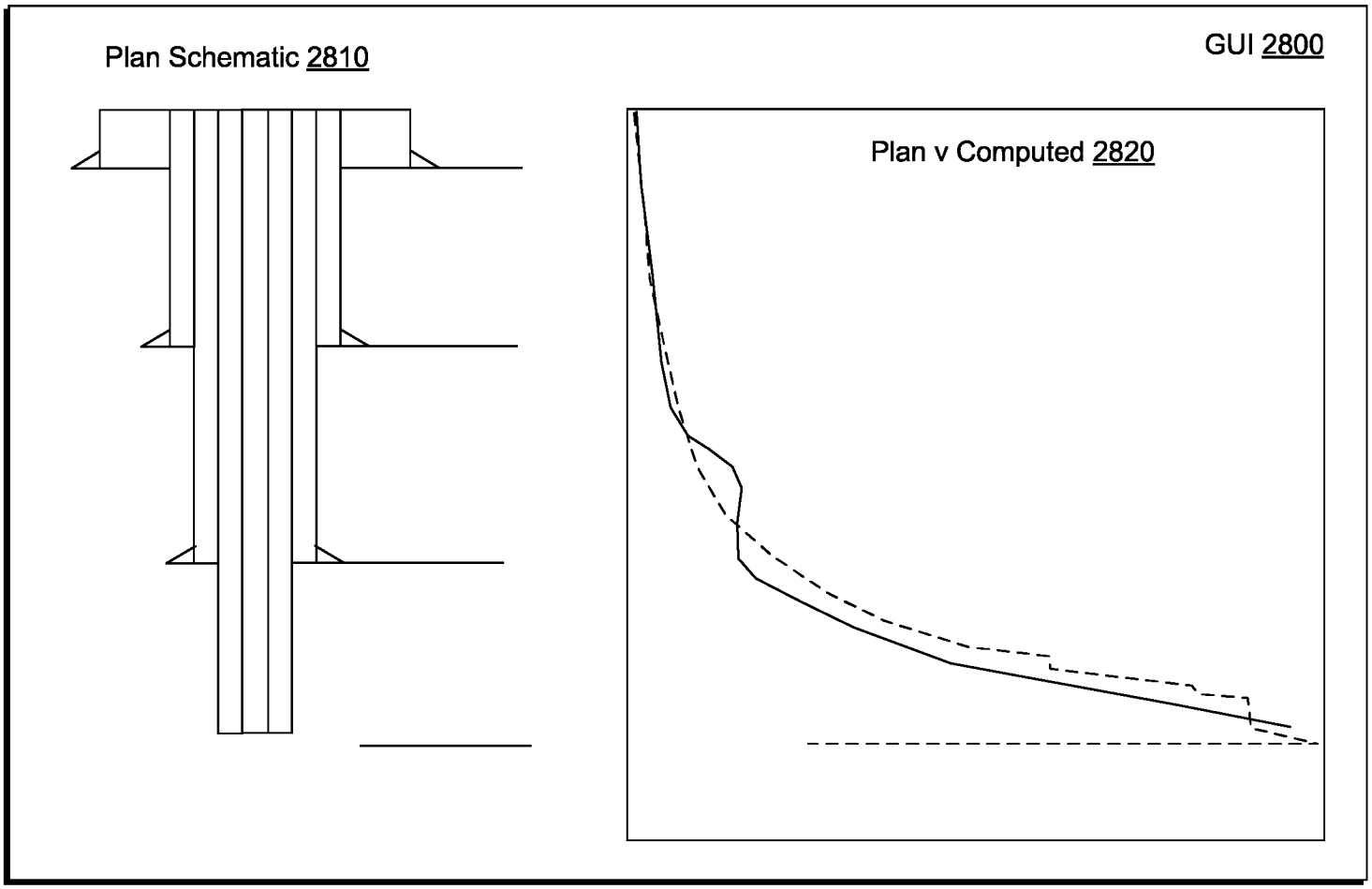
FIG. 28 illustrates an example of a graphical user interface.

FIG. 28 shows an example of a graphical user interface (GUI) 2800 that includes a plan schematic 2810 and a plot 2800 of information that illustrates discrepancies such as "deltas" or deviations. For example, consider a method that include tripMAX performance mapping. In such an example, tripping speed limitations due to surge/swab recommendations may in part determine pipe moving speed. As an example, a method can include comparing actual tripping speeds to planned tripping speeds. As an example, acceleration information may be provided and/or other position and time related information.

Figure 29:
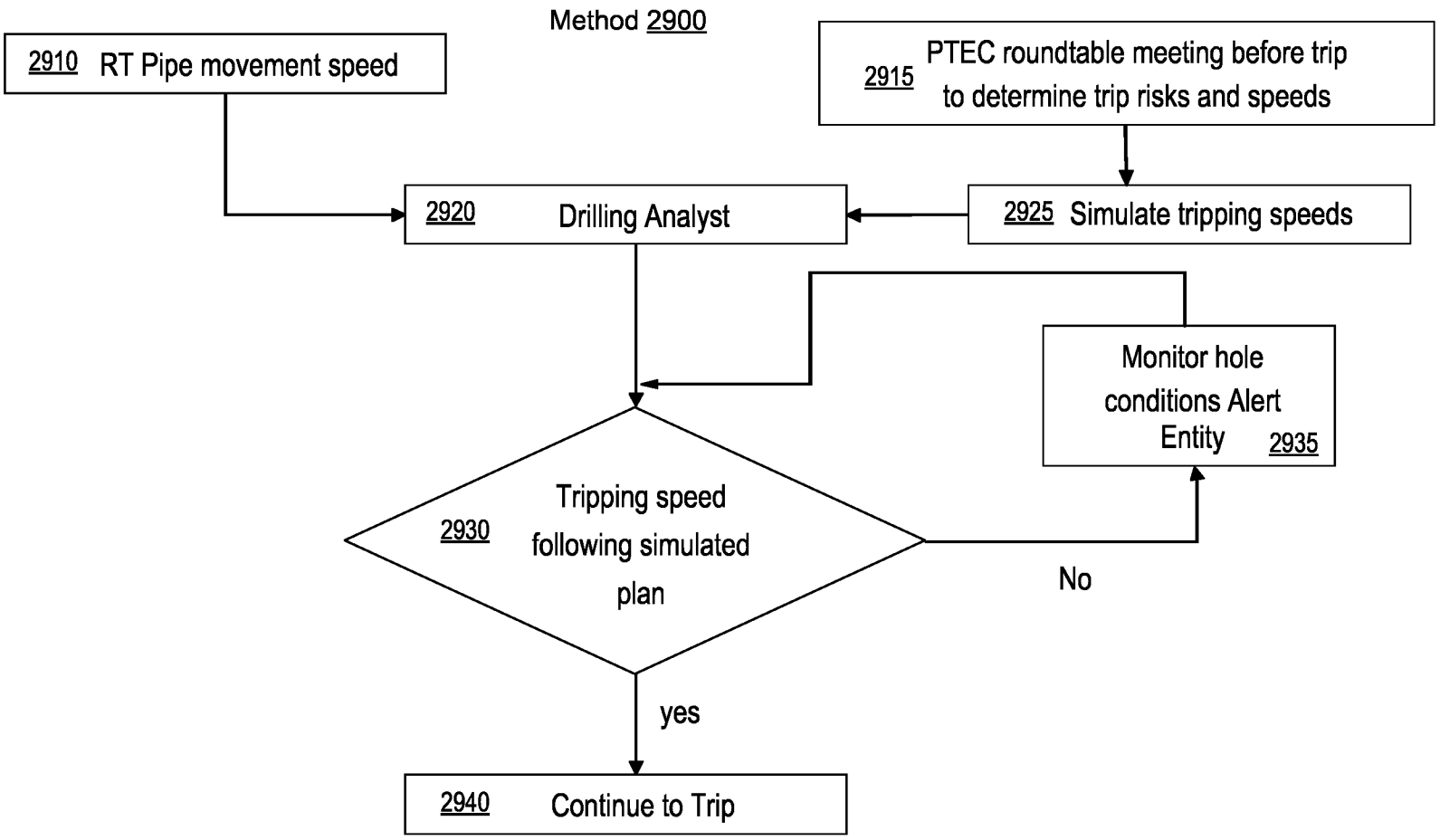
FIG. 29 illustrates an example of a method.

FIG. 29 shows an example of a method 2900 for a tripping speed work flow. As shown, the method 2900 includes a RT pipe movement speed block 2910, a meeting information block 2915, a simulation block 2925 for simulating a plan (e.g., generating a simulated plan), a drilling analyst block 2920, a decision block 2930 for deciding whether tripping speed is following a simulated plan, an alert block 2935 where deviation occurs from the simulated plan and a continuation block 2940.

As an example, planned tripping speeds may be determined by a simulation utility such as, for example, the Virtual Hydraulics™ simulation utility. As an example, the system 1400 of FIG. 14 may include the Virtual Hydraulics™ simulation utility (VH utility). As an example, a system may be operatively coupled to one or more simulation frameworks. For example, the system 1400 may be operatively coupled to one or more simulation frameworks that can simulate physical phenomena (e.g., equipment operation, fluid mechanics, stress in a formation, etc.).

As an example, a method can include copying depth and stand/sec columns from a simulation utility tripping schedule, making a new channel for pulling speed stands/min, and save as csv file and import into PTK.

Figure 30:
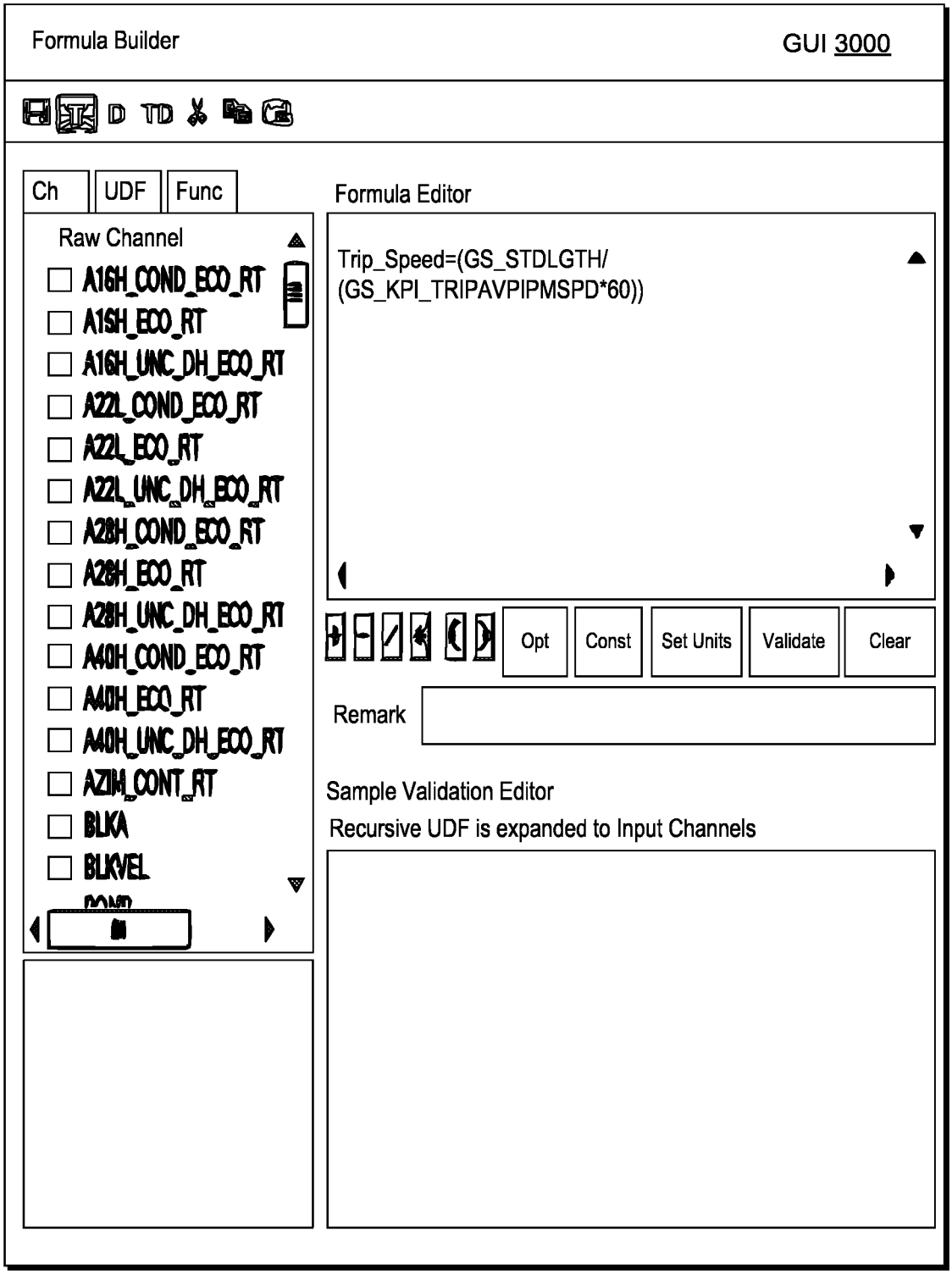
FIG. 30 illustrates an example of a method.

FIG. 30 shows an example of a graphical user interface (GUI) 3000 that can operate as an editor for generating one or more metrics based at least in part on information from one or more channels. For example, the editor can allow an operator to define a metric (e.g., a PKI, etc.). A method can include making a user-defined function (UDF) in the PTK for actual tripping speed minutes/stand. As an example, such a GUI may be part of or operatively coupled to a system such as the system 1400 of FIG. 14.

Figure 31:
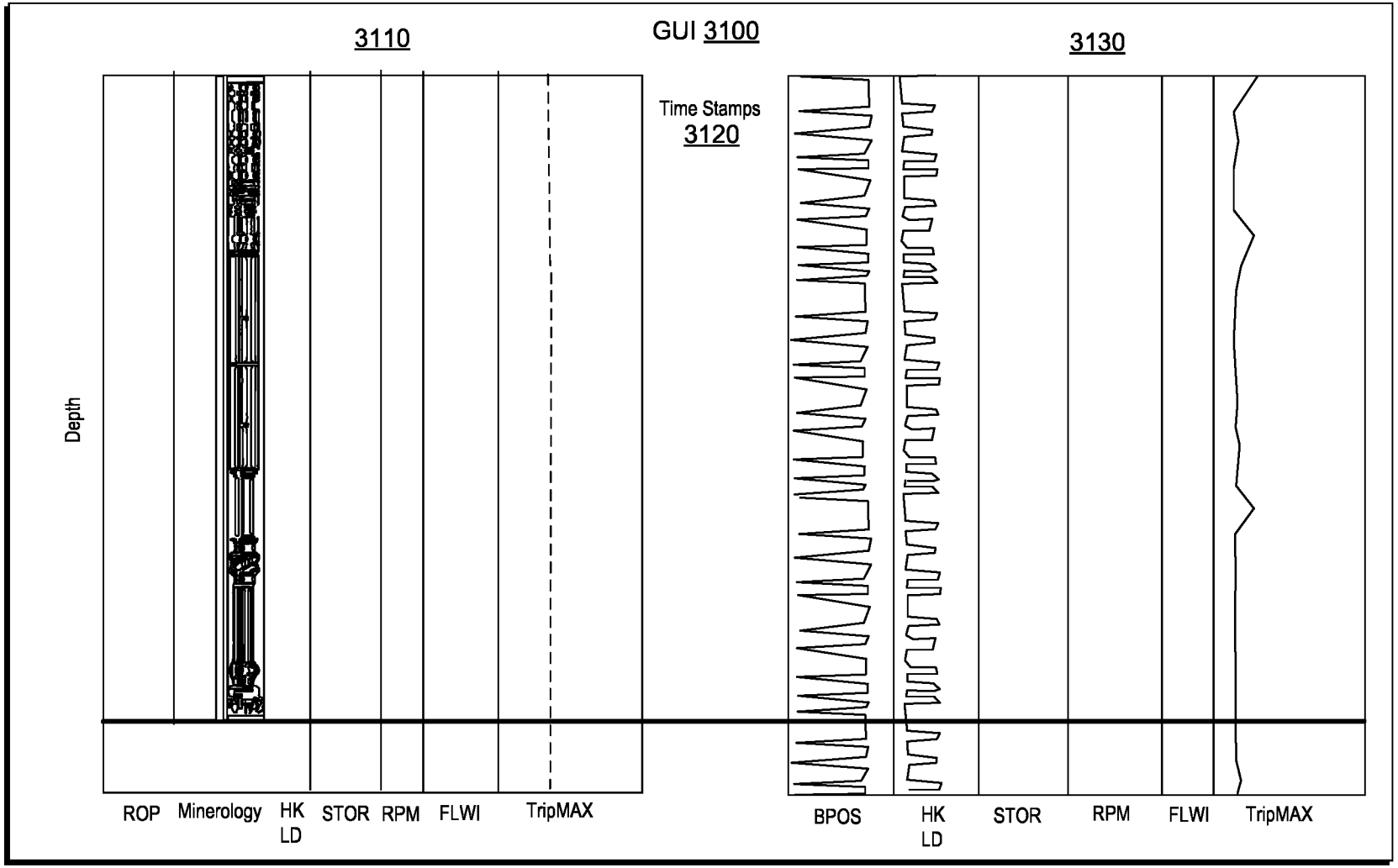
FIG. 31 illustrates an example of a graphical user interface.

FIG. 31 shows an example of a graphical user interface (GUI) 3100 that renders information for performance mapping in RT. For example, consider a scenario where tripping speed limitations may be due in part to surge/swab recommendations that determine pipe moving speed. As an example, a method can include creating a tripping sync log for a well Drilling Analyst to Compare Actual tripping speeds versus Planned tripping speeds (e.g., consider actual pulling speed 1.42 mins/std yr 0.5 min/std tripMAX). As shown in FIG. 31, the GUI 3100 includes a rendering of a drillstring and an associated bit depth in a first series of graphs 3110, a time stamps series field 3120 and a second series of graphs 3130.

Figure 32:
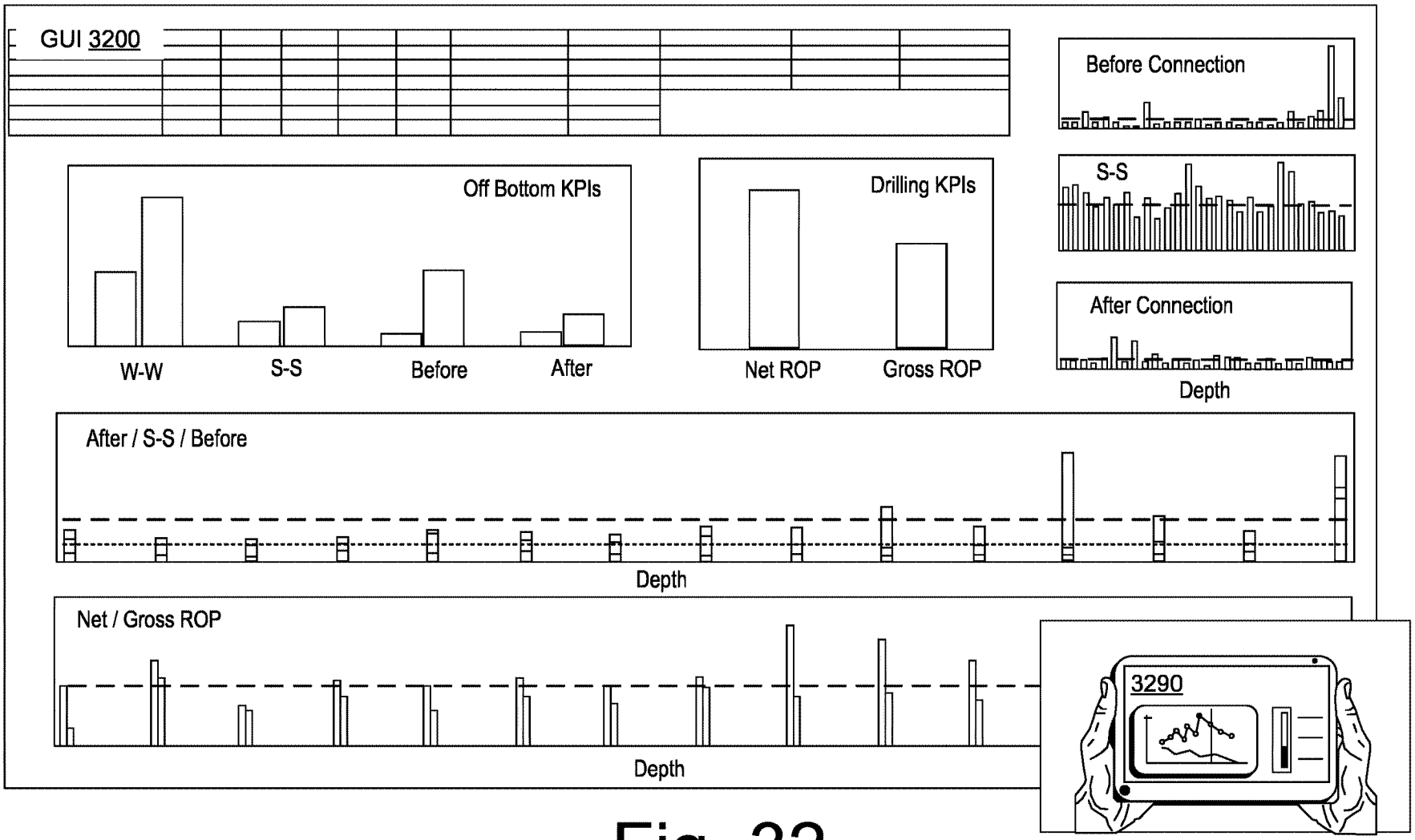
FIG. 32 illustrates an example of a graphical user interface.

FIG. 32 shows an example of a graphical user interface (GUI) 3200 that shows a Drilling Analyst KPI Analysis Report, which may be rendered, for example, via a display of a mobile device 3290. As an example, such a report may be generated on a daily or other time basis (e.g., 12 hr. or 24 hr. shift report for client). As an example, a report may filter unrepresentative connection times. As an example, information in the GUI 3200 may be generated by a system such as, for example, the system 1400 of FIG. 14. As an example, such a GUI may include a feedback control that allows information to be transmitted to a system that includes or is operatively coupled to an interpretation engine such as, for example, the interpretation engine 1412 of FIG. 14. In such an example, the interpretation engine can learn from the feedback, whether such feedback is positive, neutral or negative. Positive feedback may indicate that the interpretation engine is operating in an acceptable manner, neutral feedback may be an indication that information has been reviewed and/or received without comment and negative feedback may indicate that one or more outputs of an interpretation engine can be improved (e.g., via further training, etc.).

FIG. 33 shows an example of a method 3310 that includes a definition block 3314 for defining metrics, an acquisition block 3318 for acquiring data; a determination block 3322 for determining deltas; and an adjustment block 3326 for adjusting at least one process. Such a method may be a continuous (e.g., continual) improvement process. As an example, the method 3310 can include redefining one or more metrics and/or introducing one or more new metrics. In such an example, the determining deltas may be in real-time based at least in part on acquisition of real-time data via one or more channels.

As an example, a system may provide for RT KPI values that may be utilized, for example, for planning, for establishing quality benchmarks, for process improvement, etc. As an example, one or more section by section comparisons, trend comparison across regional markets, etc., may be made based at least in part on one or more RT KPIs. As an example, a Drilling Analyst may be supported by RT KPIs, for example, to achieve new performance targets. As an example, a method can include learning and, for example, improving performance (e.g., section by section, etc.).

As an example, a system may include one or more modules for RT KPIs in PTK.

As an example, a method can include pushing the speed limit of moving pipe in an operation. As an example, a method can include comparing a best speed and an actual speed. As an example, a method can include comparing a planned speed and an actual speed, where a cone of uncertainty may exist for future actual speeds and, for example, where adjustments may be made to reduce deltas and/or to increase speed(s). As an example, a method can include tripping in and/or tripping out.

As an example, a method can include defining metrics, determining a plan with respect to time, receiving data, determining deltas and making one or more adjustments. As an example, a method may include selecting channels and defining one or more functions based at least in part on a channel (e.g., associated information). As an example, a channel can be a real-time channel.

As an example, a well may be a deviated well or a horizontal well. As an example, a method can include reducing risk of sticking based at least in part on RT KPI information. As an example, a method can include gathering data for the rig and plotting in real time versus plan to show deviations and/or other metrics.

As an example, a display may convey information to an operator of a rig during operation. Such information can include information as to deviations and, for example, as to one or more of velocity, acceleration, position versus time.

As an example, a system can include a rig, data acquisition equipment and analysis modules. For example, consider a system that includes a rig, InterACT and PTK. As an example, a system may include one or more features of the system 1400 of FIG. 14. As an example, adjustments may be made that improve performance, which may include slowing down or speeding up one or more processes (e.g., depending on one or more goals, etc.). As an example, slowing down may reduce risk of sticking, etc. As an example, an adjustment may aim to meet one or more regulatory goals.

In the example of FIG. 33, the system 3370 includes one or more information storage devices 3372, one or more computers 3374, one or more networks 3380 and instructions 3390. As to the one or more computers 3374, each computer may include one or more processors (e.g., or processing cores) 3376 and memory 3378 for storing the instructions 3390, for example, executable by at least one of the one or more processors. As an example, a computer may include one or more network interfaces (e.g., wired or wireless), one or more graphics cards, a display interface (e.g., wired or wireless), etc.

Figure 34:
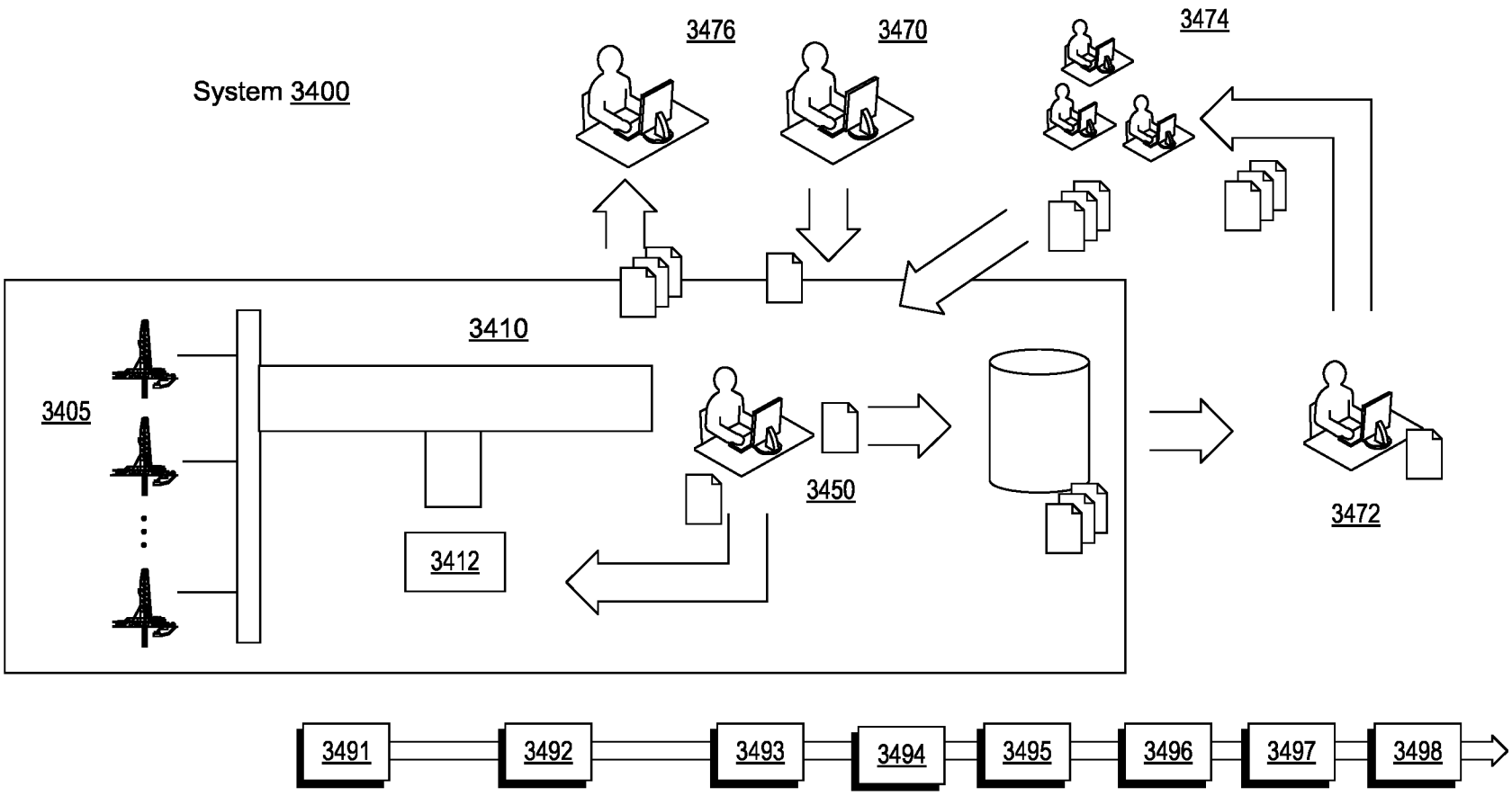
FIG. 34 illustrates an example of a system and example workflows.

FIG. 34 shows an example of a system 3400 and examples of workflows as associated with a plurality of wellsites 3405. In the example of FIG. 34, the block 3410 can correspond to various components of the system 1400 of FIG. 14. As shown in the example of FIG. 34, a plurality of wells being drilled and/or completed (e.g., or otherwise being operated, etc.) can transmit information to one or more data interfaces that can provide data to an engine 3412, which can be or include an interpretation engine such as the interpretation engine 1412 of the system 1400 of FIG. 14. Such an engine may be or may include an inference engine.

As shown in the example of FIG. 34, a master review component 3450 can be implemented that can review output, which can include results of the interpretation engine 3412. As an example, the master review component 3450 may be operated to effectuate one or more forms of quality-control (QC) as to the output. As an example, an interpretation engine can output information that can be reviewed prior to transmission of the information to one or more destination addresses.

In the example of FIG. 34, rig site equipment can be an "actor" that can generate events, etc. As an example, rig site equipment may issue notifications or information that causes a system to address one or more situations that may be occurring at a rig site. For example, a delay may exist at a rig site due to an action or actions that are not being taken elsewhere.

FIG. 34 shows various digital files, which may be streaming files, discrete files, information associated with an API call, information associated with an API response, etc. FIG. 34 also shows various stations 3470, 3472, 3474 and 3476, which correspond to a wellsite assignment station 3470, a cross-fleet station 3472, an operations management station or stations 3474 and an escalation station 3476.

As an example, a workflow can include receiving an assignment file from the wellsite assignment station 3470, which may include a communication matrix file. The master review component 3450 may be aware of information in the assignment file or may be agnostic to assignments and review information generated regardless of destination(s) to which such generated information may be directed. The assignment file can include information for directing generated information to one or more cross-fleet stations such as the cross-fleet station 3472. Reports, as digital files, may be routed from the cross-fleet station 3472 to the operations management station or stations 3474. In such an example, one or more digital files may be generated by one or more of the operations management stations 3474 and transmitted to adjust one or more aspects associated with monitoring of one or more wellsites. Such information may be received by the master review component 3450 and utilized to adjust one or more aspects of the interpretation engine 3412. For example, information may be utilized to train one or more algorithms of the interpretation engine 3412.

As shown in FIG. 34, one or more digital files may be transmitted according to one or more escalation rules, which may be specified in a communication matrix file, which may be part of or associated with an assignment file. The various stations 3470, 3472, 3474 and 3476 can be operatively coupled via one or more networks such that escalation notifications can be adequately addressed, routed, etc., including to one or more of the wellsites 3405.

In the example of FIG. 34, various blocks 3491, 3492, 3493, 3494, 3495, 3496, 3497 and 3498 are shown, which correspond to algorithms, data storage, system behaviors, notifications, visualizations, quality control, collaboration and reporting components of the system 3400. The blocks are illustrated along a workflow arrow that corresponds to various actions that can be performed by the system 3400.

As an example, the system 3400 can operate for monitoring drilling activities (e.g., drilling, tripping, casing runs, riser runs, etc.) via various streaming (real-time) computations (e.g., as to stand detection, rig states, drilling activities, KPIs, statistics, etc.) and can persist data (e.g., stand KPIs, well KPIs, activity logs, etc.) as well as issue notifications (e.g., as to events, streaming interruptions, process interruptions, escalations, de-escalations, quality metrics). As an example, the system 3400 can include analyzing data as to quality. Such an approach can include excluding information, which may help to preserve integrity of the interpretation engine 3412 as to learning, training, etc., one or more algorithms. As an example, the system 3400 may generate information that can automatically and/or manually adjust one or more operations at one or more of the wellsites 3405.

The system 3400 includes various features that allow for feedback from individuals via various stations. Such feedback can be captured as knowledge, which can populate a knowledge base and/or be utilized to train one or more algorithms of the interpretation engine 3412 where evaluations may be performed based on various inputs to generate information that can be directed to one or more destinations (e.g., destination addresses per a communication matrix, etc.).

The system 3400 can transform drilling data from the plurality of wellsites 3405 into actionable knowledge, which can result in feedback, which can further enhance one or more algorithms of the interpretation engine 3412.

As mentioned, a system can include an interpretation engine such as an interpretation engine of the APACHE STORM distributed real-time computation system for processing large volumes of streaming data. Such a system can process over a million records per second per node on a cluster. Such a system can include operational dashboards such as the various specialized stations in the system 3400 of FIG. 34. As an example, the system may implement one or more security measures, which may aim to preserve integrity of one or more interpretation engines. As an example, the system 3400 can include a cyber security analytics and threat detection component.

As an example, the system 3400 can help to prevent particular scenarios at the wellsites 3405 and/or help to optimize operations at the wellsites 3405. As an example, the system 3400 can become aware of its own operation, for example, as part of security that aims to protect the interpretation engine 3412 from input that may result in unacceptable output and/or unacceptable training (e.g., learning). As an example, the system 3400 may issue notifications where operations procedures are followed or not followed.

As an example, the system 3400 may analyze information associated with equipment conditions at the wellsites 3405. For example, the system 3400 can include a component that tracks equipment histories as to usage, maintenance, etc. As an example, one or more notifications may be issued where usage may deviate from an expected usage, where maintenance is indicated, etc.

As an example, the system 3400 may determine whether information is corrupt, missing, or otherwise inadequate. Such determinations may be associated with equipment condition. For example, where a sensor at a wellsite fails or is failing, data may drift, be sporadic, etc. The system 3400 may include a component that assesses data prior to transmission to the interpretation engine 3412. As an example, the interpretation engine 3412 may assess data to determine whether it is deviating from one or more expectations for such data, optionally based on other information from one or more of the wellsites 3405.

The system 3400 may be utilized to implement a method such as, for example, the method 2500 that includes the operations block 2510, the determination block 2520 for determining deviation from a benchmark and the report block 2530 for generating and outputting a drilling analyst report. The system 3400 may be utilized to implement multiple instances of the method 2500 for a plurality of wellsites, which may be in a common field or in one or more different fields.

Figure 35:
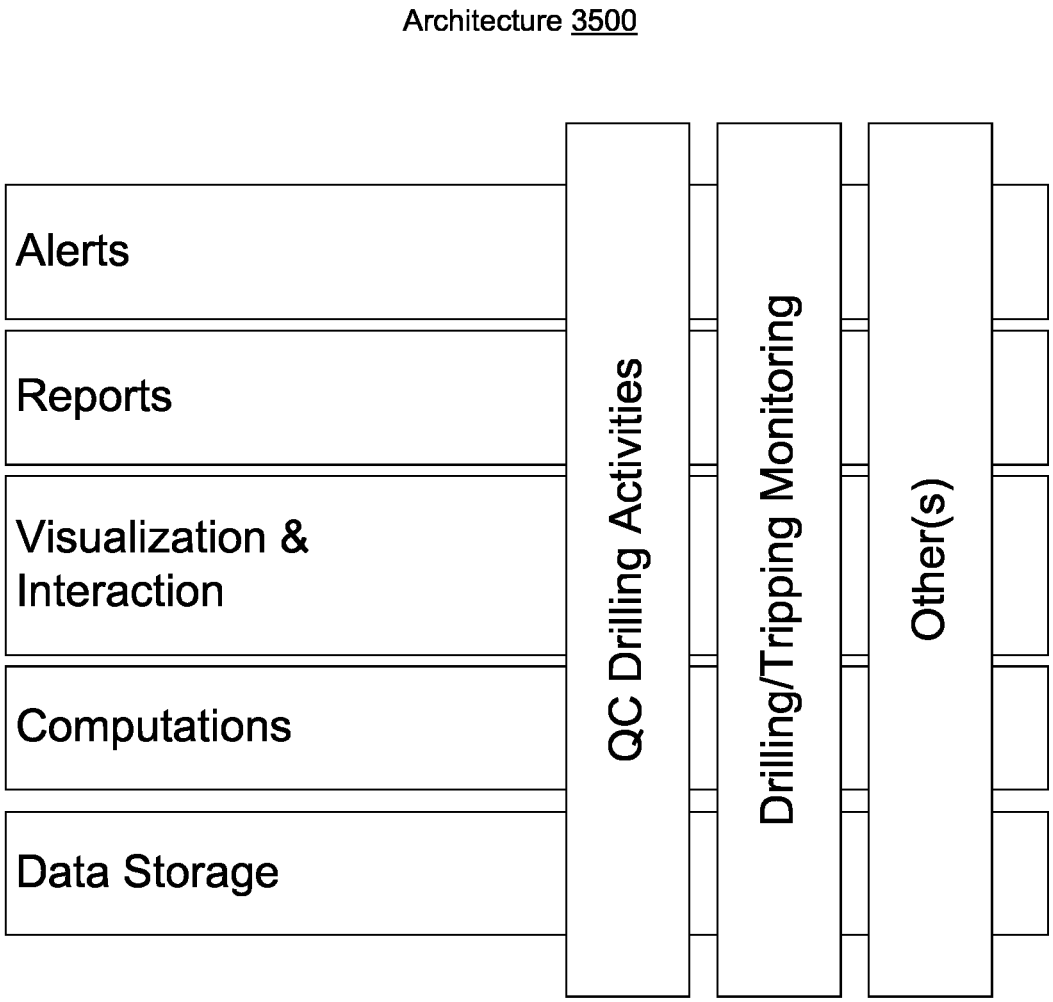
FIG. 35 illustrates an example of an architecture.

FIG. 35 shows an example of an architecture 3500. As an example, the system 3400 may be implemented to effectuate one or more scenarios illustrated in the architecture 3500.

As an example, a system can include a data interface that receives data associated with a plurality of wells; an inference engine that receives and analyzes at least a portion of the data to generate results; and a communication engine that outputs information based at least in part on the results. In such an example, the data can include measured depth data for the plurality of wells where, for example, the results include wellbore depth results for each of the plurality of wells. In such an example, the communication engine may output wellbore depth information for at least a portion of the plurality of wells to a destination address specified in a file that associates wells and destination addresses.

As an example, an inference engine may characterize uncertainty of wellbore depth for each of a plurality of wells. As an example, an inference engine may generate wellbore depth results based on at least two types of measured depth data.

As an example, a system can include receiving various types of data where the data can include rig block position data and/or rig hook load data. As an example, an interpretation engine can generate results that may include non-productive time results based at least in part on rig block position data and/or rig hook load data.

As an example, a system can include a communication matrix that relates destination addresses to a plurality of wells where a communication engine outputs information to one or more destination addresses based at least in part on the communication matrix.

As an example, results generated by an interpretation engine can include events. In such an example, a communication engine can relate types of events and levels and/or types of events to destination addresses. As an example, a communication matrix can be a digital file that associates events and levels and/or events and destination addresses and/or levels and destination addresses.

As an example, a communication engine can output information for a type of event to a destination address associated with one of a plurality of levels where each of the levels is associated with a role. In such an example, the communication engine can adjust output of information from one of the levels to another one of the levels to escalate the information and/or adjusts output of information from one of the levels to another one of the levels to de-escalate the information.

As an example, an inference engine can generate results for individual wells of a plurality of wells based at least in part on corresponding individual well plans. In such an example, the well plans can be digital well plans that are received by a system that includes the inference engine.

As an example, an inference engine can receive and analyze at least a portion of data from a first plurality of wells and from a second plurality of wells to generate results for the first plurality of wells and the second plurality of wells.

As an example, a method can include receiving data associated with a plurality of wells; analyzing at least a portion of the data using an interpretation engine to generate results; and outputting information based at least in part on the results. In such an example, the interpretation engine can be or can include an inference engine.

One or more computer-readable storage media can include processor-executable instructions to instruct a computing system to: receive data associated with a plurality of wells; analyze at least a portion of the data using an interpretation engine to generate results; and output information based at least in part on the results. In such an example, the interpretation engine can be or can include an inference engine.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

FIG. 36 shows components of a computing system 3600 and a networked system 3610. The system 3600 includes one or more processors 3602, memory and/or storage components 3604, one or more input and/or output devices 3606 and a bus 3608. According to an embodiment, instructions may be stored in one or more computer-readable media (e.g., memory/storage components 3604). Such instructions may be read by one or more processors (e.g., the processor(s) 3602) via a communication bus (e.g., the bus 3608), which may be wired or wireless. The one or more processors may execute such instructions to implement (wholly or in part) one or more attributes (e.g., as part of a method). A user may view output from and interact with a process via an I/O device (e.g., the device 3606). According to an embodiment, a computer-readable medium may be a storage component such as a physical memory storage device, for example, a chip, a chip on a package, a memory card, etc.

According to an embodiment, components may be distributed, such as in the network system 3610. The network system 3610 includes components 3622-1, 3622-2, 3622-3, . . . 3622-N. For example, the components 3622-1 may include the processor(s) 3602 while the component(s) 3622-3 may include memory accessible by the processor(s) 3602. Further, the component(s) 3622-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

controlling of a display to render a graphical user interface that presents at least a formula tool utilized to generate at least one performance indicator, wherein the graphical user interface operates to identify one or more sensor data channels for the at least one performance indicator using one or more of a user defined function tool and a sensor data channel selection tool, wherein the one or more sensor data channels correspond to one or more sensors of a wellsite system;

determining a benchmark using the at least one performance indicator and a simulation utility configured to evaluate drilling hydraulics corresponding to a simulated downhole condition during a planned operation associated with drilling of a well according to a well plan, wherein the planned operation includes a tripping operation at a planned tripping speed, and wherein the benchmark comprises a tripping speed;

accessing the one or more sensor data channels during execution of the planned operation;

during the execution of the planned operation, receiving data of the one or more sensor data channels in real-time to compute at least one real-time performance indicator; and determining, using the at least one real-time performance indicator, at least one deviation from the benchmark, wherein a control system is configured to adjust at least movement of pipe associated with the execution of the planned operation based on the at least one deviation.

2. The method of claim 1, wherein receiving the data includes receiving rig block position data that is associated with pipe length, wherein the rig block position data is utilized to characterize uncertainty in a pipe length based estimate of depth.

3. The method of claim 1, wherein receiving the data includes receiving rig hook load data that is utilized to determine an expected amount of stretching per a pipe segment, a minimum amount of stretching per the pipe segment, and a maximum amount of stretching per the pipe segment.

4. The method of claim 1, further including hosting a client key performance indicators database that is utilized to develop future wells and to determine new performance targets.

5. The method of claim 1, wherein determining the benchmark comprises utilizing an inference engine trained using at least historical data from one or more other wells in addition to or in place of the simulation utility.

6. The method of claim 1, comprising transmitting the benchmark to the control system and controlling the execution of the planned operation based at least in part on the benchmark.

7. A system comprising:

a processor;

memory accessible by the processor; and processor-executable instructions stored in the memory and executable to instruct the system to:

control a display to render a graphical user interface that presents at least a formula tool utilized to generate at least one performance indicator, wherein the graphical user interface operates to identify one or more sensor data channels for the at least one performance indicator using one or more of a user defined function tool and a sensor data channel selection tool, wherein the one or more sensor data channels correspond to one or more sensors of a wellsite system;

determine a benchmark using the at least one performance indicator and a simulation utility configured to evaluate drilling hydraulics corresponding to a simulated downhole condition during a planned operation associated with drilling of a well according to a well plan, wherein the planned operation includes a tripping operation at a planned tripping speed, and wherein the benchmark comprises a tripping speed;

access the one or more sensor data channels during execution of the planned operation;

during the execution of the planned operation, receive data of the one or more sensor data channels in real-time to compute at least one real-time performance indicator; and determine, using the at least one real-time performance indicator, at least one deviation from the benchmark, wherein a control system is configured to adjust at least movement of pipe associated with the execution of the planned operation based on the at least one deviation.

8. The system of claim 7, wherein the system is instructed to receive rig block position data that is associated with pipe length, wherein the rig block position data is utilized to characterize uncertainty in a pipe length based estimate of depth.

9. The system of claim 7, wherein the system is instructed to receive rig hook load data that is utilized to determine an expected amount of stretching per a pipe segment, a minimum amount of stretching per the pipe segment, and a maximum amount of stretching per the pipe segment.

10. The system of claim 7, wherein a client key performance indicators database is utilized to develop future wells and to determine new performance targets.

11. The system of claim 7, wherein to determine the benchmark comprises using an inference engine trained using at least historical data from one or more other wells in addition to or in place of the simulation utility.

12. The system of claim 7, wherein the system is instructed to receive a request from the control system for the benchmark.

13. The system of claim 7, wherein the system is instructed to transmit the benchmark to the control system and to control execution of the planned operation based at least in part on the benchmark.

14. A non-transitory computer-readable storage medium storing instructions that when executed by a computer, which includes a processor, cause the processor to:

control a display to render a graphical user interface that presents at least a formula tool utilized to generate at least one performance indicator, wherein the graphical user interface operates to identify one or more sensor data channels for the at least one performance indicator using one or more of a user defined function tool and a sensor data channel selection tool, wherein the one or more sensor data channels correspond to one or more sensors of a wellsite system;

determine a benchmark using the generated at least one performance indicator and a simulation utility configured to evaluate drilling hydraulics corresponding to a simulated downhole condition during a planned operation associated with drilling of a well according to a well plan, wherein the planned operation includes a tripping operation at a planned tripping speed, and wherein the benchmark comprises a tripping speed;

access the one or more sensor data channels during execution of the planned operation;

during the execution of the planned operation, receive data of the one or more sensor data channels in real-time to compute at least one real-time performance indicator; and determine, using the at least one real-time performance indicator, at least one deviation from the benchmark, wherein a control system is configured to adjust at least movement of pipe associated with the execution of the planned operation based on the at least one deviation.

15. The method of claim 1, wherein the simulation utility is configured to evaluate the drilling hydraulics by monitoring and predicting at least one of equivalent circulating density (ECD), equivalent static density (ESD), temperature, hole cleaning, or tripping profiles.

16. The system of claim 7, wherein the simulation utility is configured to evaluate the drilling hydraulics by monitoring and predicting at least one of equivalent circulating density (ECD), equivalent static density (ESD), temperature, hole cleaning, or tripping profiles.

17. The non-transitory computer-readable storage medium of claim 14, wherein the simulation utility is configured to evaluate the drilling hydraulics by monitoring and predicting at least one of equivalent circulating density (ECD), equivalent static density (ESD), temperature, hole cleaning, or tripping profiles.

* * * * *